US006556798B2

(12) United States Patent
Rimai et al.

(10) Patent No.: US 6,556,798 B2
(45) Date of Patent: Apr. 29, 2003

(54) METHOD AND APPARATUS FOR USING A CONFORMABLE MEMBER IN A FRICTIONAL DRIVE

(76) Inventors: Donald S. Rimai, NexPress Solutions LLC 1447 St. Paul St., Rochester, NY (US) 14653-7103; David J. Quesnel, NexPress Solutions LLC 1447 St. Paul St., Rochester, NY (US) 14653-7103; John W. May, NexPress Solutions LLC 1447 St. Paul St., Rochester, NY (US) 14653-7103

( * ) Notice: Subject to any disclaimer, the term of this patent is extended or adjusted under 35 U.S.C. 154(b) by 0 days.

(21) Appl. No.: 09/785,853

(22) Filed: Feb. 16, 2001

(65) Prior Publication Data

US 2002/0114642 A1 Aug. 22, 2002

(51) Int. Cl.[7] ..... G03G 15/00; G03G 15/16; G03G 15/20

(52) U.S. Cl. ..... 399/167; 399/297; 399/302; 399/308; 399/328; 399/329

(58) Field of Search ..... 399/167, 297, 399/299, 302, 303, 308, 312, 313, 318, 328, 329, 339

(56) References Cited

U.S. PATENT DOCUMENTS

| | | | | |
|---|---|---|---|---|
| 2,126,705 A | | 8/1938 | Schmidt | |
| 3,242,694 A | | 3/1966 | Schmidt | |
| 3,705,489 A | | 12/1972 | Smoltinger | 57/149 |
| 4,705,489 A | | 11/1987 | Haarmann et al. | 464/69 |
| 4,712,882 A | * | 12/1987 | Baba et al. | |
| 4,735,541 A | | 4/1988 | John | 414/431 |
| 5,136,332 A | * | 8/1992 | Johnson | |
| 5,210,578 A | | 5/1993 | Saito et al. | |
| 5,269,222 A | | 12/1993 | Johnson et al. | 101/228 |
| 5,326,011 A | | 7/1994 | Mager et al. | 226/181 |
| 5,378,302 A | | 1/1995 | Meister | 156/497 |
| 5,390,010 A | | 2/1995 | Yamahata et al. | |
| 5,429,049 A | | 7/1995 | Marozzi et al. | 102/228 |
| 5,505,401 A | | 4/1996 | Lamothe | 242/412.2 |
| 5,522,785 A | | 6/1996 | Kedl et al. | 492/21 |
| 5,542,353 A | | 8/1996 | Cuir et al. | 101/492 |
| 5,617,134 A | | 4/1997 | Lamothe | 347/264 |
| 5,630,583 A | | 5/1997 | Yergenson | 271/119 |
| 5,666,596 A | * | 9/1997 | Yoo | 399/318 X |
| 5,897,247 A | * | 4/1999 | Tombs et al. | 399/308 |
| 5,899,603 A | | 5/1999 | Markovics | 399/167 |
| 5,923,937 A | * | 7/1999 | Thompson et al. | 399/302 |
| 6,035,174 A | * | 3/2000 | Ito et al. | 399/328 |
| 6,088,565 A | * | 7/2000 | Jia et al. | 399/302 |
| 6,137,984 A | * | 10/2000 | Higashi et al. | 399/329 |

* cited by examiner

*Primary Examiner*—Sandra Brase
(74) *Attorney, Agent, or Firm*—Lawrence P. Kessler

(57) ABSTRACT

A method and apparatus for controlling image defects associated with overdrive or underdrive, and variations thereof, in an electrostatographic machine. A speed modifying force is transmitted to a conformable member that deforms in a nip, thereby inducing strains in the surface of the member at the nip which cancel or controllably reduce the strains caused by engagement in the nip. The speed modifying force may be an externally applied drag force or torque, and may be applied using an open loop or a feedback system including an electromagnetic brake, a motor, etc. The speed modifying force may be applied to a conformable member forming the nip through a redundant linkage of the system that employs gears or other suitable mechanisms.

43 Claims, 30 Drawing Sheets

METHOD AND APPARATUS FOR USING A CONFORMABLE MEMBER IN A FRICTIONAL DRIVE

CROSS REFERENCE TO RELATED APPLICATION

This application is related to the following application filed on even date herewith:

U.S. patent application Ser. No. 09/785,913, filed Feb. 16, 2001, entitled METHOD AND APPARATUS FOR CONTROLLING OVERDRIVE IN A FRICTIONALLY DRIVEN SYSTEM INCLUDING A CONFORMABLE MEMBER, in the names of John W. May et al.

FIELD OF THE INVENTION

The invention relates generally to apparatus and methods for using frictional drives including conformable members in electrostatography, and more particularly to the use of frictional drives for transferring and fusing toner images in electrophotography.

BACKGROUND OF THE INVENTION

During the production of color images in an electrostatographic engine in general and in an electrophotographic engine in particular, latent images on photoconductive surfaces are developed by electrostatic attraction of triboelectrically charged colored marking toners. A latent image is created in a color electrophotographic engine by exposing a charged photoconductor (PC) using, for example, a laser beam or LED writer. A plurality of toner images correspond to color separations that will make up a final color image. Individual writing of the color separation latent images must be properly timed so that the various latent images developed from the latent images can be transferred in registry. The toned image separations must then be transferred, in register, to either a receiver or to an intermediate transfer member (ITM). The toner images can be transferred, either sequentially from a plurality of photoconductive elements to a common receiver in proper register, or transferred, sequentially, in proper register, to one or more ITMs from which all images are then transferred to a receiver. Alternately, each photoconductive surface may be associated with its own ITM, which transfers its toned image, in proper register with those of the other ITMs, to a receiver, for the purpose of enhancing the transfer efficiencies as more fully described in T. Tombs et al., U.S. Pat. No. 6,075,965. A toner image on the receiver is thermally fused in a fusing station, typically by passing the receiver through a pressure nip which includes a heated fuser roller and a pressure roller.

A key feature is that transfers must be performed in proper registry. The degree of misregistration that can be tolerated in an acceptable print depends on the image quality specifications. For high image quality color applications, allowable misregistration is typically less than 0.004 inch (0.1 mm) and preferably less than 0.001 inch (0.025 mm). Misregistration is often examined using 10× to 20× loupes to determine relative positions of interpenetrating fiducial line or rosette patterns. In systems involving elastomeric rollers and in particular in machines including compliant incompressible elastomeric rollers as intermediate transfer members, as described by D. Rimai et al., U.S. Pat. No. 5,084,735, the rollers are known to deform as they roll under pressure against a photoconductive surface which may include a web or a drum. These intermediate transfer members also undergo deformations as they roll against receiver materials either as continuous webs or as cut sheets that can be supported by a web or by a backup roller assembly, or by combinations of these. Other prior art disclosing ITMs include U.S. Pat. Nos. 5,110,702; 5,187,526; 5,666,193 and 5,689,787.

Deformation of a conformable member produces a phenomenon known as overdrive. Overdrive refers to the fact that in a nip including an elastomeric roller in mutual nonslip rolling engagement with a relatively rigid roller, the surface speed of the rigid roller exceeds the surface speed of that portion of the elastomeric roller that is far from the nip. Far away from the nip means at a location where any distortions caused by the nip are negligible. The difference in peripheral speeds far from the nip is a result of the strains occurring in the elastomeric roller surface as it approaches and enters the nip.

The concept of overdrive may be better understood by referring to the sketches in FIGS. 1–3.

In FIG. 1, a rigid cylindrical wheel or roller is driven without overdrive. In such an example, each point on the periphery has a velocity $v_0$ given by the product of the angular velocity $\omega$ and the radius r of the roller, i.e., $v_0=\omega r$.

In FIG. 2, a deformable externally driven roller is illustrated. The deformation illustration is exaggerated to facilitate explanation of the concept that when a substantially incompressible compliant member is in a transfer nip, for example, a deformation will occur that causes the radius to be smaller in the nip area but to bulge out at pre-nip and post-nip areas. The dotted line shows the original circular rigid case of FIG. 1 for comparison. The relationship of $v_0=\omega r$ still holds true for points on the roller far from the nip area where there is no deformation. However, this relationship is not true for the points in the pre-nip, nip and post-nip areas. For the roller illustrated in FIG. 2 the speed of a point in the nip area has a higher magnitude than that far from the nip. The speed ratio of the roller surface in the nip divided by the speed at a point far from the nip area characterizes overdrive.

More particularly consider, for example, a conformable roller having an externally driven axle, frictionally driving with negligible drag a movable planar element having a nondeformable surface. If the external radius of the roller far from the nip is r and the peripheral speed of the roller far from the nip is $v_0$, then the surface velocity $v_{nip}$ of the distorted portion of the roller in nonslip contact with the planar surface is given by $$v_{nip}=\lambda\omega r$$

where $\lambda$ is a speed ratio defined by $$\lambda=(v_{nip}/v_0).$$

As defined here, overdrive (or underdrive) is numerically equal to the absolute value of the speed ratio minus one. The value of $\lambda$ is determined principally by an effective Poisson ratio of the roller materials, such as produced by a roller including one or more layers of different materials, and secondarily, by the deformation geometry of the nip produced by the roller engagement. Herein, the term engagement, in reference to a pressure nip formed between two members having operational surfaces, is defined as a nominal total distance the two members are moved towards one another to form the nip, starting from an initial undeformed, barely touching or nominal contact of the operational surfaces. In FIG. 3*a* or 3*b*, for example, the engagement is the distance the axis of rotation of the roller is moved towards the rigid planar element from a nominal initial kissing position. In an example of two parallel rollers, the engagement is an initial separation of the two axes of rotation (defined by a nominal initial kissing position with neither roller distorted) minus the actual separation of the axes after the nip is formed.

The Poisson ratios of high polymers, including elastomeric polymers which for practical purposes are almost incompressible, approach 0.5. The Poisson ratios for highly compressible soft polymeric foams approach zero. It has been shown by K. D. Stack, "Nonlinear Finite Element Model of Axial Variation in Nip Mechanics with Application to Conical Rollers" (Ph.D. Thesis, University of Rochester, Rochester, N.Y. (1995), FIGS. 5–6 and 5–7, pages 81 and 83) that the value of Poisson ratio for $\lambda=1$ is about 0.3 for a roller driving a rigid planar element. For values of Poisson ratio larger than about 0.3, the circumference of the roller distorted by the nip is greater than $2\pi r$, producing overdrive of the planar element with respect to the roller, i.e., the surface speed $v_{nip}$ of the distorted portion of the elastomeric roller within the nip and hence that of the planar element is greater than $v_0$ (i.e., $\lambda>1$). For values of Poisson ratio smaller than about 0.3, the circumference of the elastomeric roller distorted by the nip is less than $2\pi r$, producing underdrive of the planar element with respect to the roller, i.e., the surface speed $v_{nip}$ within the nip is smaller than $v_0$ (i.e., $\lambda<1$). Conversely, if a nondeformable planar element frictionally drives, with negligible drag, a roller having a Poisson ratio less than about 0.3 and causes it to rotate, one may speak of overdrive of the roller with respect to the planar element because the surface speed of the driven roller far from the nip is faster than the speed of the planar element.

With reference to FIG. 3*b*, when a roller transfer member formed of an elastomer and having a Poisson ratio of about 0.45 to about 0.5 is driving a rigid planar element that is moving through a nip and there is no slippage between the roller and the rigid element, the rigid element will be overdriven relative to the speed of the roller far from the nip. Where the roller is formed of a compressible material (i.e., experiences relatively large volume reduction upon compression), such as a foam, the distortion of the roller may be such (see FIG. 3*a*) that the surface of the roller is contracted rather than stretched. Compare FIG. 3*a* with the example of the elastomeric roller of FIG. 3*b* having little or no volume change upon compression, with each roller shown in driving engagement with a rigid planar element. In the example of the highly compressible roller (relatively large volume change upon compression) of FIG. 3*a*, the rigid planar element such as a recording sheet may be subject to an underdrive condition.

For purpose of further illustration, FIG. 3*c* illustrates an exemplary apparatus, indicated by the numeral 5, which includes two counter-rotating rollers 1 and 2 forming a pressure nip 3. Far away from the nip, rollers 1 and 2 have peripheral speeds $v_1$ and $v_2$ respectively. Roller 2 is hard, and roller 1 is conformable, with roller 1 having a strained volume portion sketched by a cross-hatched region 4 in the vicinity of the nip (deformation of the surface of roller 1 is not depicted). Consider that one of the axles P or Q is caused to rotate by the action of an external agent, such as for example a motor, and the other axle is rotated by nonslip friction in the nip. The externally rotated roller is a driving roller, while the other is a (frictionally) driven roller. There are four extreme cases to consider. Case 1: roller 1 is the driving roller, and region 4 is a substantially incompressible elastomer, whereupon as explained above the peripheral velocity $v_2$ of roller 2 far from the nip is greater than the peripheral velocity $v_1$ of roller 1 far from the nip, and roller 2 is said to be overdriven. Case 2: the same materials as case 1, except that roller 2 is the driving roller and roller 1 is the driven roller, whereupon roller 1 is said to be underdriven. Case 3: roller 1 is the driving roller, and region 4 is a compressible resilient foam, whereupon the peripheral velocity $v_2$ of roller 2 far from the nip is smaller than the peripheral velocity $v_1$ of roller 1 far from the nip, and roller 2 is said to be underdriven. Case 4: the same materials as case 3, except that roller 2 is the driving roller and roller 1 is the driven roller, whereupon roller 1 is said to be overdriven. It should be noted that it is common practice to use the term "overdrive" in a generic or nonspecific fashion where either overdrive or underdrive technically exists.

Two materials in contact in a pressure nip may have different thicknesses or different Poisson ratios, so that overdrive at their interface can cause squirming and undesirable stick-slip behavior. For example, when roller transfer members are used to make a color print, such behavior can adversely affect the final image quality, e.g., by causing toner smear or by degrading the mutual registration of color separation images. Moreover, variations in overdrive, which are referred to herein as "differential overdrive" can occur along the length of a pressure nip, such variations being caused, for example, by local changes in engagement, such as produced by runout, or by a lack of parallelism, or by variations of dimensions of the members forming a pressure nip, such as, for example, out-of-round rollers.

During transfer of a toner image in an elastomeric nip exhibiting overdrive or underdrive, an image experiences a length change in the process direction. This change in length causes a distortion in the final image that is objectionable. Change in the writing speed of an electrostatic latent image can correct for overdrive in a simple single-color engine. In a color electrophotographic engine, however, high quality color separations preferably are properly registered to a spatial accuracy comparable with the resolution of the image. In a color electrophotographic engine including a plurality of color stations, proper registration can be achieved by having each color station behave exactly in the same manner with respect to image distortion, e.g. by using rollers made as identical as possible to each other. However, this is expensive and impractical.

Specifically, in order to produce proper electrophotographic images using techniques of the prior art, properties of rollers must not vary outside predetermined acceptable tolerances. The properties include acceptable runout, reproducible and uniform resistivity and dielectric properties, uniform layer thicknesses, parallelism of the members, and responses of the rollers to changes in temperature and humidity experienced during routine operation and machine warm-up. Rollers must also maintain their properties within tolerances during wear processes so that adverse effects are not experienced on the final images as a result of wear. If the effects of wear cannot be compensated, the components must be replaced.

A roller may have variations in the location of the roller surface relative to the roller center as a function of angle during rotation that is commonly known as "runout". Runout may be caused by out of round rollers or by improper centering of an otherwise round roller or both. Runout may vary along the length of a roller. Since the magnitude of the overdrive produced by a deformable roller depends on engagement, runout will temporally and spatially modify the engagement and overdrive during the production of a single image, producing distortions that are objectionable. Runouts of 0.001 inch (0.025 mm) can produce unacceptable registration problems, with runouts of less than 0.0002 inch (0.05 mm) needed to achieve acceptable registration based on measured sensitivity of overdrive to engagement.

Further, rollers used in these applications are made from polymers that can change dimension by absorption of moisture and can change dimensions due to temperature changes. These dimensional changes further complicate the registration of color separations if the changes are not the same in each of the color separation stations included in a color electrostatographic engine.

Methods based on the prior art to produce a workable electrophotographic engine with useful image quality require very expensive manufacturing processes to control the properties and dimensions of the elastomeric rollers.

What is needed is an improved method to alleviate or effectively eliminate image distortion caused by overdrive or underdrive phenomena. As is known, this can be performed by expensive algorithms to the writing scheme using sensors to detect surface speeds of elements during writing and transfer.

There are several disclosures in the prior art that relate to the peripheral speeds of rollers. The T. Miyamoto et al. patent (U.S. Pat. No. 5,519,475) teaches the use of peripheral speed differences between a photoconductive member and an intermediate transfer member (ITM) to reduce the apparent roughness of the surface. The Miyamoto et al. patent describes transfers from the photoconductive members to transfer intermediates where there is a peripheral speed difference of 0.5% to 3%. The K. Tanigawa et al. patent (U.S. Pat. No. 5,438,398) includes disclosure relating to peripheral speeds. In particular, embodiments 6 & 7 of this patent suggest that an intentional peripheral speed difference of 1% helps with "central dropout" defects. The patent notes that transfers of images are intentionally provided with differences in peripheral speeds, but no description is provided relative to overdrive or underdrive as described herein. Another known reference is the M. Yamahata et al. patent (U.S. Pat. No. 5,390,010). This patent specifically addresses the behavior of web photoconductors (PCs) and web ITMs with the central idea to use the same drive motor to drive an intermediate transfer web drive roller which in turn drives the web drive roller of a photoconductive web. Thus, disturbances in surface speed of the ITM web, such as might be caused by engagement of a cleaning station, etc., would be transmitted to the PC web so that there would not be image degradation due to slippage. The Yamahata et al. patent does not discuss how this would affect the writing of an image. There is no disclosure in this patent of transfers where a nip is formed by an elastomeric member and the problems of overdrive or underdrive as it affects image registration. It is clear that this reference addresses the problem of slippage of the ITM relative to the PC when such slippage is caused by disturbances of the system.

The T. Fuchiwaki patent (U.S. Pat. No. 5,790,930) discloses a means for correcting for misregistration between an image-carrying member and an intermediate transfer web due to variations in the length of the two members. It accomplishes this by means of forcing a periodicity in the drive speeds. It can achieve this by means of either two motors or a single motor.

The S. Hwang patent (U.S. Pat. No. 5,376,999) discloses a method of correcting for speed mismatches between a photoconductive element and an intermediate transfer web due to the stretching of that web arising from the tension applied to that web. The strains described in this patent occur outside the nip. The patent discloses allowing one member to slip with respect to the other where both members are driven. There is no discussion of an elastomeric intermediate transfer member in this patent. In an elastomeric intermediate transfer member, the distortions occur due to the presence of stresses applied normally to the surface of the elastomeric member in the nip rather than due to stresses applied parallel to the surface of the elastomeric member.

Problems relating to overdrive are also typically found in fusing stations used in electrostatographic imaging and recording processes such as electrophotographic reproduction, in which a thermoplastic toner powder is used to form a toner image on a receiver, e.g., a sheet of paper or plastic. The toner image is fused to the receiver in a fusing station using heat or pressure, or both heat and pressure. The fuser member can be a roller, belt, or any surface having a suitable shape for fixing thermoplastic toner powder to the receiver. The fusing step in a roller fuser commonly consists of passing the toned receiver between a pair of engaged rollers that produce an area of pressure contact known as a fusing nip. In order to form such nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used. Where the fuser member is in the form of a belt, e.g., a flexible endless belt that passes around the heated roller, it typically has a smooth, hardened outer surface. A belt fuser of this type is well known, as disclosed for example by the Aslam et al. patent (U.S. Pat. No. 5,256,507) wherein the belt is driven by the fuser roller, the belt in turn frictionally rotating a pressure roller which forms a fusing nip between itself and the heated roller behind the belt. Other disclosures of fusing stations utilizing a belt are the Goel et al. patent (U.S. Pat. No. 3,976,370), the Rimai et al. patent (U.S. Pat. No. 5,089,363), and the Aslam et al. patent, (U.S. Pat. No. 5,258,256).

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations including a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a Docutech 135 machine made by the Xerox Corporation. The other uses a compliant fuser roller to form the nip against a hard or relatively non-conformable pressure roller, such as in a Digimaster 9110 machine made by Heidelberg Digital LLC. A fuser roller designated herein as compliant typically includes a conformable layer having a thickness greater than about 2 mm and in some cases exceeding 25 mm. A fuser roller designated herein as hard includes a rigid cylinder which may have a relatively thin polymeric or conformable elastomeric coating, typically less than about 1.25 mm thick. A fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, covered by one or more synthetic layers which typically include polymeric materials made from elastomers.

In an internally heated fuser roller, e.g., as used in a Kodak Ektaprint 3100 Copier/Duplicator and the Kodak 1392 Printer, a source of heat is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity.

An externally heated fuser roller is used, for example, in an Image Source 120 copier, marketed by Eastman Kodak Company, and is heated by surface contact between the fuser roller and one or more heating rollers. Externally heated fuser rollers are also disclosed by the O'Leary patent (U.S. Pat. No. 5,450,183), and the Derimiggio et al. patent (U.S. Pat. No. 4,984,027).

A conformable fuser roller may include a compliant layer of any useful material, such as for example a substantially incompressible elastomer, i.e., the layer having a Poisson ratio approaching 0.5. A substantially incompressible compliant layer including a poly(dimethyl siloxane) elastomer has been disclosed by Chen et al., in the commonly assigned U.S. patent application Ser. No. 08/879,896. Alternatively, the conformable layer may include a relatively compressible resilient foam having a value of Poisson ratio much lower than 0.5. A conformable polyimide foam layer is disclosed by the Lee patent (U.S. Pat. No. 4,791,275). Generally speaking, a conformable or deformable material or roller is defined hereinafter as including compliant materials such as elastomeric materials, or resilient foams.

When a compliant fuser roller and a hard pressure roller which are included in a simplex fusing station are pressed against each other, the compliant layer is deformed and is peripherally stretched in the fusing nip, causing the surface speed of the portion of the compliant roller having a nonslip engagement inside the nip to be faster than the surface speed where distortions produced by the nip are negligible. When, for example, the compliant roller is a driving roller frictionally rotating a relatively non-conformable pressure roller, the pressure roller will rotate faster than if the fuser roller had been non-compliant, i.e., it will be overdriven as discussed previously above (see description of FIGS. 1, 2 and 3). Hereinafter, the terms "hard" and "non-conformable" are used interchangeably, and refer to materials for which the Young's modulus is greater than or equal to 100 MPa.

A substantially incompressible elastomer that is displaced in the fusing nip results in an extra thickness of the compliant layer adjacent to either side of the fusing nip, i.e., pre-nip and post-nip bulges. Since the elastomer is substantially incompressible, the average speed of the compliant layer in these bulges is less than that of the other parts of the conformable layer that are well away from the nip. It may be understood that to produce a frictional drive involving a conformable roller, there is a "lockdown" portion within the contact zone of the nip where there is substantially no slippage between the driving and driven members. Moreover, during the continual formation and relaxation of the pre-nip and post-nip bulges or deformations on the roller as it rotates through the fusing nip, there may be locations in the contact zone of the nip where the surface velocities of the two surfaces in contact differ, i.e., there will be localized slippages. These localized slippages, which may occur just after entry and just before exit of the nip, are a cause of wear which shortens roller life. In order to avoid confusion below, a frictional drive is hereinafter defined as being nonslip if a "lockdown" region exists in the nip wherein the coefficient of friction is sufficiently large to provide a continuous frictional driving linkage between the contacting members within the nip. This definition excludes any localized slippages that may occur in the contact areas near the entry and exit of the nip, because these localized slippages are in opposite directions and any effects on the drive produced by them effectively cancel. In other words, the frictional linkage in the "lockdown" portion is the only factor of importance in determining a driving connection produced by the nip. Hereafter, the words "nonslip", "slip" and "slippage" refer to an externally measured behavior of the members involved in the frictional drive, e.g., as described below in the specification of the present invention.

All rollers suffer from surface wear, especially where the edges of receivers contact the rollers. Since relative motion due to slippage between rollers increases wear, the changes in velocity of the surface of a conformable roller, as it travels into, through, and out of a fusing nip formed with a relatively non-conformable roller, should increase the wear rate of the conformable roller, especially if the conformable roller is the heated fusing member, bearing in mind that a fuser roller typically faces a relatively rough and abrasive paper surface in the nip.

To obtain high quality electrophotographic copier/printer image quality, image defects must be reduced. One type of defect, of particular importance in high quality digital color imaging, is produced by smearing of image dots or other small-scale image features in the fusing nip. Relative motions associated with overdrive, e.g., localized slippage between rollers in a fusing nip, can cause softened toner particles to smear parallel to the direction of motion, resulting for example in elongated dots or blurred edges in an image. Such defects can make a color print unacceptable.

Some roller fusers rely on film splitting of low viscosity oil to enable release of the toner and (hence) receiver from the fuser roller. Relative motion in the fusing nip can disadvantageously disrupt the oil film. This may be acute when fusing a 4-color toner image which requires more fuser oil than a black and white image. An increased amount of fuser oil also increases any tendency for slippage.

Image gloss from a roller fuser is more critically dependent upon the time a toned receiver is in the fusing nip than is the fuser nip pressure. Thus, fuser nip width is a critical parameter and is more important than the nip engagement or load, especially for fusing full color images where the toner stack height is much greater than for a black and white toner image. To rival the glossiness of silver halide technology prints, it is desirable that multicolor toner images have high gloss. To this end, it is desirable to provide a very smooth fusing member contacting the toner particles in the fusing station.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient cushion layer. The extent of the contact area helps establish the length of time that any given portion of the toner image will be in contact with and heated by the fuser roller.

A well known problem in fusing is that paper receiver sheets may not be perfectly rectangular, in part as a result of humidity-induced swelling. After manufacture, paper sheets are typically stacked and conditioned in a humidity controlled environment. During this time, moisture partially penetrates the paper through the edges of the sheets. For typical commercial paper used in electrophotographic machines, moisture penetration is much faster in a direction parallel to the orientation of the long paper fibers. A typical 8.5"×11" paper sheet has long paper fibers oriented substantially parallel to the 11" direction, and moisture therefore penetrates preferentially into the 8.5" edges. This causes the nominally 8.5" edges to expand, so that the 8.5" edges become about 1% to 2% longer than the width of the paper measured across the center of the sheet (parallel to the 11" direction). It is usual practice to feed such paper sheets into a fuser nip with the 8.5" edges parallel to the feeding direction, i.e., perpendicular to the roller axes. Therefore, unless corrective measures are taken, it typically takes a longer time for the swollen 8.5" edges to pass through the fusing nip than it does for the middle of the sheet, which can result in severe paper wrinkling and large scale image defects. In order to provide a correction for this problem, it is known that elastomerically coated fusing station rollers may be manufactured with an axially varying profile obtained by gradually varying the thickness of the elastomeric coating, such that the outer diameter of a roller is greater near the ends of the roller than midway along the length of the roller. Inasmuch as elastomerically induced overdrive increases with increasing engagement, the larger engagements nearer the ends of the roller produce locally larger surface velocities of the paper through the nip, thereby tending to compensate for humidity-induced paper swelling by having all portions of the paper spend substantially the same time passing through the nip. As is also well known, a pressure nip formed between two rollers, at least one of which has an elastomeric coating, does not usually have a uniform pressure distribution measured in the axial direction along the length of the rollers. Rather, owing to the fact that the compressive forces are applied at the ends of the rollers, e.g., to the roller axle, the rollers tend to bow outwards slightly, thereby producing a higher pressure near the ends of the rollers than midway along their length. This also tends to produce greater overdrive towards the ends of the rollers. However, the amount of extra overdrive from roller bending is not normally sufficient to compensate for humidity-induced paper swelling, and therefore a profiling of the thickness of the elastomeric coating in the axial direction, as described above, is often practiced.

To improve image quality of a fused toner image, and also to reduce wear and aging and thereby prolong the life of a conformable roller in a fusing station, there remains a need for inexpensive means to control or eliminate overdrive-induced wear of the roller. There also remains a need to prevent or reduce overdrive-induced image defects, either large-scale or small-scale, when using a conformable roller in a fusing station.

In electrostatography in general and, more particularly in electrophotography, the elimination of overdrive or underdrive in a conformable nip is desirable because overdrive and variations in overdrive can cause image defects such as misregistration of color separation images objectionable to the customer. There is a need to provide a simple, inexpensive mechanism to control or eliminate overdrive related registration artifacts.

SUMMARY OF THE INVENTION

An important aspect of this invention includes a method and apparatus to control image defects related to transfer of toner images in an electrostatographic machine, including defects such as misregistration associated with overdrive or underdrive and variations in overdrive and underdrive in a transfer station including a toner image bearing member. In this aspect of the invention, a speed modifying force is applied to a conformable transfer member that forms a nip for transfer of an image, thereby inducing strains in the surface of the member at the nip which will cancel or controllably reduce the strains caused by the engagement of the conformable nip. This lateral force, which is directed along the direction of motion in the nip, may be an externally applied drag force such as for example a friction force that either opposes motion of the elements engaged at the nip (positive drag), or of the opposite sign which urges faster motion of the elements engaged at the nip (negative drag), and may be applied using an open loop or a feedback system including an electromagnetic brake, a motor, etc. (Note that any system involving one or more pressure nips will generally have an inherent drag, e.g., due to friction, which is to be distinguished from an applied drag force of the invention). Alternatively, the speed modifying force may be produced by a controllable torque applied for example by a torque generator to an axle of a roller included in a frictionally driven system of rollers. In a preferred embodiment, the speed modifying force is applied to an elastomeric member forming the nip through a redundant linkage of the system that employs gears or other suitable mechanisms. In this latter case, the action of a frictionally engaged nip with its overdrive working against a redundant mechanical linkage will cause a drag force to develop which is of precisely the correct sign and magnitude to cancel the surface strain responsible for the overdrive normally produced by the frictional engagement of the operational surfaces of the members forming the nip. A transfer system according to the present invention may have a steady state overdrive or underdrive, including the possibility of zero overdrive. The control of overdrive or underdrive is preferably independent of the extent of engagement and detailed material properties.

Another aspect of this invention includes a similar method and apparatus for providing, in a station for thermal fusing of toner images in an electrostatographic machine, a speed modifying force controllably applied to a drivingly and frictionally moved member included in a fusing nip, the fusing nip utilizing a conformable roller. The speed modifying force, which may be produced by a drag or torque, is controllably applied to reduce wear of the conformable roller and also to control image defects related to thermal fusing of toner images, such as image smear including the smearing of halftone dots. A fusing system according to the present invention preferably has a negligible or zero amount of overdrive or underdrive in the fusing nip, and the control of overdrive or underdrive in the fusing nip is preferably independent of the extent of engagement and detailed material properties.

BRIEF DESCRIPTION OF THE DRAWINGS

The invention and its objects and advantages will become apparent upon reading the following detailed description and upon reference to the drawings, in which.

DETAILED DESCRIPTION OF THE PREFERRED EMBODIMENTS

Figure 1:
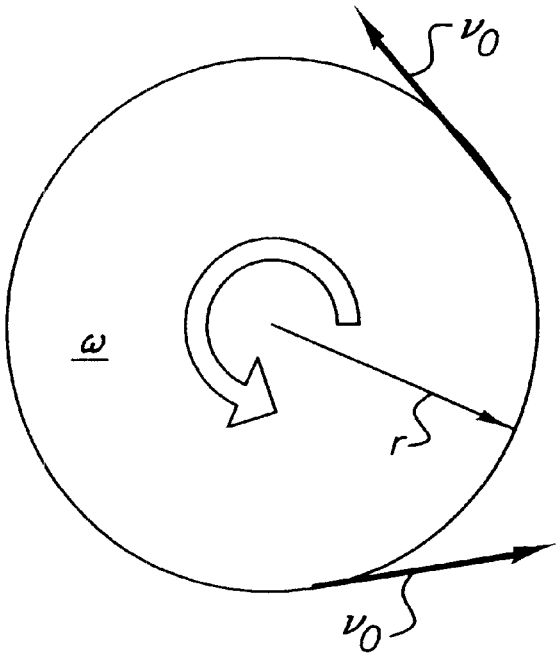
FIG. 1 is a schematic illustration of a rigid rotating roller.
Figure 2:
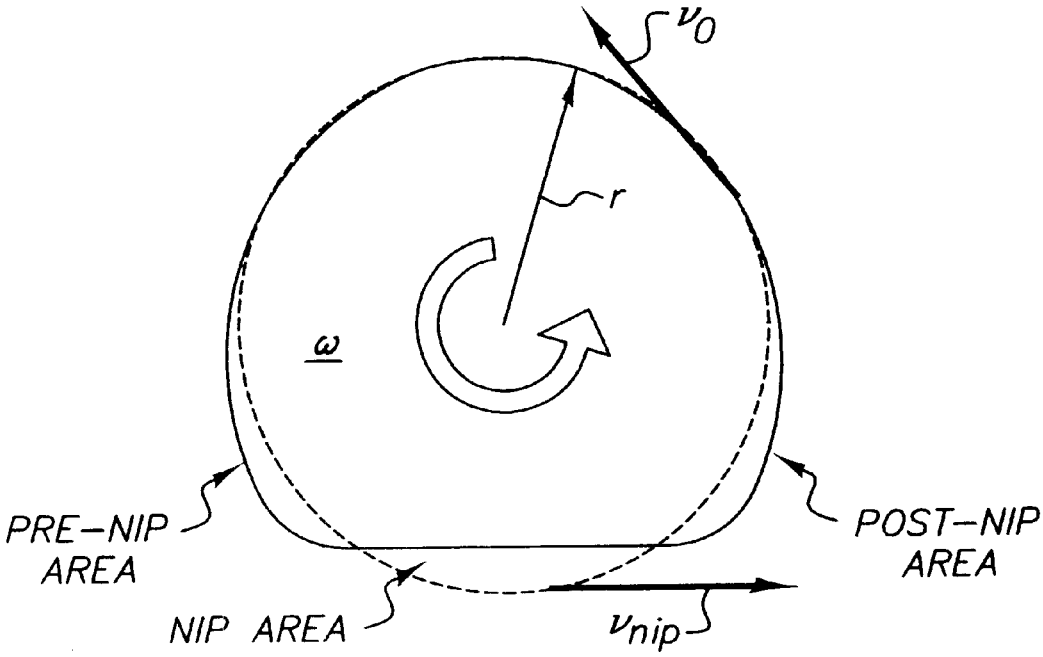
FIG. 2 is a schematic illustration of an elastomeric rotating roller that is deformed when forming a nip (exaggerated deformation shown)
Figure 3A:
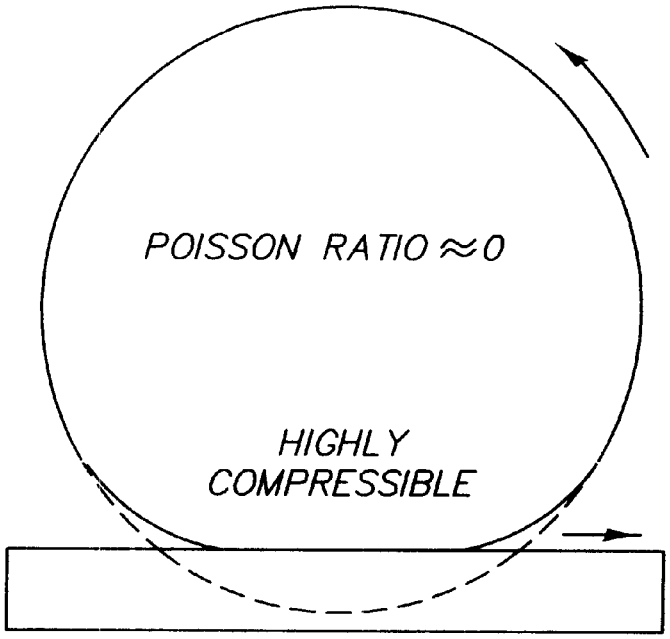
FIGS. 3*a* and 3*b* are respective schematic illustrations, each of a rotating elastomeric roller in engagement with a rigid planar element for the cases respectively of a highly compressible elastomeric roller material such as a foam material and an incompressible elastomeric roller material, wherein the incompressible elastomeric material substantially retains an equal volume between strained and unstrained states.
Figure 3B:
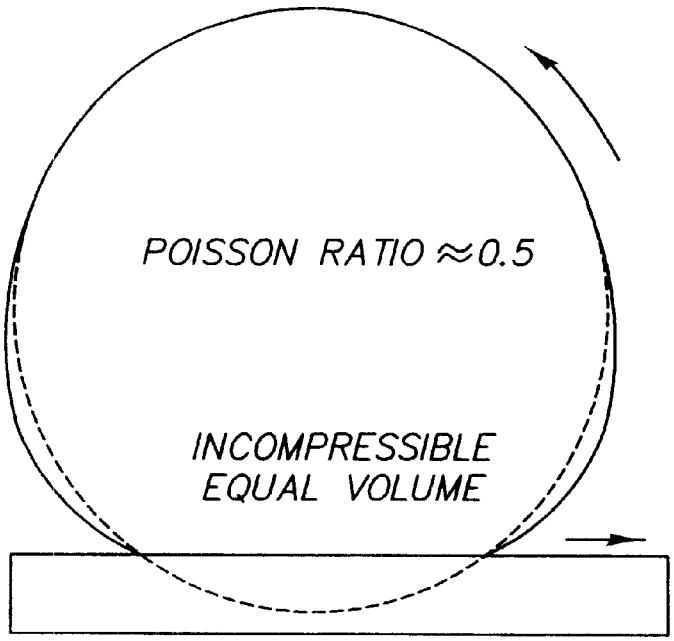
Figure 3C:
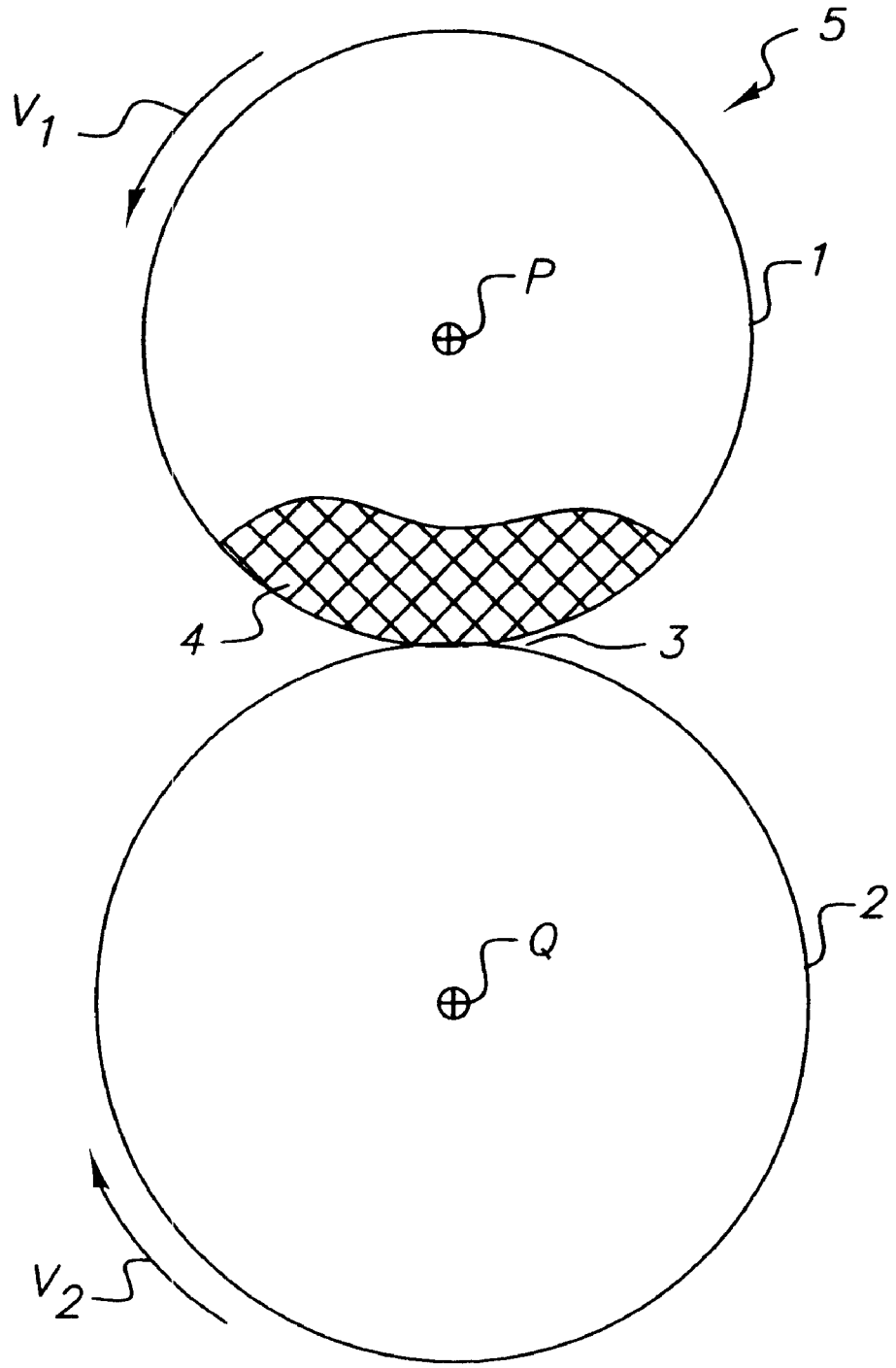
FIG. 3*c* is a schematic illustration of a conformable roller in nip engagement with a counter-rotating hard roller.

This invention discloses a general scheme, with applications useful in an electrostatographic machine, e.g., in transfer and fusing, to compensate for overdrive or underdrive that occurs when cylindrically symmetric conformable rollers, e.g., elastomeric rollers, are made to roll against surfaces that cause them to deform, thereby inducing strains in their surfaces and hence overdrive or underdrive. The difference in speed is a result of strains occurring in a conformable roller surface as it approaches and enters a nip. External drag forces and external drag torques transmitted through a nip also cause strains in the surface of a conformable roller. Application of the appropriate external drag force or torque to a nip can produce a strain of the appropriate sign and magnitude such that the net strain on the surface in the nip is zero thereby canceling the overdrive intrinsic to the nip. In cases where a definite value of overdrive is desired, a specific value may be obtained according to the invention by adjusting the value of the drag force or torque that is applied.

Generally, the invention may be used for any system of rotatable members, e.g., a system of rollers which includes one or more frictionally driven rollers having their operational surfaces in mutual nonslip engagement with one another, the rotations of which are produced by a primary driving element which may be a roller, a web or other suitable member in frictional driving relation to one of the driven rollers. The drive for the primary element originates from a source outside of the system of rotatable members. In an electrostatographic machine, e.g., an electrophotographic reproduction device, the system of rollers may for example be included in a toner transfer station including a toner image bearing member, or in a toner fusing station. A drag force or a torque applied to any selected roller of the one or more driven rollers affects equally all of the nips between the selected roller and the primary driving element. Conversely, a drag force or torque applied to this selected roller does not affect the speed ratios of nips involving rollers that are driven by the selected roller. Thus, the net speed modifying force acting on all of the driven rollers between the selected roller and the primary driving element is the sum of all of the lateral forces, both positive and negative, produced by drag forces and torques on the one or more of the driven rollers between the selected roller and the primary driving element. A predetermined amount of drag force or torque may be applied to just one of the driven rollers, or it maybe divided among the one or more driven rollers. Moreover, these drag forces or torques may be positive or negative, where a positive drag force or a positive torque is defined to oppose the direction of the frictional drive, and a negative drag or a negative torque by definition augments the frictional drive in the same direction as the drive.

The application of suitable speed modifying forces, i.e., drag forces or torques, to a nip can control the overdrive to acceptable levels. The speed modifying forces can be applied to a member of a frictional drive train by a speed modifying device (SMD), the SMD including any mechanism known in the art such as, but not limited to, clutches, friction pads, brushes, brakes, motors, electrical windings, actuators, torque generators, magnetics, electric eddy current generators, piezoelectrics, hydraulics, or pneumatics. The magnitude of the forces and torques may be set manually or through an automatic system such as a servo system designed to directly control the overdrive in the system to specific values. Sensors may be used in such servo systems to assess the value of the force or torque needed and so adjust the appropriate prime mover through a feedback loop.

Although the various transfer embodiments will be described with reference to conformable and preferably compliant elastomeric intermediate transfer rollers and more generally to conformable intermediate transfer members (roller or belt), it will be appreciated that the electrostatographic primary image forming member may be made in the form of a compliant elastomeric roller and an image formed thereon transferred directly to a receiver sheet that is supported on a platen or a preferably non-compliant transfer roller while being driven through the transfer nip. More generally, an electrostatographic primary image forming member may be a conformable roller or a non-conformable (hard) roller and the platen or transfer roller may have any amount of compliancy when used for direct transfer of a toner image from a primary imaging member to a receiver sheet.

Figure 4A:
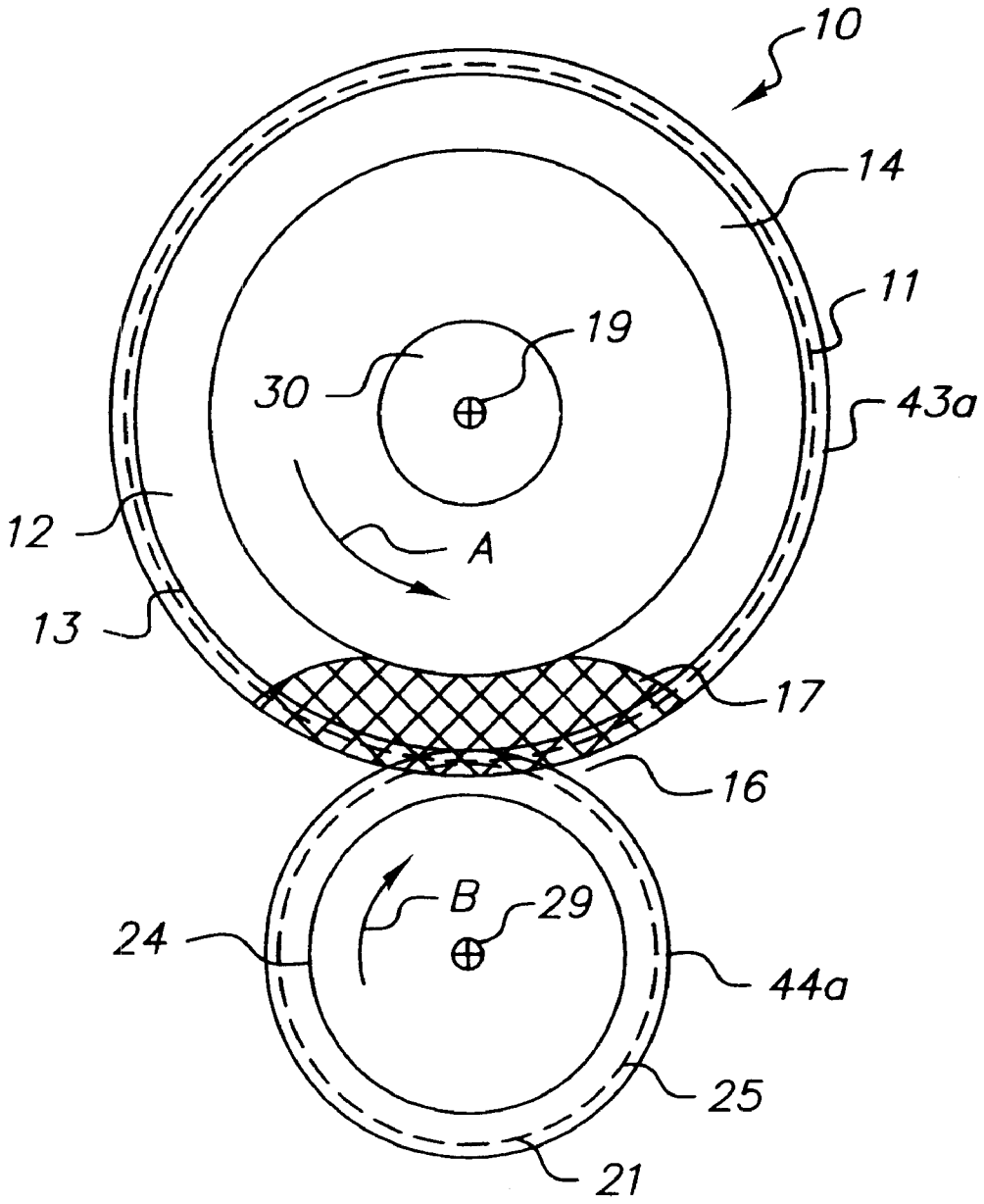
FIGS. 4*a* and 4*b* are schematic side and front elevational views respectively of a transfer apparatus incorporating a first embodiment of the invention.
Figure 4B:
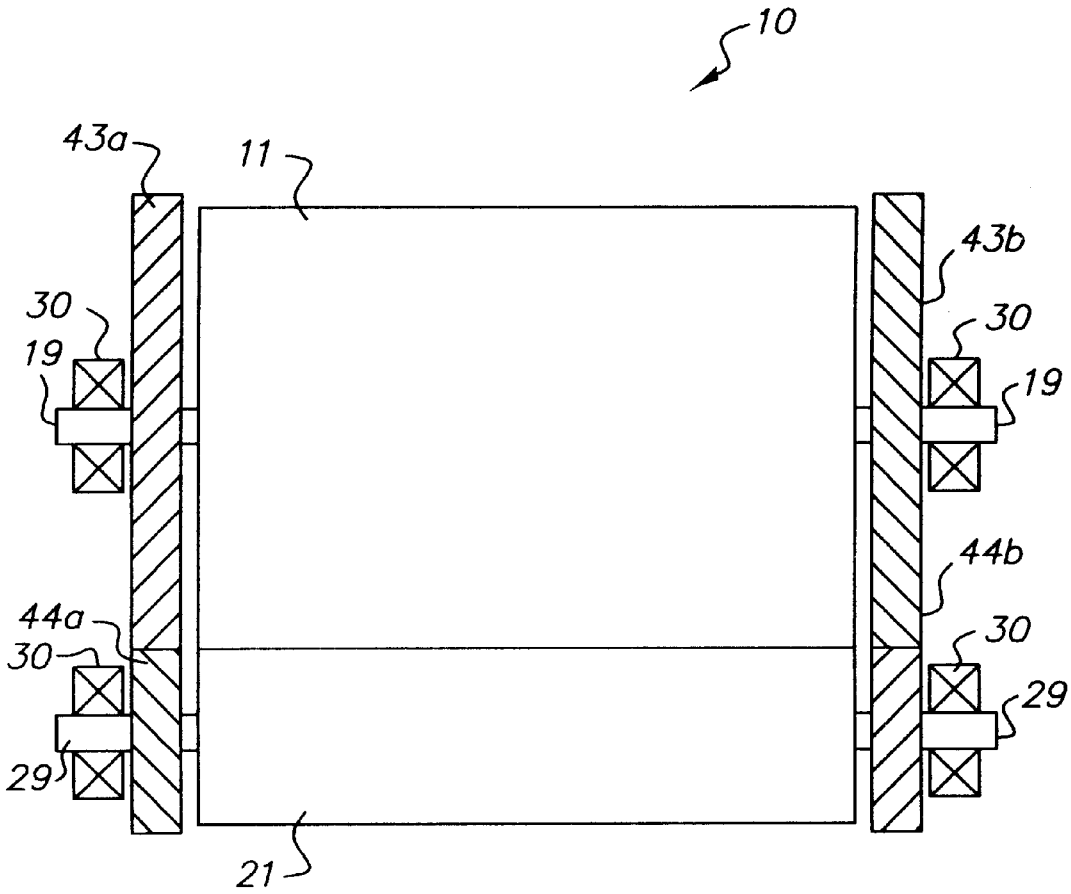
Figure 8A:
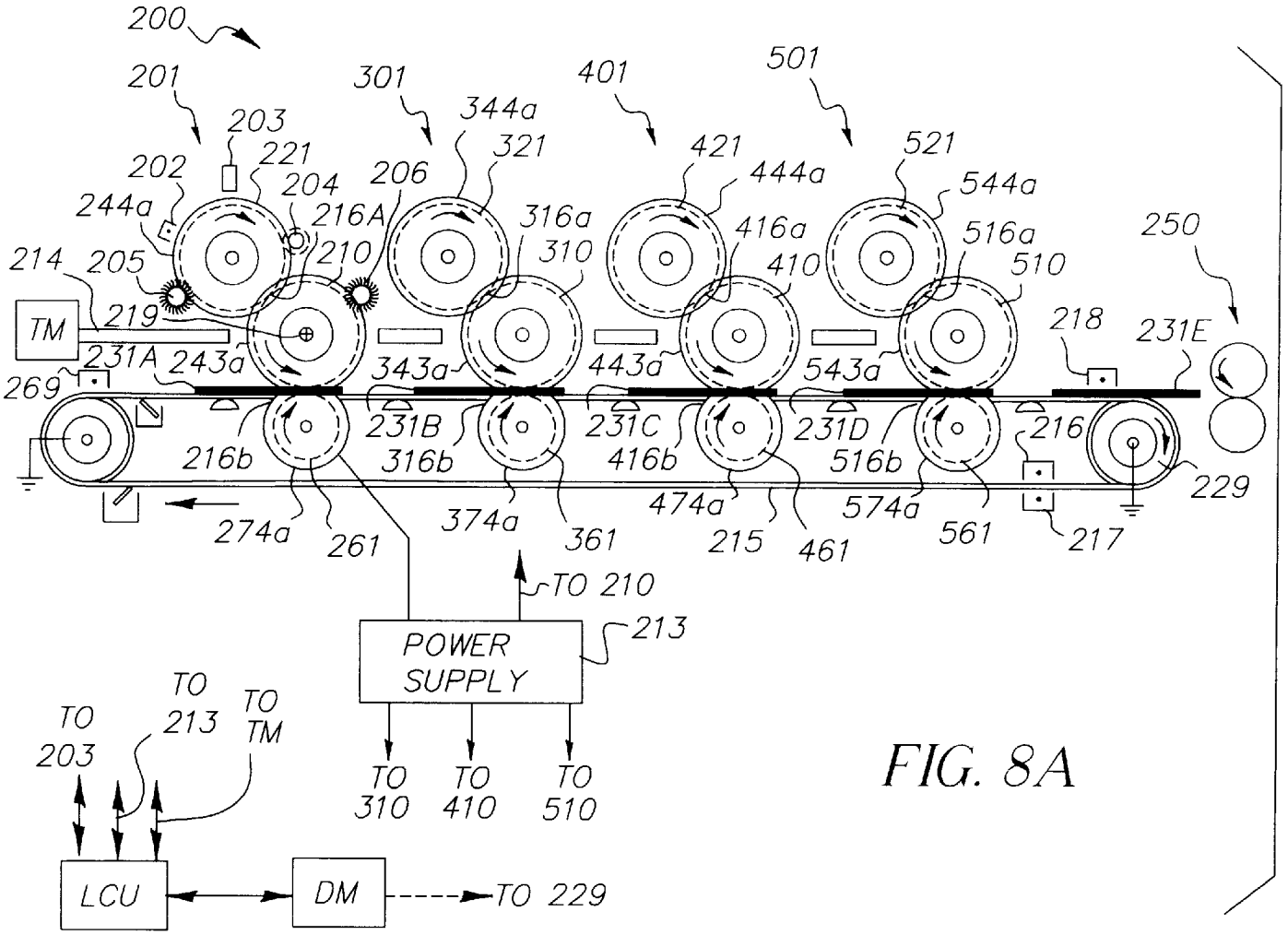
FIG. 8*a* is a schematic side elevational view of a transfer apparatus incorporating yet still another embodiment of the apparatus of the invention.

FIGS. 4*a* and 4*b* show a first embodiment of the invention wherein an image transfer assembly 10 includes a conformable intermediate transfer roller (ITR) 11 that is engaged to form a nip 16 with a photoconductive roller 21 or other primary image-forming member such as used in electrographic recording or other types of recording or printing. In lieu of a roller, a web type primary image forming member (PIFM) may be used with a backup roller. The conformable roller 11 may be a compliant elastomeric roller in which the elastomeric material is for all practical purposes incompressible, or it may be a roller having a compressible resilient foam layer. Various stations (not shown) but similar to that described below for the embodiment of FIG. 8*a* are positioned about the photoconductive roller 21 as is well known to form an electrostatic image, develop the image with dry pigmented insulative toner particles and to transfer the toner image in the nip 16 to the outer surface of the ITR 11. An electrical bias to the ITR is preferably used to assist transfer. Additional photoconductive rollers may also be located about the periphery of ITR 11 and form other nips for transferring toner of other pigments or physical characteristics, i.e., the other toner may be unpigmented or can include magnetic toner particles. A receiver sheet (not shown) may be brought into engagement with the ITR 11 at a secondary nip (not shown) to transfer a toner image to the receiver, using for example a backup or transfer roller frictionally driven by ITR 11 as is well known.

The photoconductive roller 21 is composed of a metallic core 24 that is coated with a relatively rigid photoconductive layer included at or near the surface 25 of roller 21. The photoconductive layer may be composed of one or plural layers as is well known and may be covered by a thin insulating layer (not shown). Alternatively, the photoconductive layer may be included in a replaceable removable seamless tubular sleeve surrounding core member 24. The intermediate transfer roller (ITR) 11 has a metallic core 14, either solid or as a shell. On core 14 is coated or formed thereon a preferably relatively compliant and elastomeric layer 12 whose thickness is between 0.2 mm and 20 mm and the layer preferably has a Young's modulus between 0.5 MPa and 100 MPa and more preferably a Young's modulus between 1 MPa and 50 MPa and an electrical bulk or volume resistivity between $10^6$ and $10^{12}$ ohm-cm, preferably $10^7$ to $10^9$ ohm-cm. Alternatively, layer 12 may be included in a replaceable removable seamless tubular sleeve on core member 14. The roller and its various layers and structures are not drawn to scale to facilitate understanding of this description. This compliant elastomeric layer 12 preferably has a relatively hard surface or covering layer(s) 13 to provide functionality as described in the Rimai, et al. patent (U.S. Pat. No. 5,666,193) and in the Tombs et al. patent (U.S. Pat. No. 5,689,787) and the Vreeland et al. patent (U.S. Pat. No. 5,714,288). The hard covering layer is relatively thin (0.1 micrometer to 20 micrometers in thickness) and has a Young's modulus greater than 50 MPa and preferably greater than 100 MPa.

Young's modulus is determined on a macroscopic size sample of the same material using standard techniques, such as by measuring the strain of the sample under an applied stress using a commercial device such as an Instron Tensile tester and extrapolating the slope of the curve back to zero applied stress. The material covering the core 14 of ITR 11 (i.e., including the compliant elastomeric layer and the preferred hard outer coating 13 covering the compliant layer as a composite member) is preferably incompressible and preferably has a Poisson ratio of between or in the range of approximately 0.45 to 0.50. The Poisson ratio of this composite material may be determined by applying a load to the material and measuring the deflection of the material in a direction perpendicular to the direction of the applied load and dividing this deflection amount by the deflection in the direction of the load. Since the latter measurement is a negative value a negative of the obtained resulting division result is taken. In determining Poisson ratio of the compliant roller it will be understood that such Poisson ratio is that of the composite material forming the roller from and including the outer layer radially inward through the compliant layer and up to but not including a non-elastomeric element such as the core or other non-elastomeric element. A non-elastomeric element is defined as a member having a Young's modulus greater than 100 MPa.

Rollers 11 and 21 are mutually frictionally driven by a pressure contact of either of the rollers to a moving member (not shown) which may be a roller or a web, and included, e.g., in a transfer station. The moving member preferably contacts and frictionally drives ITM 21. The frictionally driven rollers 11 and 21 supported by axial shafts 19 and 29 are rotatively connected for rotation (in the directions indicated by arrows A, B) such as by equivalent sets of gears 43*a*, 44*a* and 43*b*, 44*b*, preferably spur gears, that mesh or engage to achieve a rotation rate such that the surface speeds of the two rollers far from the nip 16 are determined by a gear ratio provided between gears 43*a* and 43*b* and gears 44*a* and 44*b*, respectively. The gear ratio can be set so that the surface speeds of the two rollers 11 and 21 are the substantially the same at locations far from the nip 16 where each roller has a nominally undistorted shape, i.e., the speed ratio is then equal to 1.000. Alternatively, the speed ratio may be set at any predetermined value by an appropriate choice of the operational gear ratio, providing that a nonslip frictional linkage exists in nip 16 between the surfaces of rollers 11 and 21.

To minimize the effects of differential overdrive, the gear ratio is set close to that which would be produced by the natural speed ratio of the two contacting rollers, i.e., set to almost match the overdrive or underdrive that can be measured at the same engagement in the absence of redundant gearing. In such a case, it is important not to exactly match the natural speed ratio so as to avoid gear chatter.

As noted above, there is a gearing connection by gears 43*a,* 44*a* and 43*b,* 44*b* between the respective drive shafts 19 and 29 to which the gears and rollers 11, 21 are respectively fixed for rotation. Each shaft 19 and 29 is shown having two respective gears fixed thereto one adjacent each end of rollers 11 and 21. However, only one gear on each shaft need be provided. The shafts 19, 29 are respectively supported for rotation by suitable bearings 30 as is well known. The gearing connection between the shafts 19, 29 constitutes a redundant linkage since there is provided a nonslipping frictional drive between the surfaces of the rollers 11 and 21 at the nip 16. The frictional drive imparted to one of the rollers, say roller 11 for example, serves to drive roller 11 and to adequately drive roller 21 through frictional engagement at the nip. A logic and control unit LCU (not shown) provides control of the elements used to create the images on the photoconductor roller 21 and preferably also provides control over the frictional drive imparted to one of the rollers. The actual surface speeds of rollers 11 and 21 are controllable by adjusting the speed of the moving element such as a web or a driving roller that frictionally drives one or the other of the driven rollers 11 and 21, e.g., through a feedback loop using for example a sensor (not shown) to sense the movement of fiducial marks placed for example on the surface of one of the rollers 11 and 21, preferably on roller 21, the sensor sending signals to the LCU and thence to a variable speed motor (not shown) that controls the speed of the driving moving element, thereby varying the rotational rates of shafts 19 and 29. Fiducial marks placed on roller 21 may be formed by photoconductive imaging and toning. Alternatively, the fiducial marks may be provided on a wheel secured coaxially to either of shafts 19 and 29, as for example described in detail below for embodiment 200" of FIG. 13*a.*

The inventors have found that the additional gearing connection between the rollers in the case of a compliant ITR provides a constraint to the rotation of the ITR. For purpose of illustration, let it be assumed that the gear ratio is such that the speed ratio imposed by the gears equals 1 (overdrive is completely suppressed). The rollers are engaged under pressure at nip 16 and the engagement causes a deformed zone or region 17 in the compliant ITR 11. This deformed region stretches the surface of the compliant elastomeric ITR before the compliant ITR's surface comes into nonslip contact with the surface 25. Nevertheless, the gearing constraint induces a drag force in the surface of the ITR roller 11. This drag force deforms the elastomeric layer 12 in such a way as to cause the tensile strain in covering layer 13 to be reduced to substantially zero at the critical location where the ITR's surface is about to lock down onto the surface of the photoconductive roller entering the nip 16. In this case, the tensile strain in layer 13 at the interface of layer 13 with the photoconductive roller 21 is substantially zero in the entire lockdown region, consistent with a speed ratio of 1. In effect, an equilibrium is established such that the induced drag cancels the overdrive that would have been associated with the engagement of the elastomer in the absence of the gears. The system is self-correcting when used in this constrained rotation preferred embodiment. Moreover, it will be evident that effects due to differential overdrive are advantageously effectively eliminated.

As an alternative to a frictional drive of one of rollers 11 and 21, a variable speed motor drive or other form of controllably variable mechanical drive (not shown in FIGS. 4*a* and 4*b*) may be provided directly to one of the shafts 19 or 29 supporting the gears and rollers, or the motor drive may be provided through a gear drive to the gears supported on one of these shafts. Preferably the motor drive is to the ITR 11. A logic and control unit LCU (not shown) provides control over the motor and control of the elements used to create the images on the photoconductor roller 21. Since the gear ratio between gears 43*a* and 44*a* is a predetermined known quantity, the actual surface speeds of the driving and driven rollers, e.g., rollers 11 and 21 respectively, are controllable to a preset value by adjusting the variable speed motor drive, e.g., through a feedback loop using for example a sensor (not shown) to sense the movement of fiducial marks placed for example on the surface of one of the rollers 11 and 21, preferably roller 21, the sensor sending signals to the LCU and thence to the motor, thereby varying the rotational rate of shaft 19. Fiducial marks placed on roller 21 may be formed by photoconductive imaging and toning. Alternatively, the fiducial marks may be provided on a wheel secured coaxially to either of shafts 19 and 29, as for example described in detail below for embodiment 200" of FIG. 13*a.*

Figure 4C:
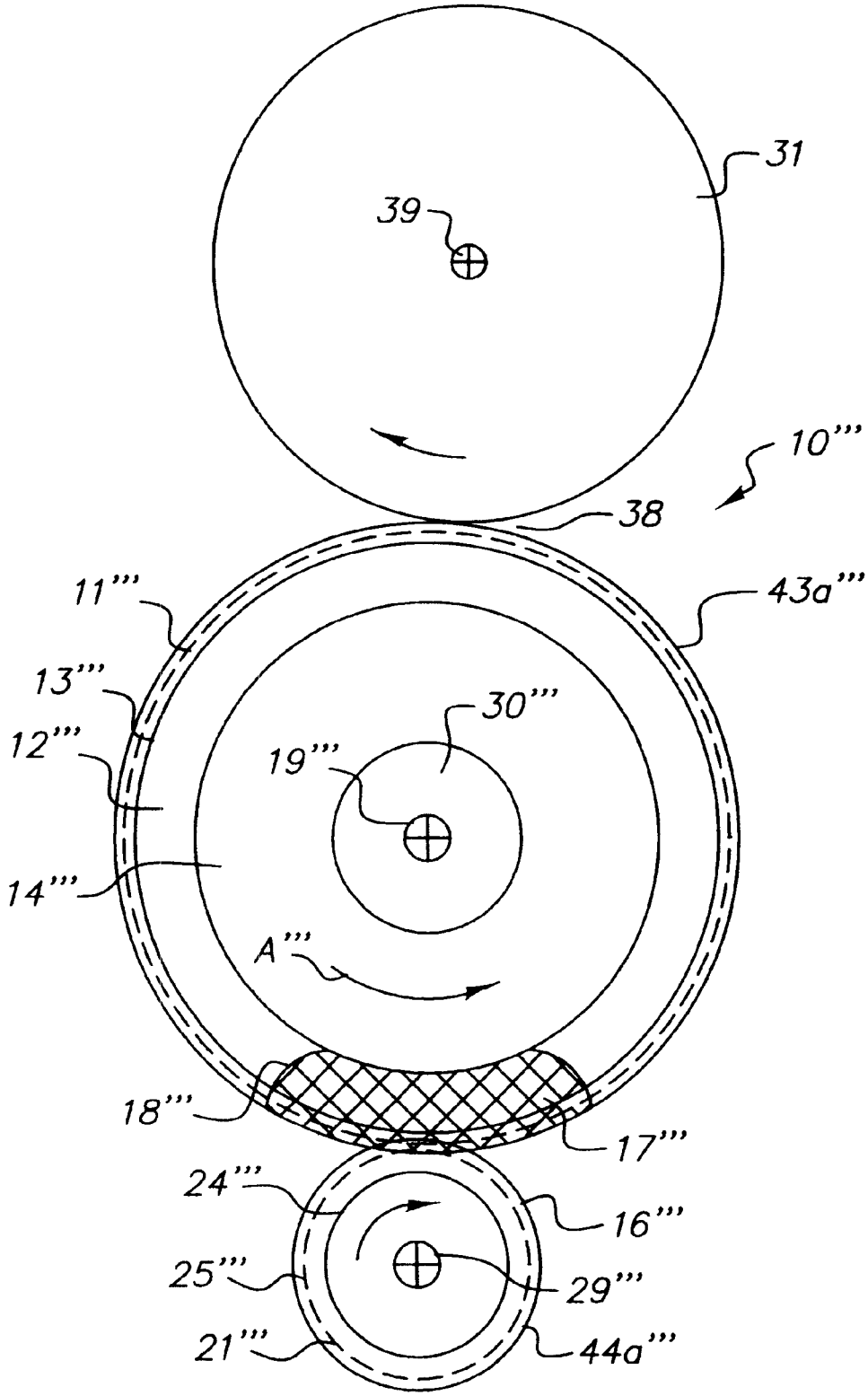
FIGS. 4*c* and 4*d* are schematic side and front elevational views respectively of a transfer apparatus incorporating an alternative to the embodiment of the invention shown in FIGS. 4*a* and 4*b;*
Figure 4D:
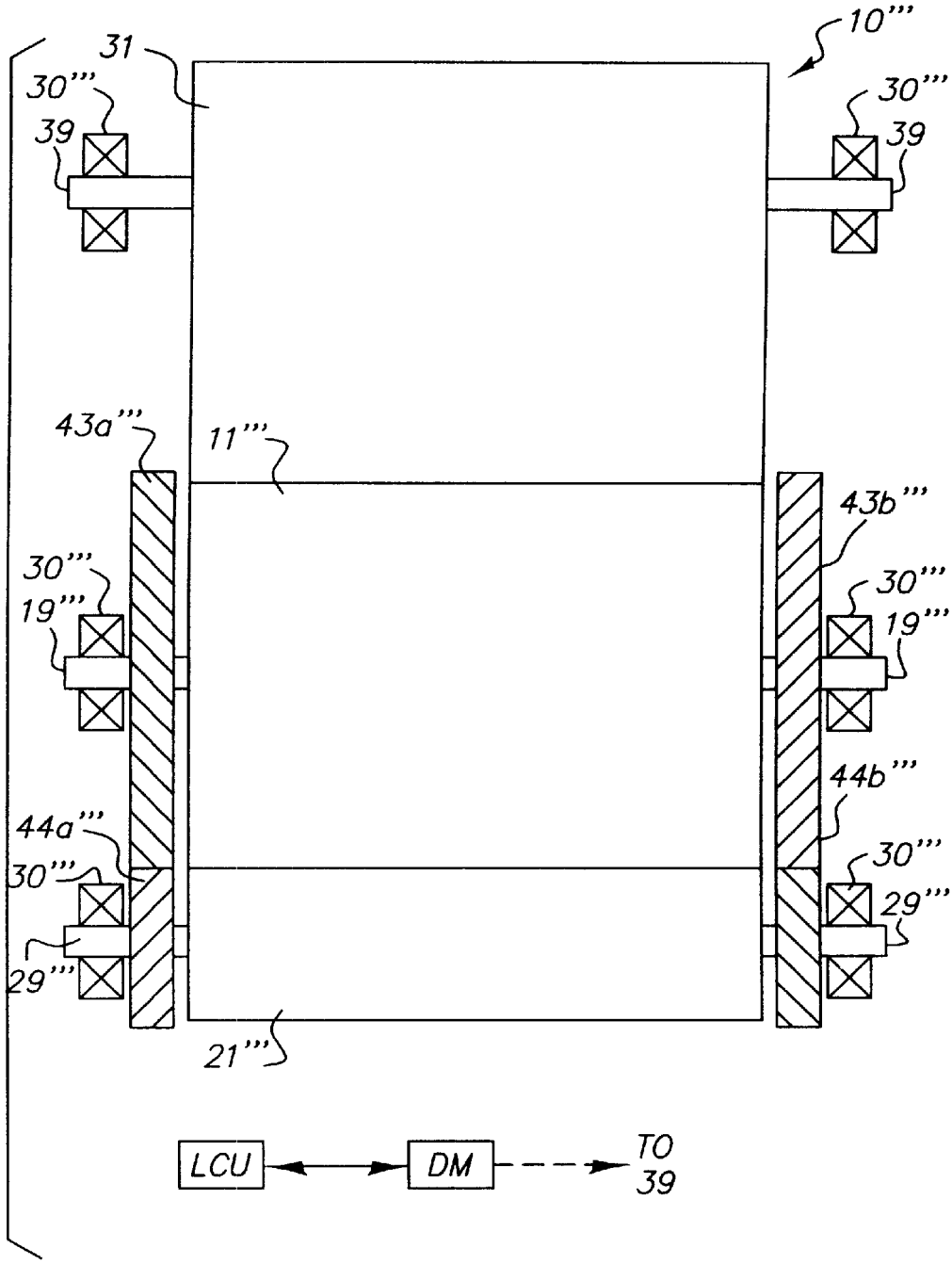

Referring now to FIGS. 4*c* and 4*d,* an alternative to the first embodiment is shown as 10'", wherein triple-primed entities (''') of transfer station 10''' are in all respects similar to corresponding unprimed entities in FIGS. 4*a* and 4*b.* A transfer roller 31 rotating on shaft 39 is in pressure contact with ITR 11''' to form nip 38. Roller 31 is a driving roller, rotated by a variable speed motor (not shown), and frictionally driving the two-roller system including ITR 11''' and photoconductive roller 21'''. A toner image formed on roller 21''' and previously transferred from roller 21''' to ITR 11''' may be transferred, preferably electrostatically, to a receiver sheet (not shown) passed into and moved frictionally through nip 38 by the concerted motions of rollers 31 and 11'''. Alternatively, the receiver sheet may be held tightly, e.g., electrostatically or by means of grippers, on the surface of roller 31. Transfer roller 31 includes a conductive core (not shown) and is provided with a transfer voltage by connecting it to a power supply (not shown). The two-roller system including driven rollers ITR 11''' and photoconductive roller 21''' may be used to deposit a toner image of one color on the receiver, whereupon the receiver may be transported around to one or more of other similar two-roller systems (not shown) in frictional contact with and driven by roller 31, where each of the other two-roller systems can be used to transfer a different color toner image in registry with the toner images previously transferred to the receiver, thereby building up a full color toner image on the receiver. The receiver is subsequently detached from roller 31 and sent to a fusing station (not shown).

As described above in reference to FIGS. 4*a* and 4*b,* a gear ratio of the redundant linkage provided by the gears 43*a*''', 44*a*'''and 43*b*''', 44*b*''' may be given any suitable value, this value depending for example upon the material thicknesses and properties, including the coefficient of friction in nip 16''' which must be sufficient to maintain a nonslip frictional drive. To minimize the effects of differential overdrive, the gear ratio is set close to, but not exactly equal to, that which would be produced by the natural speed ratio of the two contacting rollers, i.e., set to almost match the overdrive or underdrive that can be measured in the absence of redundant gearing at the same engagement. Transfer roller 31, in contact with the conformable ITR 11''', is preferably a hard roller but may alternatively be conformable, as is well known. The conformable ITR 11''' preferably includes a substantially incompressible elastomeric layer 12''' which is similar to layer 12. Alternatively, layer 12''' may include a compressible resilient foam. It will be evident that the materials chosen for layer 12''' and the outer layer(s) of roller 31 (not illustrated) will dictate the speed ratio associated with nip 38, i.e., roller 11''' may be overdriven or underdriven by the driving roller 31.

A logic and control unit (LCU) provides control of the elements used to create the images on the photoconductor roller 21''' and also provides control over the frictional drive imparted to ITR 11'''. The actual surface speeds of rollers 11''' and 21''' are controllable by adjusting the rotational rate of shaft 39, e.g., through a feedback loop using for example a sensor (not shown) to sense the movement of fiducial marks placed for example on the surface of one of the rollers 11''' and 21''', preferably roller 21'''. The sensor sends signals to the LCU and thence to a drive motor DM that controls the peripheral speed of roller 31, thereby varying the rotational rates of shafts 19''' and 29'''. Alternatively, the fiducial marks may be provided on a wheel secured coaxially to either of shafts 19''' and 29''', as for example described in detail below for embodiment 200''' of FIG. 13*a*. When there are also one or more other similar two-roller systems in frictional contact with and simultaneously driven by roller 31, as described above, a speed modifying force, caused by an applied drag force or a torque applied to ITR 11''', is used to modify the rotational rate of roller 11''' and thereby that of roller 21''', using a sensor to send signals to the LCU which then uses feedback to adjust the rotational rate of roller 11'''. Sensors are used in similar fashion to control each of the other two-roller systems by an applied speed modifying force, so that good registration can be effected in a full color toner image produced on the receiver.

Gearing or otherwise constraining a nip between rotatable elements that are otherwise frictionally driven is not intuitive. On first thought, the redundancy associated with such gearing or constraint might appear to cause substantial problems. However, the invention in its broader aspects is not limited to redundant gearing relationship and contemplates methods and apparatus to correct for the effects of overdrive and underdrive in both an open loop and self-compensating closed loop manner. Closed loop applications include the possibility of electronic feedback with sensors or a preferred embodiment using an entirely mechanical feedback system. A closed loop system has the advantage of being able to correct for differential overdrive, e.g., due to run out etc. as noted above, with corrections done in real time in an ideal system. The rotatable elements of the subject invention are shown as both rollers and webs in the examples of this description but may also include drums, wheels, rings, cylinders, belts, segmented platens, and platen-like surfaces.

An electrostatographic machine may include a system of two rollers (not illustrated but designated as G and H in the following descriptive analysis) wherein each roller includes an axial shaft and there is a frictional drive in a pressure nip between the rollers. According to the subject invention, a redundant gearing linkage may be provided between rollers G and H in order to provide a self-compensating drag force in the nip so as to control overdrive and differential overdrive. Either of the rollers G and H may be a driving roller, e.g., provided with a motor to rotate its shaft, or alternatively either of rollers G and H is driven by frictional contact with another rotatable element, e.g., a roller, a web in the form of a loop or other device. It will be evident that the invention can be usefully applied to the following cases: roller G or H is conformable; rollers G and H are both conformable. Similarly, an electrostatographic machine may include a system of three rollers (not illustrated but designated as J, K, and L in this descriptive analysis) wherein each roller includes an axial shaft and there is a frictional drive including pressure nips between rollers J and K and between K and L. According to the subject invention, redundant gearing linkages may be provided, between rollers J and K and also between K and L, in order to provide a self-compensating drag force in each nip. It is also provided by the invention that a redundant gearing linkage may be provided between rollers J and L with no gearing connection to roller K. Any of the three rollers J, K, L may be a driving roller, e.g., provided with a motor to rotate its shaft. It will be evident that the invention can be usefully applied to any of the following cases: roller K is conformable; rollers J and K, K and L, or J and L are conformable; rollers J, K and L are all conformable.

Figure 5B:
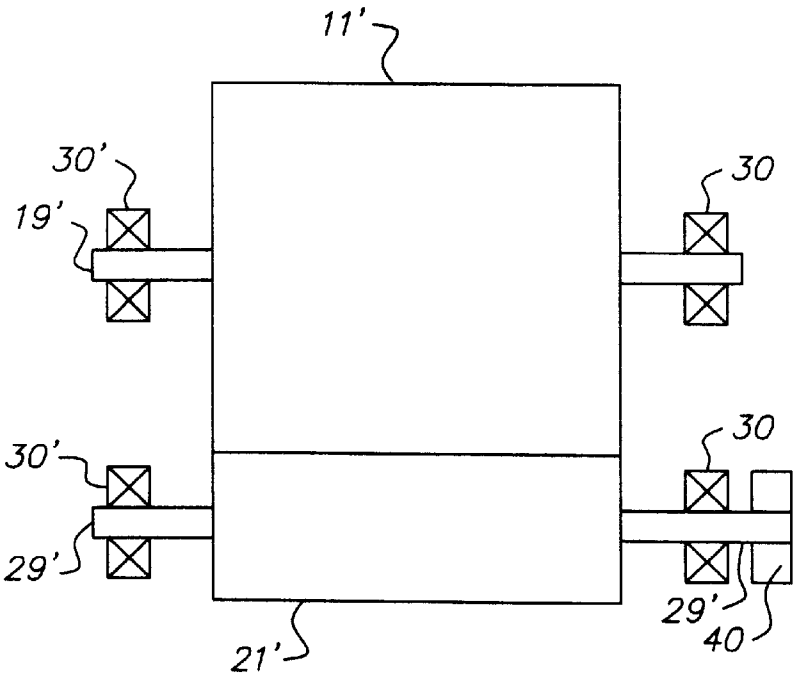
FIGS. 5*a* and 5*b* are schematic side and front elevational views respectively of a transfer apparatus incorporating another embodiment of the invention.
Figure 5A:
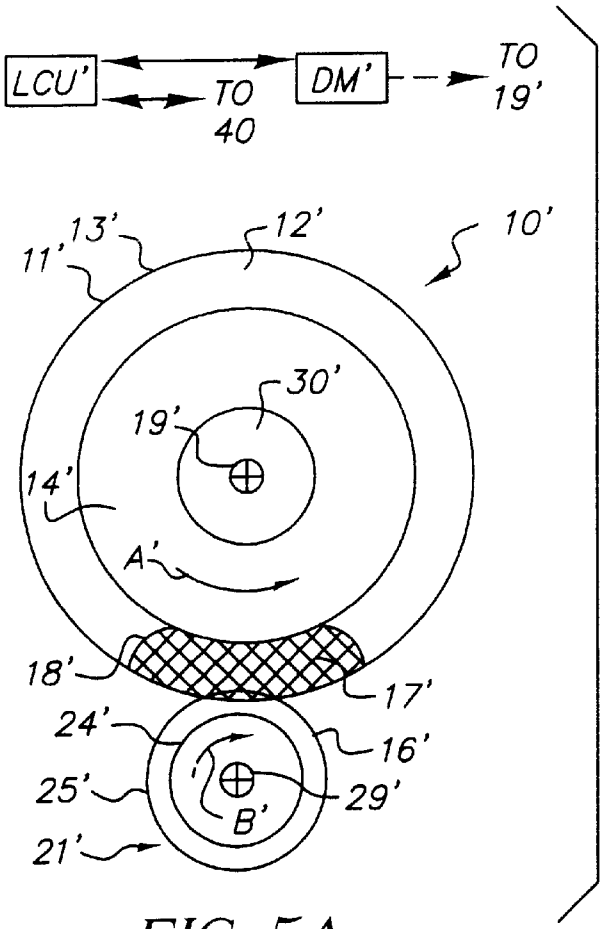

Another embodiment of the subject invention will now be described with reference to FIGS. 5*a*, 5*b* wherein parts similar to that shown in FIGS. 4*a* and 4*b* are identified with a similar reference number followed by a (′). In the embodiment of FIGS. 5*a*, 5*b*, the redundant gearing linkage is not present. An assembly 10' for transferring toner images includes a roller 11', for example, a conformable intermediate transfer roller including for example a compliant elastomeric layer 12'. A motor drive or other feed of mechanical drive is provided by for example, motor DM' to one of the shafts 19' or 29' supporting the rollers. The roller 11' is driven at a specific peripheral speed appropriate to the electrophotographic process while frictionally engaged without substantial slip with roller 21', for example, a photoconductive roller. If roller 21' is subject to overdrive because roller 11' is elastomeric and deformed at the nip, a speed modifying force is applied by a speed modifying member represented nonspecifically as 40. To reduce or eliminate the overdrive a drag force or torque is applied by member 40 in the form of a brake or other device known in the art for retarding rotation. The drag force is applied to the axle or shaft 29' of roller 21' so that the peripheral surface speed of the roller surface 25' at locations far from the nip is reduced and becomes equal to a predetermined speed, this predetermined speed being preferably the same as the peripheral speed of the intermediate transfer roller 11'. Instead of member 40 representing a brake, a frictional retarding force may be applied to shaft 29', for example with member 40 representing a brush or other suitable frictional means, or the retarding frictional force may be applied to the surface 25' of roller 21' by any appropriate mechanism (not shown). Alternatively, the braking force may be reduced so that the peripheral speed of the roller 21' has a value up to and including the speed it would have if freely overdriven. Or, the braking force may be increased to produce an underdrive of roller 21' of a predetermined magnitude.

The application of forces or torques to an overdriven roller can thus change the peripheral speed of that roller to take on other peripheral speeds including underdrive, overdrive, and equal peripheral speeds, thereby providing a means to select a predetermined amount of overdrive or underdrive, or preferably means for substantially eliminating the overdrive associated with compliant nips in frictional engagement. These loadings can be produced in an open loop system or with a closed loop system which provides for a specific resulting speed or speed ratio, depending on the sensing system employed. The amount of peripheral speed change that can be produced by applying drag is limited to the extent to which the drag forces can be supported in the nip without slippage; e.g., as determined by the coefficient of friction. It will be appreciated that when layer 12' is made of a compressible material such as a resilient foam, roller 21' will be underdriven, not overdriven. In order then to modify this underdrive to a predetermined level including an overdrive or preferably reduce the underdrive to zero, a negative drag or a negative torque is applied to roller 21' by speed modifying member 40, preferably with member 40 in the form of a torque generator applying a negative torque. Alternatively, the negative torque may be applied frictionally as an accelerating friction applied to shaft 29' by member 40, or the accelerating friction may be applied to the surface 25' of roller 21' by any suitable means (not shown).

Further, in a preferred embodiment of FIGS. 4*a* and 4*b* by connecting the two rollers of a conformable nip so that their surface speeds far from the nip are the same using a gear drive or other drive system known in the art, a self-compensating drag force will be induced in the nip that is automatically of the correct sign and magnitude to cancel overdrive (or underdrive) caused by a purely frictional engagement. The drag force that is induced will be exactly the value needed to reduce the overdrive to zero. A similar effect will occur when speeds are intentionally mismatched using redundant gearing to produce intentional overdrive or underdrive. Intentional mismatching of speeds may be provided by employing mating gear drives that deviate from or are different from the normal gear drive relationship. In the embodiment of FIGS. 4*a* and 4*b*, the normal gear ratios are the same as the ratios of the outer diameters of the undeformed rollers. However, the gear ratio may be made different from the normal gear ratio to control a specific amount of overdrive or underdrive. Here the drag forces will develop that are necessary to elastically distort the surfaces to accommodate the intentional overdrive or underdrive. The control that this counter-intuitive redundant linkage system provides for frictional nips is of significant advantage in the transfer nips of an electrostatographic engine using a conformable member. The use of the present invention requires a nonslip condition at the interface between the conformable roller and the surface that it engages that is of sufficient strength to produce the value of drag forces necessary to correct for the overdrive that would occur without the redundant linkage for the preferred embodiment and is sufficiently strong to suppress slip for other embodiments in which external drag forces are applied.

Figure 5D:
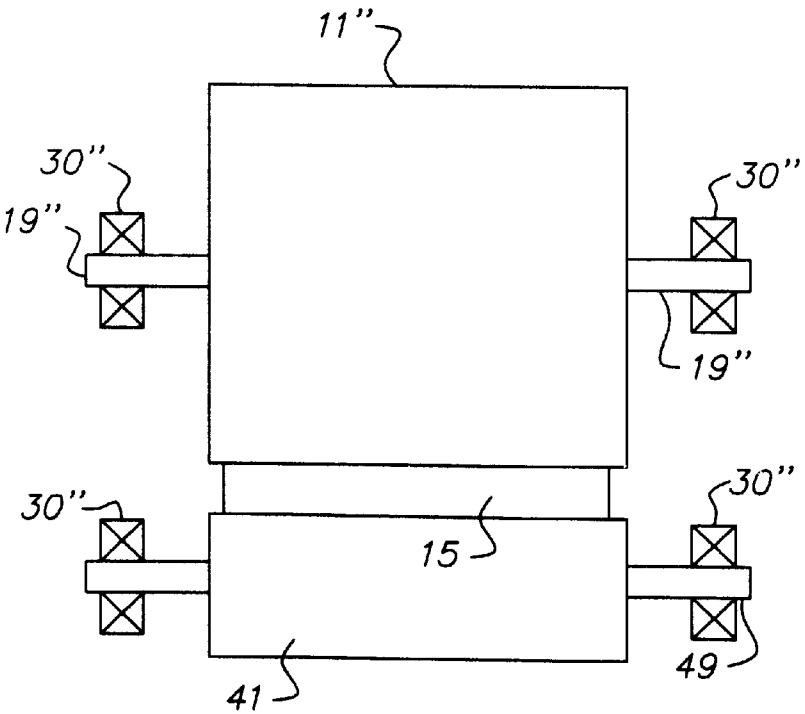
FIGS. 5*c* and 5*d* are schematic side and front elevational views respectively of a transfer apparatus incorporating yet another embodiment of the invention.
Figure 5C:
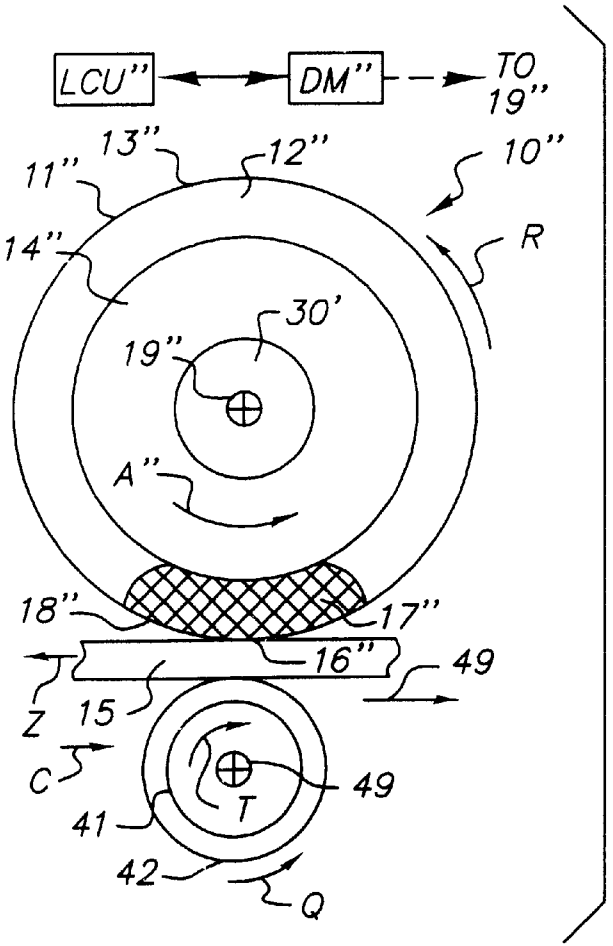

FIGS. 5*c* and 5*d* illustrate yet another embodiment 10" of the subject invention. In this embodiment, parts similar to those of FIGS. 4*a* and 4*b* are designated with a double prime (''). A web 15 is engaged by an intermediate transfer roller (ITR) 11" against a backup roller 41. This web can be a photoconductive web, a continuous receiver web such as paper, a transport web such as appropriate for transporting cut sheet receivers, or any other known web used in the art. The transfer intermediate roller or ITR 11" is composed of an inner core 14" that is relatively rigid and a conformable layer 12" having the characteristics described above. The engagement under pressure with the web 15 causes a deformed region 17" that strains the surface of the conformable layer producing a particular tensile strain at the critical location 18" of the ITR that is just about to touch down onto the surface of the web 15. There is no slip in the nip 16" where the materials are sufficiently engaged by friction. For purpose of the following discussion, conformable layer 12" may be assumed to be made of a compliant elastomer. When no predetermined loading force Z is applied to the web, the web 15 is overdriven in the direction C by the elastomeric ITR roller 11" at a speed determined by the rotation rate of the ITR 11" and the deformations taking place due to rolling engagement just prior to the point of lockdown when friction forces constrain the two surfaces of the web 15 and compliant ITR 11" to not slip at their mutual interface. The degree of overdrive or underdrive may be controlled by application of a predetermined force Z to the web or a predetermined torque Q to the backup roller. The direction of torque Q as shown provides a resisting torque (positive drag). (Note the direction of rotation of rollers 11" and 40 are shown by arrows A" and T, respectively, while the arrows R and Q represent directions respectively of driving torque and resisting torque.) An indicated drag force Z is a positive drag (to the left in FIG. 5*a*) and is appropriate for correcting overdrive from an incompressible elastomeric compliant ITR 11". A negative drag (to the right) would be applied for a roller that underdrives, e.g., a roller that includes a foam or a volume compressible elastomeric material. Similarly, and as an alternative, counterclockwise (in this example) applied torque Q provides positive drag, while a clockwise torque would provide negative drag. The force Z or torque Q produces a shear in the deformation zone 17" of the roller and thereby induces a strain in the critical location 18" that can offset the tensions that ordinarily occur there and which tensions induce overdrive when layer 12", for example, is a solid (non-foam) elastomeric compliant layer. In this embodiment, the externally applied force(s) or torques Z and/or Q can be adjusted to control the level of the overdrive or underdrive, minimizing it to a desired level, or the relative rotation rates of the ITR 11" and the backup roller 41 may be constrained to induce a specific level of overdrive, if desired, including zero. It is preferred to induce a level of overdrive which is substantially zero. This allows a toner image to be transferred from (or to) belt 15 to (or from) ITR 11" with minimal image distortion.

In certain cases, the degree of intrinsic overdrive from a compliant roller may be large enough that the magnitude of the applied compensating drag force needed to reduce the overdrive to zero becomes objectionably large. This large drag force may cause undue wear or may lead to slipping. In this circumstance, the drag force Z or torque Q may be adjusted to reduce the drag force magnitude by purposefully driving the two surfaces far from the nip at slightly different speeds up to peripheral speed differences that are characteristic of the overdrives that occur in elastomeric or compliant nips, typically 0.5% or more. That is, in accordance with one aspect of the present invention the intended surface speed of the relatively rigid component may be biased to a larger or smaller value and then a known fixed amount of overdrive or underdrive in the system is accepted. Under this situation, the value of the drag force required may be made arbitrarily small including change of sign and zero. This is particularly useful in those applications where the coefficient of friction may be variable or have a small value. The drag torque Q may be provided by friction braking applied at surface 42 of backup roller 41 or at its shaft 49.

Figure 6A:
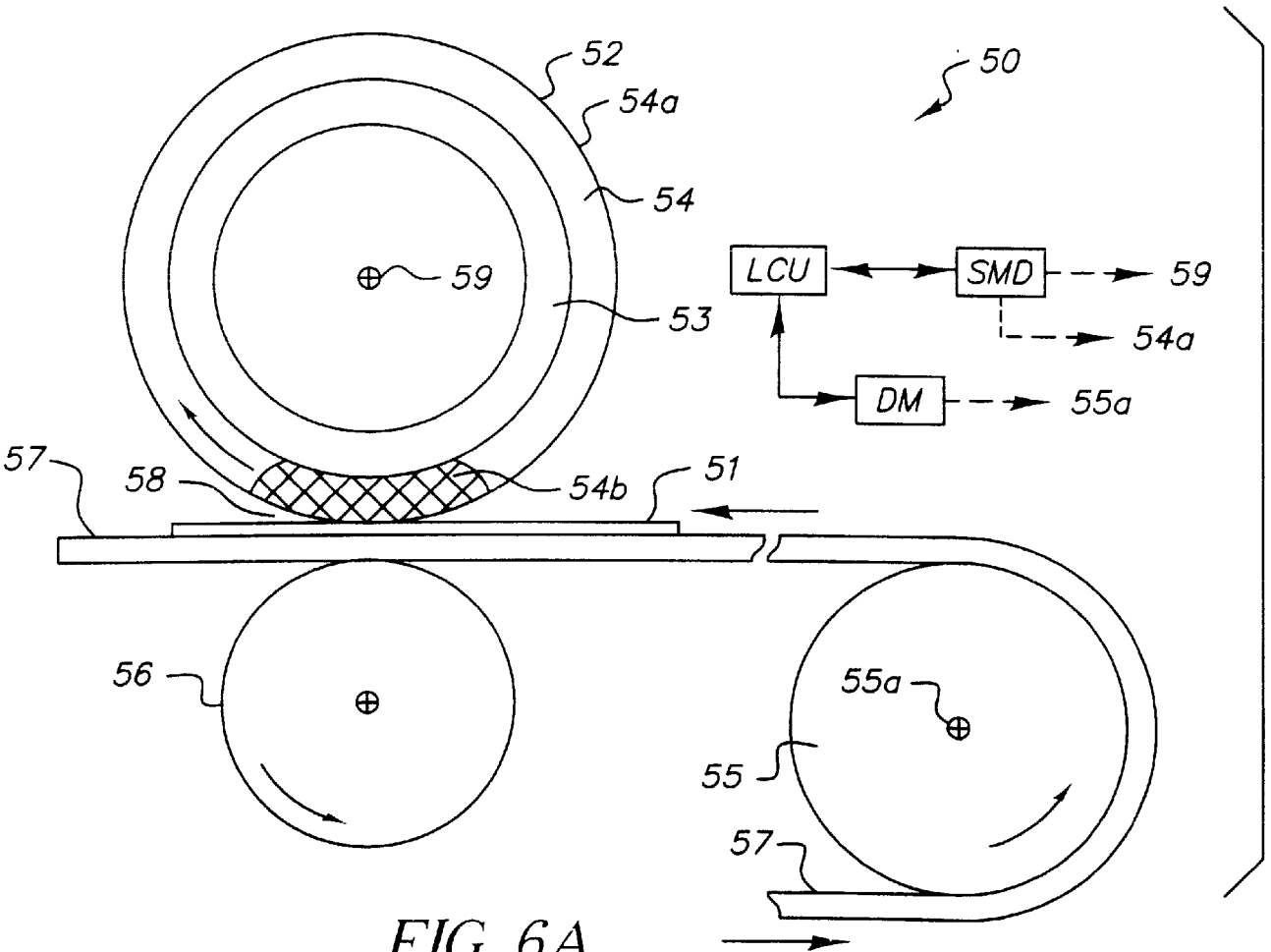
FIG. 6*a* is a side elevational view of a transfer apparatus incorporating still yet another embodiment of the invention.

FIG. 6*a* illustrates still yet another transfer embodiment of the invention. An image forming station designated as 50 includes a conformable primary image forming roller 52 which engages under pressure a receiver member 51 supported by a transport web 57, and a transfer backup roller 56.

Receiver 51 is adhered in nonslip fashion, e.g., electrostatically or using grippers, to web 57. Roller 52 is a photoconductive roller or other primary image-forming member such as used in electrographic recording or other types of recording or printing, and includes devices (not shown) located about its periphery to form a toner image on the surface of roller 52 that is electrostatically transferred to the receiver 51. The transport web 57 is driven by a drive roller 55, mounted on a shaft 55*a* and rotated by motor DM, which moves the receiver 51 through a pressure transfer nip 58 where the toner image is transferred to the receiver. Preferably web 57 is insulating and receiver 51 is held to the web by any known mechanism, preferably electrostatically. Image forming roller 52 is frictionally driven by nonslip contact with the receiver 51. Also, when a receiver is not in the transfer nip (not illustrated) roller 52 is driven frictionally by contact with the outer side of web 57, i.e., the engagement provided in nip 58 is sufficient to provide nonslip frictional drive of roller 52 with and without the receiver in the nip. The web is an endless loop maintained in tension which passes around another support roller (not illustrated) which is preferably an idler roller.

The backup transfer roller 56, to which a transfer voltage is provided by a power supply (not shown) is frictionally driven by contact with the inner side of web 57. Inasmuch as the peripheral speed of transfer roller 56 has little or no influence on the motion of roller 52, roller 56 may be a hard roller or may include a covering layer that is conformable. A photoconductive imaging roller 52 includes a preferably tubular metal core 53 and a conformable photoconductive structure 54 which includes one or more layers surrounding the core. A compliant photoconductive structure, such as for example disclosed in the J. W. May et al. patent (U.S. Pat. No. 5,828,931) may be used. Preferably, the conformable structure 54 is for all practical purposes incompressible, and includes in order outwards from the core, a compliant elastomeric cushion layer, a preferably thin grounded metallic electrode layer, and one or more layers as is well known to provide photoconductivity (individual layers of structure 54 not illustrated). Alternatively, conformable structure 54 may be compressible and include a material such as a resilient foam instead of a compliant elastomeric cushion layer. The conformable structure may include the compliant elastomeric layer bonded to the core member and the other layers formed as a replaceable removable seamless tubular sleeve. A deformed region 54*b* is caused by the pressure in the web and is indicated by crosshatching.

In an application in which structure 54 is for all practical purposes incompressible, roller 52 will be underdriven by the motion of web 57, inasmuch as its peripheral speed far from the nip is less than that of the web, as explained above. Conversely, in an application in which structure 54 is compressible, roller 52 will be overdriven by the motion of web 57. For either of these applications, the subject invention provides a speed modifying force to control and preferably eliminate the respective overdrive or underdrive. A resulting respective overdrive or underdrive may be controlled to a suitable predetermined magnitude, including zero. A speed modifying device (SMD) is used to apply the speed modifying force to the imaging roller 52. A logic and control unit (LCU) provides control of the elements used to create the images on the photoconductor roller 52 and also provides control over the surface speed of roller 52 by adjusting the rotational rate of shaft 59, e.g., through a feedback loop using for example a sensor (not shown) to sense the movement of fiducial marks placed for example on the outer surface 54*a* of roller 52, the sensor sending signals to the LCU and thence to the SMD. The fiducial marks are preferably in the form of identically spaced parallel fine lines or bars. These lines or bars are preferably perpendicular to the direction of rotation of the roller, and have a predetermined center-to center distance which is preferably known precisely. The fiducial marks may be included as permanent markings on, or in, the outer layer of roller 52 and may be placed for example near one edge of the roller outside of the imaging area. Alternatively, the fiducial marks may be provided on a wheel secured coaxially to shaft 59, as for example described in detail below for embodiment 200" of FIG. 13*a*. The SMD (not illustrated in detail) can be used to apply a frictional speed modifying force to roller 59, for example by using, when suitable, a brake, a brush, a friction wheel, or a torque generator, or any other suitable mechanism may be used. In an application in which structure 54 and deformed portion 54*b* are for all practical purposes incompressible, an accelerating frictional force (negative drag) is applied by the SMD to surface 54*a*, e.g., by a brush or other mechanism, or, an accelerating torque (negative torque) or a negative drag force is applied to shaft 59 by a torque generator or other suitable mechanism. In an application in which structure 54 and deformed portion 54*b* are compressible, a retarding frictional force (positive drag) is applied by the SMD to surface 54*a* by a brush or other suitable mechanism, or, a retarding torque or drag (positive torque or drag) is applied to shaft 59 by a brake or other suitable mechanism. As a result of eliminating or reducing overdrive (or underdrive) to a predetermined level using the SMD, the toner image which is transferred from roller 52 to receiver 51 has a reduced distortion, mirroring the fact that the distorting strain of surface 54*a* in the frictional drive portion of region 54*b* is reduced or eliminated.

The web 57 moving to the left through the nip 58 can carry the receiver sheet 51 through one or more other imaging stations (not shown) similar to station 50 in a multistation color imaging apparatus. Each of the other stations similarly includes a conformable photoconductive roller, a backup transfer roller producing a pressure nip through which web 57 is driven by motor DM, and a SMD for controlling the peripheral speed of each photoconductive roller via signals from the LCU. A toner image of a first color is transferred to receiver 51 in station 50, a second color is transferred in registry in the next station, and so forth, thereby producing a full color toner image on receiver 51. For example, the colors in order from right to left may be black, cyan, magenta and yellow to form a 4-color image. After passing through all of the imaging stations, the receiver is detached from web 57 by any known mechanism and transported to a fusing station (not shown). In the multistation apparatus, the peripheral speeds of all the individual photoconductors are preferably controlled to be the same, i.e., all the peripheral speeds match the speed of web 57. Alternatively, all the peripheral speeds may be made to differ from the speed of web 57 by a predetermined amount. In either case, each of the single color toner images which form the full color image has an equal amount of distortion, thereby producing an image having an improved registration. As is known, when a digital device such as a writer including for example a scanning laser beam is used to form an electrostatic latent image on the surface of the photoconductive roller 52, the writer may be programmed to compensate for a toner image distortion caused by an overdrive or underdrive in nip 58. Thus, because each of the single color toner images which form the full color image has an equal amount of distortion, as provided by this invention, the compensation provided for the writer is the same for each station. This improves greatly over an apparatus where SMDs are not used, in which an optimized registration would require the exact amount of overdrive-induced or underdrive-induced distortion produced by each station to be separately compensated for, which is comparatively difficult.

Alternatively, a digital writer may be used to form a latent electrostatic image on roller 52, this latent image being for example in the form of a set of parallel equi-spaced bars or lines written perpendicular to the direction of rotation of roller 52. The latent image is developed to form a toned image by a toning station (not shown). The toned bars or lines on the surface of roller 52 are formed at a known frequency, i.e., the number of bars or lines written per unit time is, say, equal to f and is established by the writer and stored in the LCU. After the toned image has been transferred to receiver 51, where the receiver may be a test sheet used for correcting for overdrive or underdrive, a sensor (not shown) is used to measure a frequency, say f', of passage of the toned bars or lines on the receiver past the sensor, and this frequency is sent to the LCU. Generally, as a result of overdrive or underdrive in nip 58, f and f' will not be the same. A speed modifying force is applied to roller 52 such that the frequencies f and f' are matched, whereupon it will be evident that the peripheral speed of roller 52 far from the nip will then be the same as the speed of receiver 51 being transported by belt 57. In a machine that includes a plurality of individual color stations, as described above, each station may be used to make a similar set of short bars or lines, with each set displaced in a direction parallel to axis 59 so that no set overlaps another, and a similar frequency matching procedure is used in each station. When all stations have adjusted the corresponding peripheral speeds of the respective photoconductor rollers by suitable speed modifying forces applied separately in each station, it will be evident that a full color image made immediately subsequent to the test sheet passing through the machine will be in good registration. A test sheet may be utilized at any convenient time, e.g., between runs. Thereby, changes in dimensions of rollers or other members due to wear, aging, temperature changes and so forth may be compensated for in a simple way without the need for complicated adjustments to the individual writers.

Figure 6B:
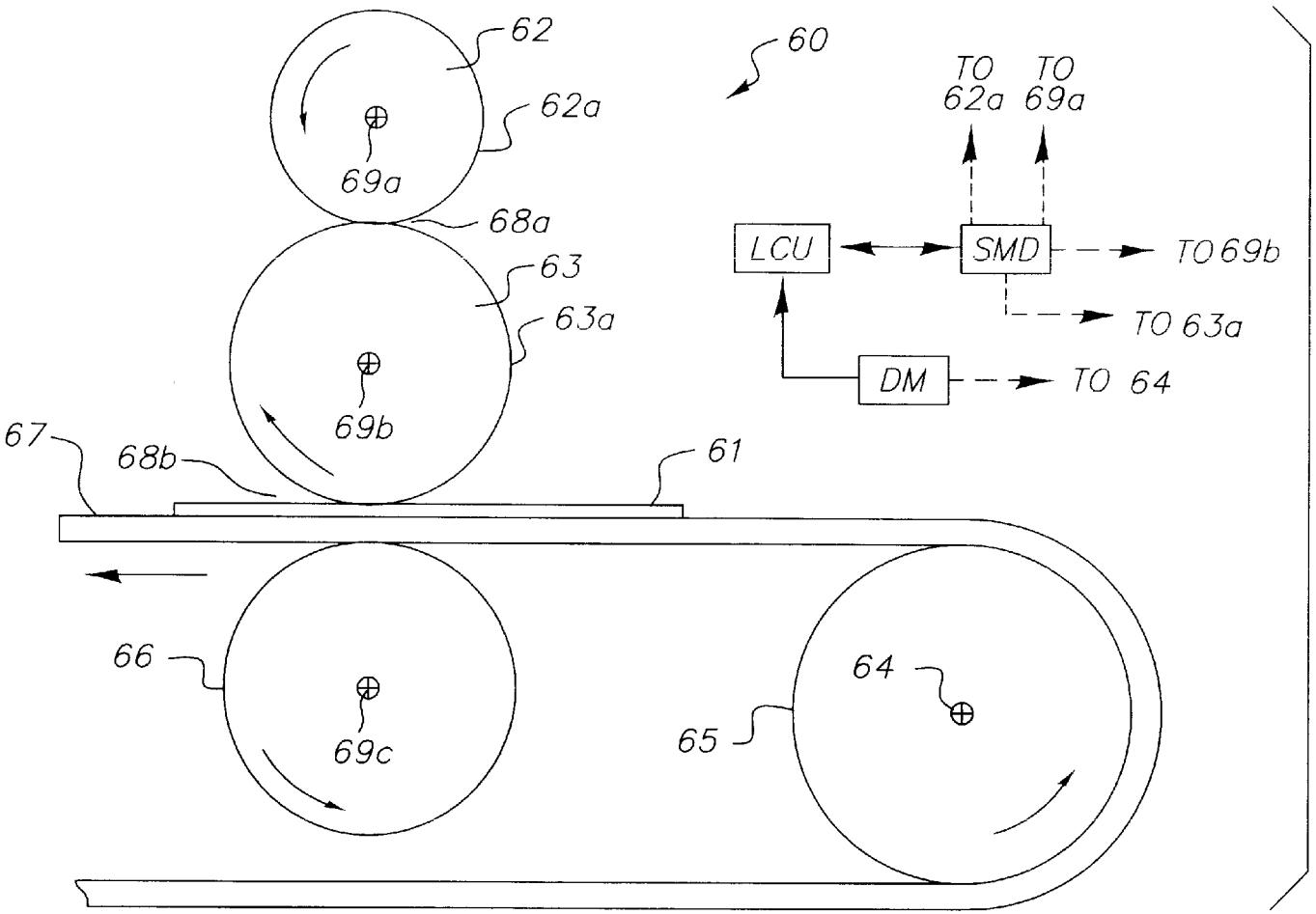
FIG. 6*b* is a schematic side elevational view of a transfer apparatus incorporating another embodiment of the invention.

FIG. 6*b* illustrates another transfer embodiment of the invention. An image forming station designated as 60 includes a primary image forming roller 62 having a coaxial shaft 69*a* forming a primary pressure nip 68*a* with an intermediate transfer roller (ITR) 63 having a coaxial shaft 69*b*. In a secondary pressure nip 68*b*, ITR 63 engages a receiver member 61 supported by a transport web 67, and a transfer backup roller 66 having a coaxial shaft 69*c*. Shafts 69*a*, 69*b* and 69*c* may be coplanar or not coplanar as is suitable. Receiver 61 is adhered in nonslip fashion, e.g., electrostatically or using grippers, to web 67. Roller 62 is a photoconductive roller or other primary image-forming member such as used in electrographic recording or other types of recording or printing, and includes devices (not shown) located about its periphery to form a toner image on the surface 62*a* of roller 62. The toner image (not shown) is electrostatically transferred to the surface 63*a* of ITR 63 in nip 68*a* and then transferred from ITR 63 to the receiver 61 in nip 68*b*. The transport web 67 is preferably nonconformable and is driven by a drive roller 65 having a coaxial shaft 64 rotated by a motor DM, the web transporting the receiver 61 through nip 68*b*. Preferably web 67 is insulating and receiver 61 is held to the web by any known mechanism, preferably electrostatically. ITR 63 is frictionally driven by nonslip contact with the receiver 61, and image forming roller 62 is frictionally driven by nonslip contact with ITR 63. Also, when a receiver is not in the transfer nip (not illustrated) roller 62 is driven frictionally by contact with the outer side of web 67, i.e., the engagement provided in nip 68*b* is sufficient to provide nonslip frictional drive of roller 62 with and without the receiver in the nip. The web is an endless loop maintained in tension which passes around another support roller (not illustrated) which is preferably an idler roller. The backup transfer roller 66, to which a transfer voltage is provided by a power supply (not shown) is frictionally driven by contact with the inner side of web 67. Roller 66 may be a hard roller or may include a covering layer that is conformable. A photoconductive imaging roller 62 includes a preferably tubular metal core and a photoconductive structure which includes one or more layers surrounding the core (layers not illustrated). ITR 63 includes a conformable structure having one or more layers (layers not illustrated). Preferably, ITR 63 includes a compliant elastomeric layer which is for all practical purposes incompressible, the compliant layer being preferably overcoated with a thin hard layer such as for example disclosed in the Rimai et al. patent (U.S. Pat. No. 5,084,735). Alternatively, conformable ITR 63 may be compressible and include a material such as a resilient foam as a cushion layer. The conformable structure may be bonded to the core member, or alternatively provided as a replaceable removable seamless tubular sleeve.

In an application in which the conformable structure of ITR 63 is for all practical purposes incompressible, ITR 63 will be underdriven by the motion of web 67, inasmuch as its peripheral speed far from the nip is less than that of the relatively nonconformable web or receiver 61, as explained above. Roller 62, on the other hand, will be overdriven by ITR 63. An underdrive in nip 68*b*, therefore, tends to be compensated by an overdrive in nip 68*a*, so that a net overdrive or underdrive of roller 62 by web 67 has a generally smaller magnitude than the magnitude of overdrive or underdrive produced in each of nips 68*a* and 68*b* separately. Conversely, in an application in which the conformable structure of ITR 63 is compressible, a similar compensation will result from ITR 63 being overdriven by the motion of web 67 and roller 62 being underdriven by ITR 63.

For either of these applications of the previous paragraph, the subject invention provides a speed modifying force to control and preferably eliminate a net overdrive or underdrive of roller 62 by web 67 (or by receiver 61). The net overdrive or underdrive may be controlled to a suitable, predetermined, magnitude, including zero. When the net overdrive is made equal to zero, a speed of a portion of surface 62*a* far from nip 68*a* ie equal to a speed of web 67. A speed modifying device (SMD) is used to apply the speed modifying force, which may be applied to the imaging roller 62 or to the ITR 63, as is suitable. A logic and control unit (LCU) provides control of the elements used to create the images on a photoconductor roller 62 and also provides control over the surface speed of roller 62 far from nip 68*a* by adjusting the rotational rate of coaxial shaft 69*a*, e.g., through a feedback loop using for example a sensor (not shown) to sense the movement of fiducial marks placed for example on the outer surface 62*a* of roller 62, the sensor sending signals to the LCU and thence to the SMD. The fiducial marks are preferably in the form of identically spaced parallel fine lines or bars. These lines or bars are preferably perpendicular to the direction of rotation of roller 62, and have a predetermined center-to center distance which is preferably known precisely. The fiducial marks may be included as permanent markings on, or in, the outer layer of roller 62 and may be placed for example near one edge of the roller outside of the imaging area. Alternatively, the fiducial marks may be provided on a wheel secured coaxially to shaft 69*a,* as for example described in detail below for embodiment 200" of FIG. 13*a*. The SMD (not illustrated) can be used to apply a frictional speed modifying force to surface 62*a* of the imaging roller 62, for example by using, when suitable, a brake, a brush, a friction wheel, or a torque generator, or any other suitable mechanism may be used. A positive or a negative drag force may be applied by the SMD to surface 62*a,* e.g., by a brush or other mechanism, or alternatively a positive or a negative torque or drag force may be applied to shaft 69*a* by a torque generator or other suitable mechanism, in order to eliminate or reduce an overdrive (or underdrive) of roller 62 by web 67 to a predetermined level using the SMD. As a result, the toner image which is transferred from roller 52 to receiver 51 has a known distortion, as determined by the magnitude of the predetermined level. The predetermined level is preferably zero, under which condition a toner image, as formed on imaging roller 62, is not stretched parallel to the direction of travel of web 67 after the secondary transfer of the toner image to receiver 61. Alternatively, the SMD is similarly used to apply a speed modifying force to ITR 63, i.e., a suitable drag force is applied to surface 63*a* or a suitable torque or drag force is applied to shaft 69*b* in order to provide a predetermined speed ratio equal to a speed of surface 62*a* far from nip 68*a* divided by a speed of web 67, the preferred predetermined speed ratio being substantially 1.000.

The web 67 moving to the left through the nip 68*b* can carry the receiver sheet 61 through one or more other imaging stations (not shown) similar to station 60 in a multistation color imaging apparatus, each of which other stations similarly includes a photoconductive roller, an intermediate transfer roller, and a backup transfer roller producing a respective pressure nip through which web 67 is driven by motor DM, and further includes a respective SMD for controlling the peripheral speed of each of the respective photoconductive rollers via signals from the LCU. A toner image of a first color is transferred to receiver 61 in station 60, a second color is transferred in registry in the next station, and so forth, thereby producing a full color toner image on receiver 61. For example, the colors in order from right to left may be black, cyan, magenta and yellow to form a 4-color image. After passing through all of the imaging stations, the receiver is detached from web 67 by any known mechanism and transported to a fusing station (not shown). In the multistation apparatus, the peripheral speeds of all the individual photoconductors far away from any nip are preferably controlled to be the same, i.e., all the peripheral speeds match the speed of web 67. Alternatively, all the peripheral speeds may be made to differ from the speed of web 67 by a predetermined amount. For either alternative, each of the single color toner images which form the full color image has an equal amount of distortion, thereby producing an image having an improved registration. As is known, when a digital device such as a writer including for example a scanning laser beam is used to form an electrostatic latent image on the surface of a photoconductive roller 62, the writer may be programmed to compensate for a toner image distortion caused by a net overdrive or underdrive of roller 62 by web 67. Thus, because each of the single color toner images which form the full color image has an equal amount of distortion, as provided by this invention, the compensation provided for the writer is the same for each station, which simplifies the writing procedure. As is preferred, no compensation by the writer is required when the net overdrive or underdrive of roller 62 by web 67 as controlled by each SMD is zero. This improves greatly over an apparatus where SMDs are not used, in which an optimized registration would require the exact amount of overdrive-induced or underdrive-induced distortion produced by each station to be separately compensated for by the respective image writer, which is comparatively difficult and costly.

Alternatively, a digital writer or other known device may be used to form a latent electrostatic image on imaging roller 62, this latent image being for example in the form of a set of parallel equi-spaced bars or lines oriented preferably perpendicular to the direction of rotation of roller 62. The latent image is developed to form a toned image by a toning station (not shown). The toned bars or lines on the surface of roller 62 are formed at a known frequency, i.e., the number of bars or lines written per unit time is, say, equal to f'" and is established by the writer and stored in the LCU. After the toned image has been transferred to receiver 61, where the receiver may be a test sheet used for correcting for overdrive or underdrive, a sensor (not shown but situated after nip 68*b*) is used to measure a frequency, say f"", of passage of the toned bars or lines on the receiver past the sensor, and this frequency is sent to the LCU. Generally, as a result of net overdrive or underdrive of roller 62 by web 67, f'" and f"" will not be the same. A speed modifying force is applied to imaging roller 62 (or alternatively to ITR 63) such that the frequencies f'" and f"" are matched, whereupon it will be evident that the peripheral speed of roller 62 far from the nip 68*a* will then be the same as the speed of receiver 61 being transported by belt 67. In a machine that includes a plurality of individual color stations, as described above, each station may be used to make a similar set of short bars or lines, with each set displaced in a direction parallel to axis 69*b* so that no set overlaps another, and a similar frequency matching procedure is used in each station. When all stations have adjusted the corresponding peripheral speeds of the respective photoconductor rollers by suitable speed modifying forces applied separately in each station, it will be evident that a full color image made immediately subsequent to the test sheet passing through the machine will be in good registration. A test sheet may be utilized at any convenient time, e.g., between runs. Thereby, changes in dimensions of rollers or other members due to wear, aging, temperature changes and so forth may be compensated for in a simple way without the need for complicated adjustments to the individual writers.

Figure 7A:
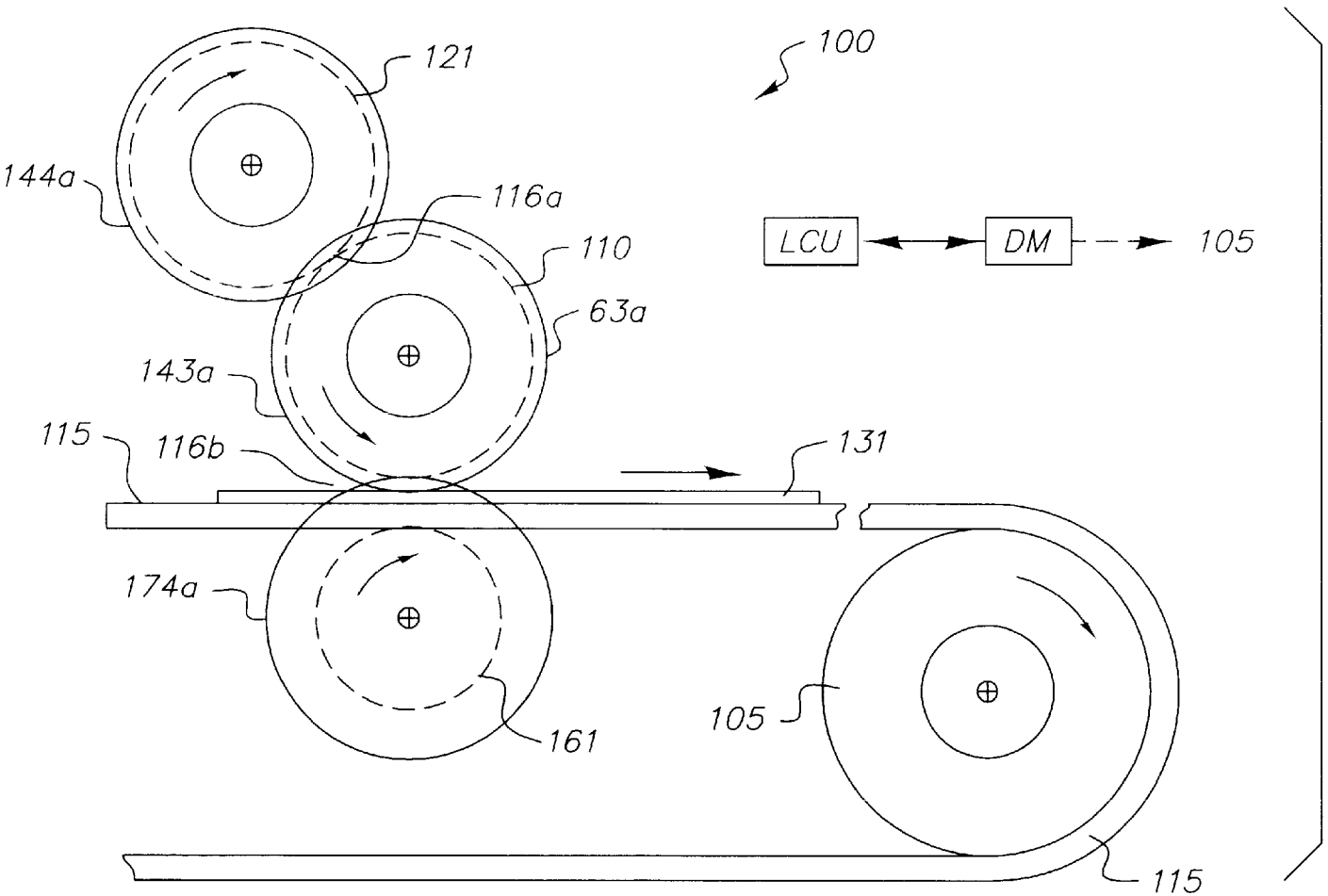
FIG. 7*a* is a schematic side elevational view of a transfer apparatus incorporating still another embodiment of the invention.

FIGS. 7*a, b,* and *c* illustrate still another transfer embodiment of the present invention wherein an image formation apparatus includes an image transfer assembly 100 that has a conformable intermediate transfer roller (ITR)110 which engages under pressure both a photoconductive (PC) member 121 in the form of a roller and a receiver member 131 supported by a transport web 115 and a transfer backup roller 161. PC roller 121 includes devices (not shown) located about its periphery to form a toner image on the PC that is to be electrostatically transferred to the ITR. 110. All three members or rollers 121, 110 and 161 are redundantly geared to rotate so as to have the same peripheral speeds at locations far from the respective nips 116*a*, 116*b*. Drive from a motor DM is applied in this example to a roller 105 which is one of the plural rollers about which transport web 115 is entrained. This causes drive by friction to be imparted to the rollers 110 and 161. Roller 110 in turn frictionally drives roller 121. The web is transported about an endless path by a web tracking system also geared to have the web move at the peripheral speed of the backup roller 161. The ITR 110 may be compressible and may include, for example, a resilient foam. Preferably, ITR 110 has all of the characteristics described above for ITR 11 of FIG. 4*a*, i.e., with layer 12 including a compliant elastomer which is for all practical purposes incompressible. Because of conformability of the ITR, the tendency that occurs naturally to produce overdrive of roller 121 by a compliant elastomeric roller 110 (or underdrive in an application in which ITR 110 is compressible) causes, at the nonslip nip engagement points of the intermediate transfer member 110 with the photoconductive member 121, a drag on the intermeshed gears 143*a*, 144*a*. This drag is determined by a first gear ratio of gears 143*a*, 144*a*, and thus the overdrive (or underdrive) may be eliminated or fixed at any predetermined amount which is consistent with this first gear ratio and with a nonslip frictional drive at this first engagement nip 116*a*. Similarly, the tendency to produce underdrive of a compliant elastomeric ITR 110 by the receiver 131 (or overdrive if ITR 110 is compressible) causes, at the nonslip nip engagement points of ITR 110 and the receiver member 131, a drag on the intermeshed gears 143*a*, 174*a*. This drag is determined by a second gear ratio of gears 143*a*, 174*a*, and thus the underdrive (or overdrive) may be eliminated or fixed at any predetermined amount which is consistent with this second gear ratio and with a nonslip frictional drive at this second engagement nip 116*b*. Alternatively, to minimize effects of differential overdrive in producing associated time varying changes of strains in the nips, i.e., maintaining a condition of nonslip frictional drive in both of nips 116*a* and 116*b*, each of the first and second gear ratios is preferably set close to, but not exactly equal to, that which would be respectively produced by the natural speed ratio of the two contacting rollers, i.e., set to almost match the overdrive or underdrive that can be measured at the same engagement in the absence of redundant gearing.

The drags which develop bias the gearing system to improve motion quality by elimination of backlash normally present in gearing systems. Spur gears are preferred and the engagements may be fine tuned by radial motions of the axles within the allowable range for spur gear engagements. The rollers 121, 110 and 161 are fixed for rotation to shafts 109, 119 and 129 respectfully which are each supported by respective bearings 130. The rollers 121, 110 and 161 are supported so that the conformable layer on roller 110 deforms. As an alternative, a motor drive may be provided to roller 161.

Figure 7C:
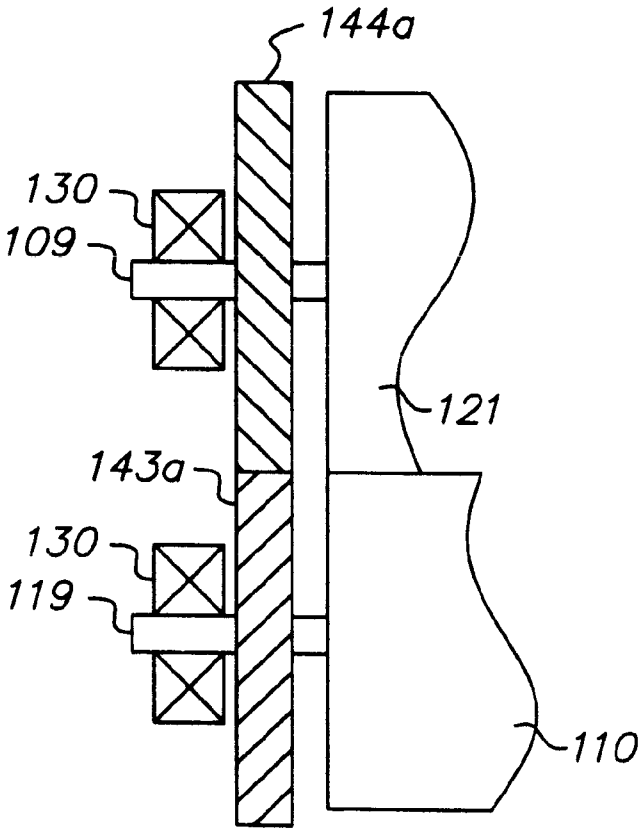
FIG. 7*c* is a schematic front elevational view of another portion of the apparatus shown in FIG. 7*a;*
Figure 7B:
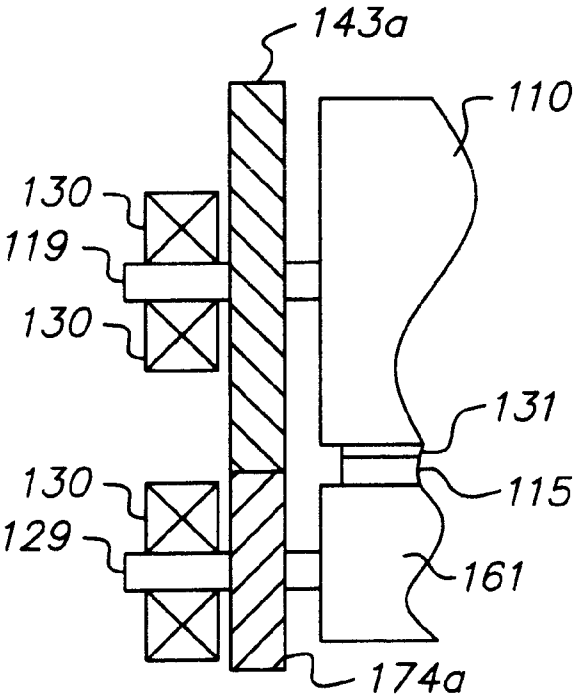
FIG. 7*b* is a schematic front elevational view of a portion of the apparatus shown in FIG. 7*a;*
Figure 7D:
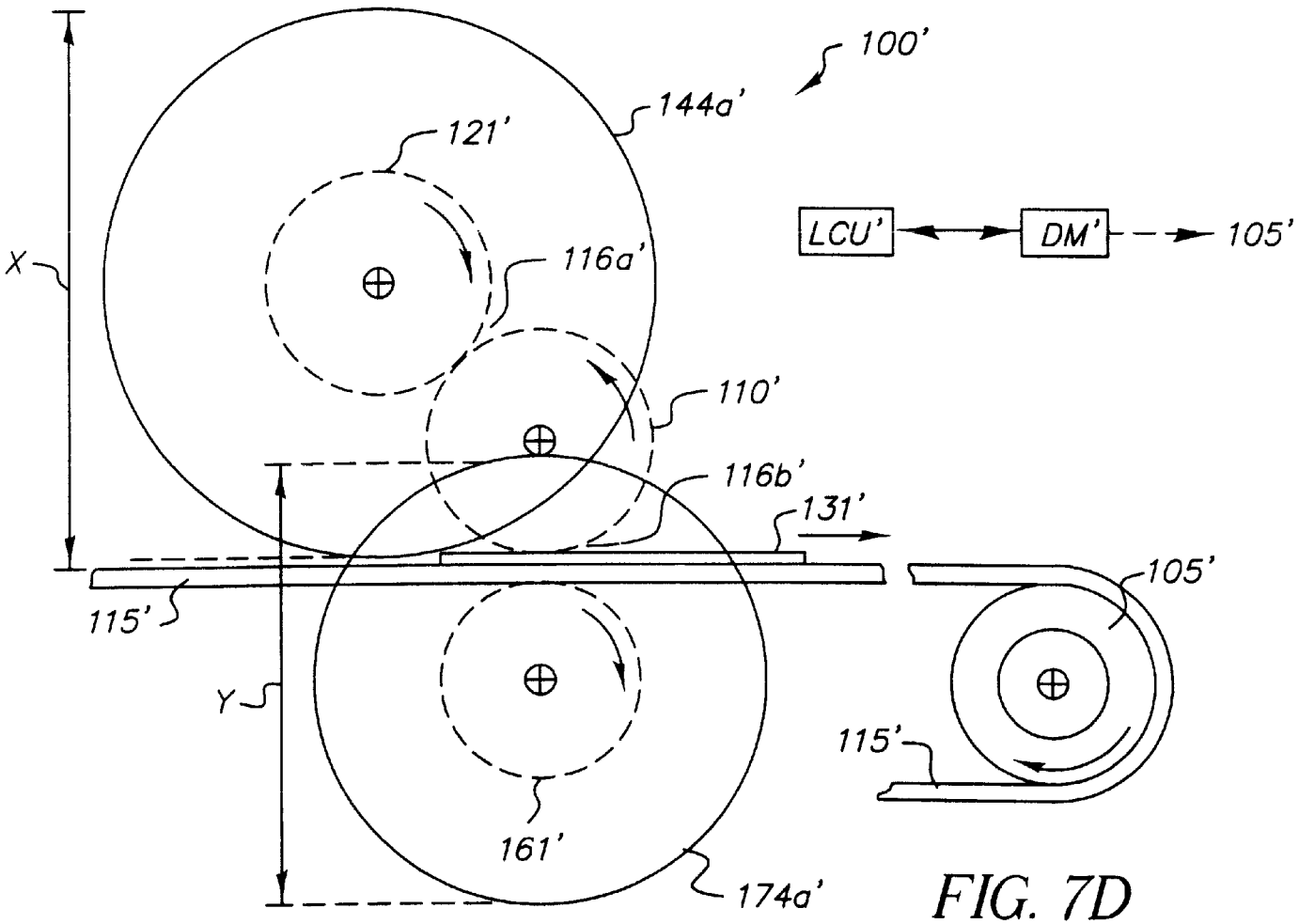
FIG. 7*d* is a schematic side elevational view of a transfer apparatus incorporating an alternative to the embodiment of the invention shown in FIG. 7*a;*
Figure 7E:
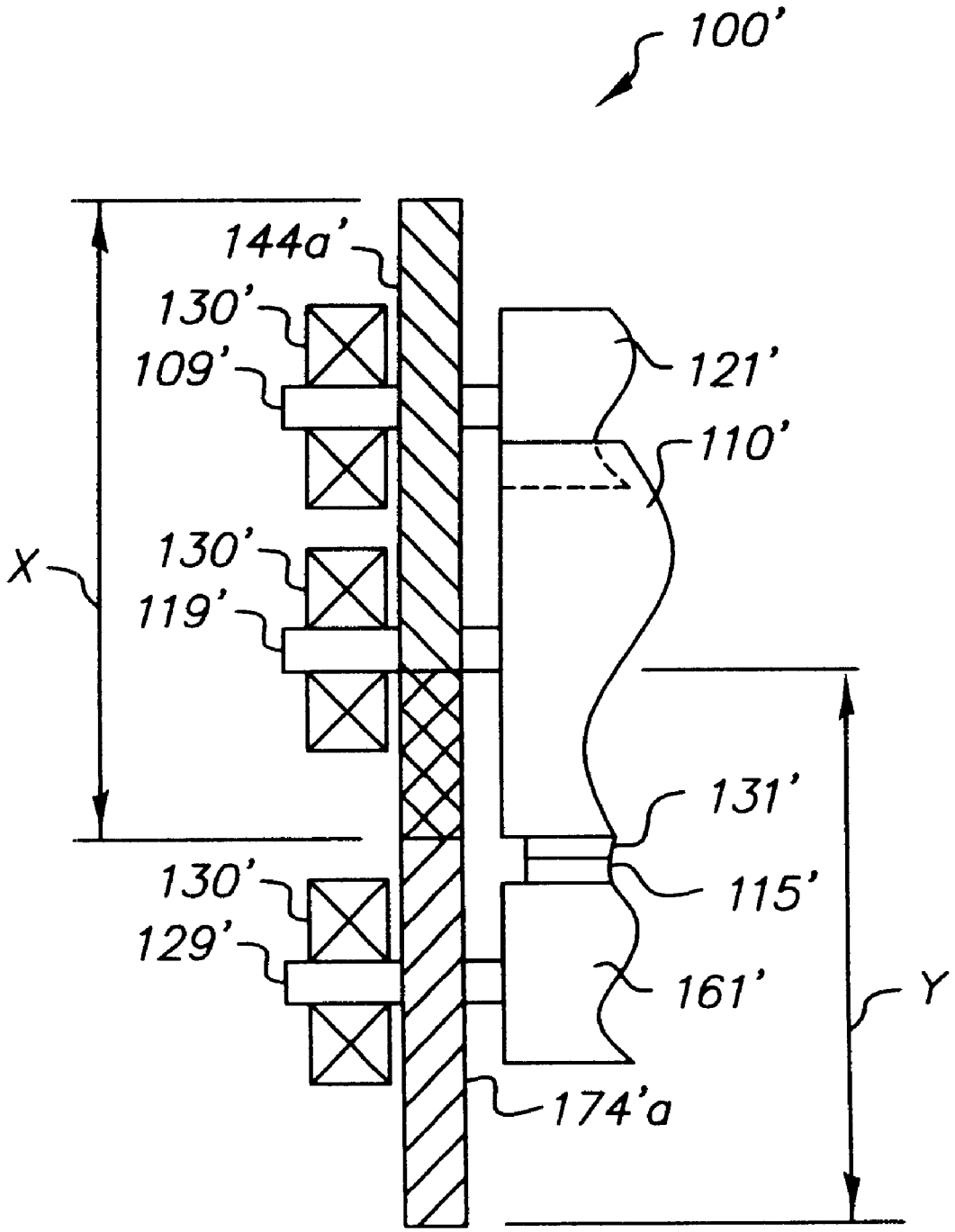
FIG. 7*e* is a schematic front elevational view of another portion of the apparatus shown in FIG. 7*d;*

FIGS. 7*d* and 7*e* illustrate still yet another transfer embodiment 100' which is an alternative embodiment to transfer embodiment 100. The primed entities (') have functions and material characteristics that are similar in all respects to those of the corresponding unprimed entities of FIGS. 7*a*, 7*b*, and 7*c*. Embodiment 100' differs from embodiment 100 in that a redundant gearing linkage is provided between imaging roller 121' and backup roller 161', but no gearing linkage is provided to intermediate transfer roller (ITR) 110'. Thus, rollers 121', 110', and 161', having respective coaxial shafts 109', 119', and 129' supported by bearings 130', are frictionally driven in nonslip fashion by web 115', the redundant gearing linkage being provided between gears 144*a*' and 174*a*' attached to shafts 109' and 129', respectively. Note the geometric requirement of relatively larger diameters (X and Y) for these gears. A suitable choice of gear ratio of gears 144*a*' and 174*a*' has any value consistent with a nonslip drive in both nips. As explained herein above, lateral stresses are produced in the ITRs in each of the nips formed by the ITRs, and these lateral stresses oppose the drag forces induced in nips 216*a*' and 216*b*' by the redundant gearing. Thus, stresses are produced, e.g., in conformable roller 210' forming nips 216*a*' and 216*b*', which exactly compensate for these drags.

Embodiment 100', having only one set of gears, is generally simpler and less costly to manufacture than embodiment 100. Another possible beneficial consequence of having only one set of gears, useful for a nonslip frictional drive, is that an inherent drag in the system due to friction should generally be less than with two sets of gears. The tensile strain in the driving web 115' may also be beneficially lower as a result of a smaller inherent drag.

Figure 8B:
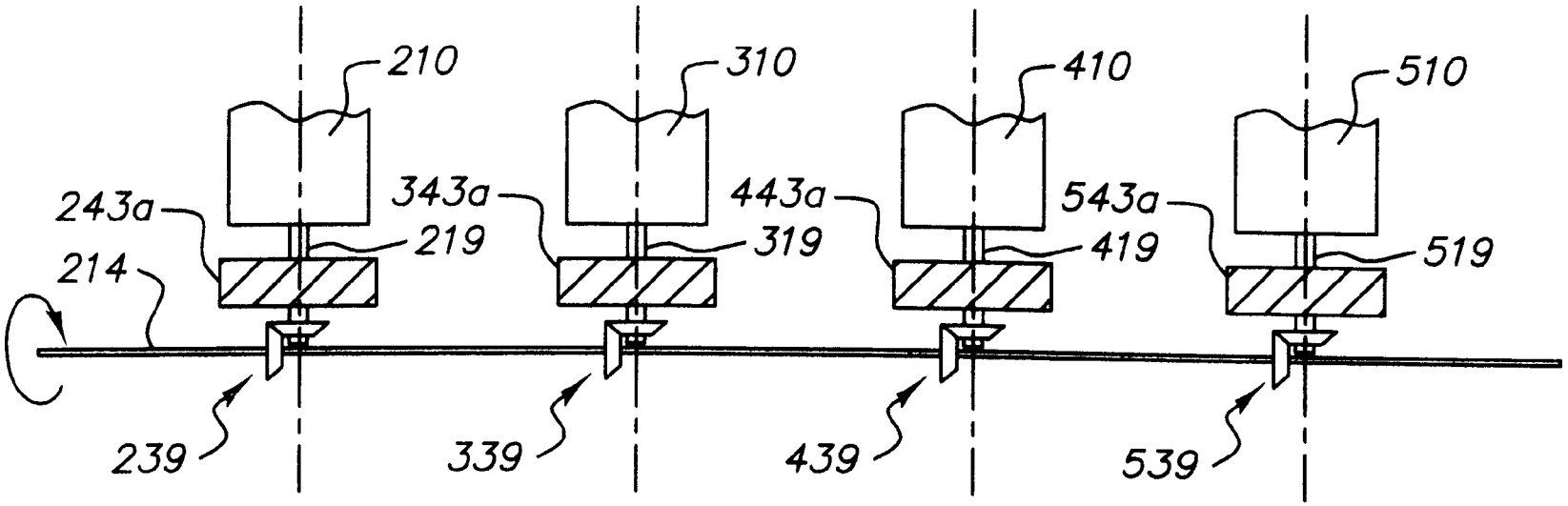
FIG. 8*b* is a top view of a portion of the apparatus of FIG. 8*a,* illustrating a common shaft drive to each of the included intermediate transfer members.

FIGS. 8*a* and 8*b* show a preferred modular color electrophotographic reproduction apparatus 200 including a plurality of modules of the type shown and described for the embodiment of FIGS. 7*a, b, c,* each module of which is independently geared as described above for FIGS. 7*a, b, c.*

The apparatus designated as 200 shown in FIGS. 8*a* and 8*b* is a full color electrophotographic printing press or apparatus and includes a plurality of electrophotographic modules working in parallel. The apparatus has some similarity to that described in the T. Tombs et al. patent (U.S. Pat. No. 6,075,965). Each electrophotographic module 201, 301, 401 and 501 produces a different color image and all operate simultaneously to construct a four-color image. For example, the colors in order from left to right may be black, cyan, magenta and yellow. With regard to image module 201, there are shown various devices for creating a toner image on the primary image forming member (PIFM) 221 and similar devices are also associated with the PIFMs 321, 421 and 521 but not illustrated. A primary charger 202 applies a uniform electrostatic primary charge to the photoconductive member 221 which is in the form of a drum or roller. An LED, laser or other suitable imaging source 203 which may even be an image projection device, image-wise modulates the electrostatic primary charge to form an electrostatic latent image on the peripheral surface of the photoconductive member 221. The latent image on the photoconductive member is developed with dry pigmented insulative toner particles by development station 204 to form a developed toner particle image. The developed image is electrostatically transferred in primary toner image transfer nip 216*a* to the intermediate transfer member or roller (ITR) 210. Other modules have respective primary nips 316*a,* 416*a,* 516*a* between a respective PIFM and a respective ITR. The material characteristics and dimensions of layers included in PIFM 221 and in ITR 210, respectively, are similar in all respects to the described material characteristics and dimensions of layers included in rollers 21 and 11 of FIG. 4*a,* respectively, and similarly for the other modules. However, any suitable materials and dimensions may be used. The developer may be a so-called single component developer wherein the carrier and toner particles are one and the same. Preferably, however, the developer includes at least two components; i.e., non-marking magnetic carrier particles and marking non-magnetic insulative toner particles. In addition, the developer can also include so-called "third component" particle addenda such as, for example, submicron silica particles to enhance toner transfer charge stability and developer flow properties. For high quality images, toners having relatively small particle size are preferred, such as toners that have a mean volume weighted average diameter between 2 micrometers and 9 micrometers, as can be measured by commercially available equipment such as a Coulter Multisizer. Typically, the toner particles are triboelectrically charged in the developer station and transferred through electrostatic attraction to the PIFM to develop the electrostatic latent image. An electrical power supply (213) applies a DC electrical voltage bias of proper polarity to ITR 210 to attract the oppositely charged toner particles of the toner image to transfer to the ITR. After transfer, the surface of the rotating photoconductive member 221 is moved to a cleaning station 205 wherein any untransferred toner remnants and other debris are cleaned from the surface and the surface is prepared for reuse for forming the next image to be developed with the particular color toner associated with this module. A cleaning brush 206 or other cleaning device may be provided for ITR 210 as shown. In this embodiment, a single transport web 215 in the form of an endless belt serially transports each of the receiver members or sheets 231A, 231B, 231C and 231D through four secondary toner image transfer nips 216*b*, 316*b*, 416*b* and 516*b* formed by the ITRs 210, 310, 410 and 510, respectively of each module with respective transfer backup rollers 261, 361, 461 and 561 where each color separation image is transferred in turn to a receiver member so that each receiver member receives up to four superposed registered color images to be formed on one side thereof.

The insulative endless belt or web (IEW) 215 is preferably made of a material having a bulk electrical resistivity greater than $10^5$ ohm-cm. Where electrostatic hold down of the receiver member is not employed, it is more preferred that the web 215 have a bulk electrical resistivity of between $10^8$ ohm-cm and $10^{11}$ ohm-cm; where electrostatic hold down of the receiver member is employed, it is more preferred that the web have a bulk resistivity of greater than $1\times10^5$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton®), polyethylene napthoate, or silicone rubber. Whichever material that is used, such web material may contain an additive, such as an anti-static (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge marking particle image transfer; however, it is more preferable to have an arrangement without the conducting layer and instead apply the transfer bias through either one or more of the support rollers or with a corona charger. The endless belt is relatively thin (20 micrometers to 1000 micrometers, preferably, 50 micrometers to 200 micrometers) and is flexible.

Registration of the various color images requires that a receiver member be transported through the modules in such a manner as to eliminate any propensity to wander and a toner image being transferred from an ITR in a given module must be created at a specified time. The first objective may be accomplished by electrostatic web transport whereby the receiver is held to the transport web (IEW) 215 which is a dielectric or has a layer that is a dielectric. A charger 269, such as a roller, brush or pad charger or corona charger may be used to electrostatically adhere a receiver member onto the web. The second objective of registration of the various stations' application of color images to the receiver member may be provided by various well known mechanisms such as by controlling timing of entry of the receiver member into the nip in accordance with indicia printed on the receiver member or on a transport belt wherein sensors sense the indicia and provide signals which are used to provide control of the various elements. Alternatively, control may be provided without use of indicia using a robust system for control of the speeds and/or position of the elements. Thus, suitable controls including a logic and control unit (LCU) can be provided using programmed computers and sensors including encoders which operate with same as is well known in this art.

Additionally, the objective may be accomplished by adjusting the timing of the exposure forming each of the electrostatic latent images; e.g. by using a fiducial mark laid down on a receiver in the first module or by sensing the position of an edge of a receiver at a known time as it is transported through a machine at a known speed. As an alternative to use of an electrostatic web transport, transport of a receiver through a set of modules can be accomplished using various other methods, including vacuum transport and friction rollers and/or grippers.

In the embodiment 200 of FIGS. 8*a* and 8*b*, each module 201, 301, 401 and 501 is of similar construction to that shown in FIGS. 7*a–c* except that, as shown, one transport web operates with all the modules and the receiver member is transported by the IEW from module to module. Four receiver members or sheets 231A, B, C and D are shown about to be receiving images from the different modules, it being understood as noted above that each receiver member may receive one color image from each module and that up to four color images can be received by each receiver member. Each color image may be a color separation image. The movement of the receiver member with the transport belt (IEW 215) is such that each color image transferred to the receiver member at the secondary toner image transfer nip (216*b*, 316*b*, 416*b*, 516*b*, respectively) of each module formed with the transport belt is a transfer that is registered with the previous color transfer so that a four-color image formed in the receiver member has the colors in registered superposed relationship on the receiver member. The receiver members are then transported to a fusing station 250, as is the case for all the embodiments, to fuse the dry toner images to the receiving member using heat and pressure. A detack charger 218 or scraper may be used to overcome electrostatic attraction of the receiver member to the IEW such as receiver member 231E upon which one or more toner images are formed. The transport belt is reconditioned by providing charge to both surfaces by opposed corona chargers 216, 217 which neutralize charge on the surfaces of the transport belt.

In the embodiment of FIGS. 8*a* and 8*b*, a receiver member may be engaged at times in more than one image transfer nip and preferably is not in the fuser nip and an image transfer nip simultaneously. The path of the receiver member for serially receiving in transfer the various different color images is generally straight, thereby facilitating use with receiver members of different thickness. Support structures are provided before entrance and after exit locations of each transfer nip to engage the transport belt on the backside and alter the straight line path of the transport belt to provide for wrap of the transport belt about each respective ITM so that there is wrap of the transport belt of greater than 1 mm on each side of the nip. This wrap allows for reduced pre-nip and post-nip ionization. The nip is where the pressure roller contacts the backside of the web or where no roller is used where the electrical field for image transfer to a receiver sheet is substantially applied but preferably still a smaller region than the total wrap of the transport belt about the ITM. The wrap of the transport belt about the ITM also provides a path for the lead edge of the receiver member to follow the curvature of the ITM but separate from engagement with the ITM while moving along a line substantially tangential to the surface of the cylindrical ITM. Pressure of the transfer backup rollers 261, 361, 461 and 561 upon the backside of the transport belt forces the surface of the compliant ITM to conform to the contour of the receiver member during transfer. Preferably, the pressure of the backup rollers on the transport belt is 7 pounds per square inch or more and it is also preferred to have the backup rollers have a layer whose hardness is in the same range for the compliant layer of the ITM noted above. The electrical field in each nip is provided by an electrical potential provided to the ITM and the backup roller. Typical examples of electrical potential might be grounding of a conductive stripe or layer on the photoconductive member, an electrical bias of about 600 volts on the ITM and an electrical bias of about 900 volts on the backup roller. The polarity would be appropriate for urging electrostatic transfer of the charged toner particles and the various electrical potentials may be different at the different modules. In lieu of a backup roller, other means may be provided for applying the electrical field for transfer to the receiver member such as a corona charger or conductive brush or pad.

Drive to the respective modules is preferably provided from a motor DM which is connected to drive roller 229, which is one of plural (two or more) rollers about which the IEW is entrained. The drive to roller 229 causes belt 215 to be preferably frictionally driven and the belt frictionally drives the backup rollers 261, 361, 461 and 561 and also the ITRs 210, 310, 410 and 510. The ITRs in turn frictionally drive a respective photoconductive drum 221, 321, 421 and 521 in the directions indicated by the arrows. It is preferred to have, as shown in FIG. 8*b*, a common shaft 214 or gear connection to each respective shaft 219, 319, 419 and 519 of an ITR or each respective gear fixed to the shaft of the ITR such as gear 243*a* of module 201, gear 343*a* of module 301, gear 443*a* of module 401, gear 543*a* of module 501. A set of respective bevel gears 239, 339, 439 and 539, or other suitable gearing arrangement or mechanical drive connection, may be used to provide a gearing or drive connection between shaft 214 and respective shafts 219, 319, 419 and 519. The respective ITRs 210, 310, 410 and 510 then frictionally provide drive through respective nonslip engagement to the respective photoconductive members 221, 321, 421 and 521 so that the image bearing surfaces run synchronously for the purpose of proper registration of the various color separations that make up a completed color image.

Alternatively, instead of shaft 214, a common shaft similar to shaft 214 may similarly be used to provide a gearing or drive connection between the shafts of the respective photoconductive members 221, 321, 421 and 521 instead of the shafts 219, 319, 419 and 519 (this alternative not illustrated). The control of overdrive is accomplished substantially identically in each color module so that a toned image developed on each latent image on the photoconductive elements 221, 321, 421 and 521 can be transferred with similar accuracy to ITMs 210, 310, 410, 510. The toned images are transferred sequentially to a respective receiver electrostatically attached to the transport web 215 supported by backup rollers 261, 361, 461, 561 as the receiver successively passes underneath the respective ITMs through nips 216*b*, 316*b*, 416*b*, 516*b*. The power supply 213 provides a respective electrical bias potential to each ITM 210, 310, 410 and 510 and also electrically biases the backup rollers 261, 361, 461 and 561 with a respective DC voltage of suitable polarity to electrostatically attract the respective toner on the respective ITM to the receiver sheet in the respective nip.

The substantial reduction or elimination of overdrive (or underdrive) in this embodiment may be accomplished by the various mechanisms described herein. Preferably, a redundant gearing linkage in addition to the nonslip friction drive is used. Thus, compliant ITR 210 is frictionally driven by belt 215 and frictionally drives PC drum or roller 221 at nonslip nip engagement 216*a*. A redundant gearing linkage is also provided by gear 243*a*, that is fixed to shaft 219 as is ITR 210 and which gear engages gear 244*a* that is fixed for rotation on a shaft upon which PC drum 221 is also fixed for rotation. It is preferred that the pitch diameters of respective gears 243*a* and 244*a* be no greater than the respective diameters of rollers 210 and 221. The redundant gearing linkage between PC drum 221 and ITR 210 provides a drag force that unexpectedly cancels the overdrive associated with the pressure engagement of the elastomeric compliant ITR 210 and the relatively more rigid PC drum 221 at nip 216*a*. The ITRs 210, 310, 410 and 510 have the characteristics described for the compliant ITR roller 11 of FIG. 4*a*. A redundant gearing linkage is also provided between ITR 210 and the backup roller 261. Although both the ITR 210 and the backup roller 261 are driven through nonslip friction drive with belt 215 there is a gearing connection between the shafts of both these members by engaged gears 274*a* fixed to rotate with backup roller 261 and 243*a* fixed to rotate with ITR 210. It is preferred that the pitch diameter of gear 274*a* is no greater than the outer diameter of backup roller 261. Thus, there is provided by this redundant gearing linkage a drag force that effectively cancels overdrive arising from the nip association of the compliant ITR 210 and the relatively more rigid backup roller 261. When a receiver sheet is in a nip, there is also a nonslip frictional engagement between the (relatively more rigid) receiver sheet and the ITM with which it is in nip engagement. A receiver sheet may be in nip engagement with two ITMs simultaneously.

For the other modules 301, 401 and 501 similar redundant gearing connections are provided by gear combinations 344*a*, 343*a*, 374*a*; and 444*a*, 443*a*, 474*a*; and 544*a*, 543*a* and 574*a*, respectively. The provision of the shaft 214 connection is optional but advantageously locks all the members together for improved registration. If necessary, a tendency drive may be provided by a tendency motor TM that drives shaft 214 when a sensor senses that additional torque is needed to drive the ITRs.

The apparatus of FIGS. 8*a* and 8*b* improves image quality in color electrophotography by greatly reducing misregistration of different color separation images on a receiver. This is accomplished by means of the gearing linkages provided in each module which ensure that the individual toner images which are combined to form a full color image have substantially the same lengths, as measured parallel to the direction of motion of belt 215. In general, although the angular velocities of the individual rollers are determined to a high degree of accuracy by the redundant gears, the precision of these image lengths depends on the accuracy of manufacture of the rollers that are geared together, and in particular, on deviations of the outer diameters from pre-specified values. Thus, for example, if the as-manufactured diameters of rollers 221, 210 and 261 differ slightly from aim values, a deviation in each nip from a pre-specified amount of overdrive or underdrive will result, producing a deviation in the length of a toner image produced on receiver 231A in module 201, and similarly for the other modules. It will be evident that, owing to a randomness inherent in these deviations, the quality of the resulting registration of toner images from all the modules may be slightly degraded in an unpredictable fashion. On the other hand, if redundant gearing according to the subject invention is not provided, the amounts of unwanted overdrive or underdrive produced in each module by module-to-module variations in drag and by dimensional variations arising from manufacturing tolerance variations (or mounting tolerance variations) of the rollers or other members are much larger, and therefore produce much more serious registration errors. The use of redundant gearing in the present invention significantly reduces this problem and greatly improves registration.

To minimize the effects of differential overdrive, each gear ratio, e.g., for gears 244*a* and 243*a* linking rollers 221 and 210 and for gears 243*a* and 274*a* linking rollers 210 and 261, is set close to that which would be produced by the natural speed ratio of each pair of contacting rollers, i.e., set so as to almost match the overdrive or underdrive that can be measured at the same engagement in the absence of redundant gearing. It is important not to exactly match the natural speed ratios so as to avoid gear chatter. The mechanically predetermined gear ratios determine the actual speed ratio of the peripheral speed of roller 221 far from nip 216*a* divided by the speed of IEW 215. When the natural speed ratio in each nip is almost matched, this actual ratio will generally correspond to some degree of overdrive or underdrive of roller 221 with respect to IEW 215. In each of the modules, as a result of an identical redundant gearing in each module, this degree of overdrive or underdrive will be substantially the same. This overdrive or underdrive can be precisely compensated for by the respective writer in each module, e.g., writer 203, which can be programmed so as to appropriately stretch, or compress, a latent image formed on photoconductive roller 221, so that a corresponding toner image has a correct length after it is transferred to a receiver, e.g., receiver 231. The same correct length is similarly provided by substantially the same compressing or stretching of the respective latent images formed in the other modules.

When gear ratios are preferably chosen to provide speed ratios that are consistent with substantially no overdrive or underdrive, the present invention also improves image quality in color electrophotography by minimizing toner smearing that can occur due to slippage typically caused by a peripheral speed mismatch due to overdrive in a transfer nip.

Figure 8C:
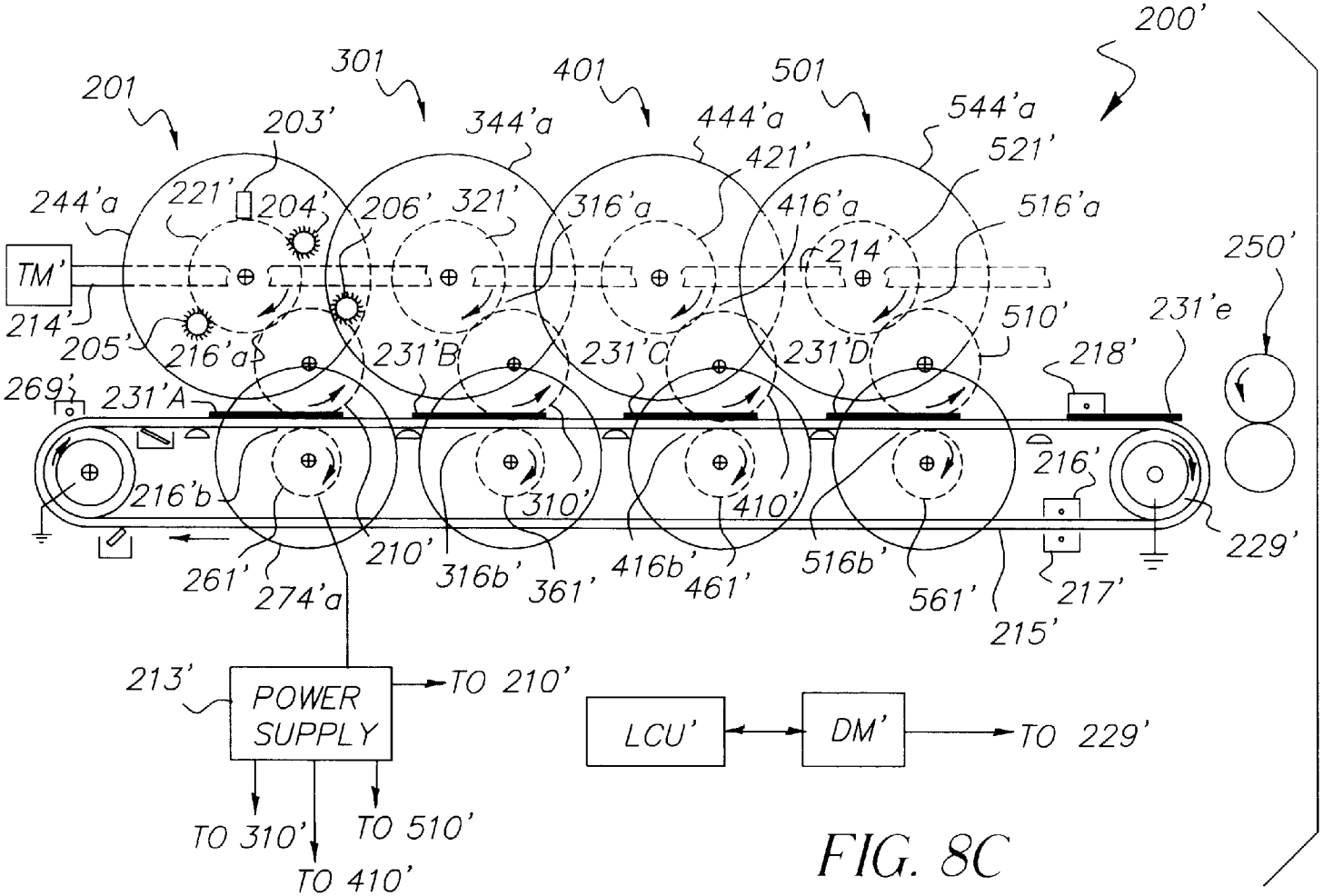
FIG. 8*c* is a schematic side elevational view of a transfer apparatus incorporating an alternative embodiment of the invention.

FIG. 8*c* shows a full color electrophotographic printing press or apparatus 200' as an alternative preferred embodiment of the apparatus of the invention shown as 200 in FIG. 8*a*. The primed (') structures or members in FIG. 8*c* are in all respects similar to corresponding unprimed structures or members in FIG. 8*a*. In the embodiment 200' of FIG. 8*c*, each module 201', 301', 401' and 501' is of similar construction to that shown in FIGS. 7*d* and 7*e* except that as shown one transport web operates with all the modules and the receiver member is transported by the IEW 215' from module to module. Embodiment 200' differs from embodiment 200 in that redundant gearing linkages are provided between the photoconductor rollers and the backup transfer rollers located behind web 215', with no gearing connections to the intermediate transfer rollers. Thus, ITR 210' is not linked by redundant gears to backup roller 261' nor to photoconductor roller 221', and similarly for the other backup rollers 361', 461' and 561' and the respective photoconductor rollers 321', 421' and 521'. The backup rollers are frictionally driven by nonslip pressure contact with the underside of IEW 215'. Conformable ITRs 210', 310', 410' and 510' are rotated by frictional nonslip contact with IEW 215' or by nonslip contact with receivers 231A', 231B', 231C' and 231D', respectively. As depicted in FIG. 8*c*, gears 344*a'* and 544*a'* are shown staggered with respect to gears 244*a'* and 444*a'* because of the large diameters of these gears. However, it may not be necessary to include staggered gears in a different geometric arrangement (not illustrated). In this embodiment it is optional to use a common shaft 214' and associated bevel gearing connections to the respective shafts of all the photoconductor rollers 221', 321', 421', and 521', in similar fashion as depicted in FIG. 8*b*, or alternatively as described above, a common shaft may be used to link the backup rollers 261', 361', 461' and 561'. It will be apparent that a drag force or torque may be applied to common shaft 214', and that this drag force or torque will simultaneously act on all of the primary and secondary nips 216*a', b'*, 316*a', b'*, 416*a', b'* and 516*a', b'*. As explained herein above, lateral stresses will be produced in the ITRs in each of the nips formed by the ITRs, these lateral stresses opposing the drag force applied in each module. Thus, stresses are produced, e.g., in conformable roller 210' forming nips 216*a'* and 216*b'*, which exactly compensate for the applied drag or torque, and similarly in each module. In embodiment 200' the use of one gearing linkage per module instead of two gearing linkages as in embodiment 200 may advantageously reduce the frictional drag resistance produced by the modules against the drive provided to IEW 215' by motor DM' which drives roller 229', so that the tensile strain in IEW 215' of FIG. 8*c* may be beneficially lower than in IEW 215 of FIG. 8*a*. Use of one gearing linkage per module rather than two is simpler and less costly.

Figure 11:
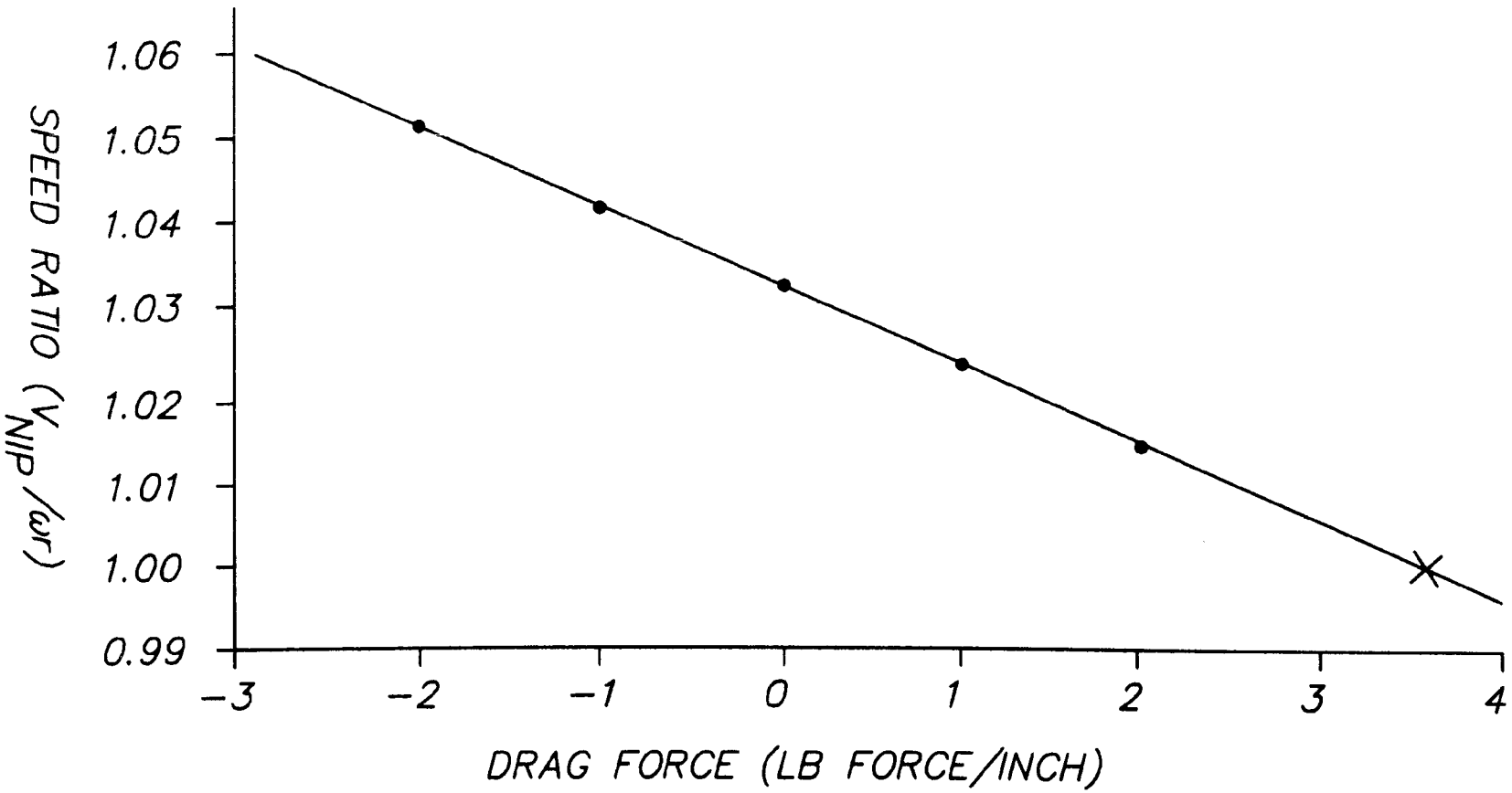
FIG. 11 is a graph illustrating a relationship between speed ratio for an elastomeric roller (as related to overdrive or underdrive) vs. drag force as determined by a computer simulation using a composite elastomeric roller.

Speed ratio characterizes the degree of overdrive in an elastomeric nip. A speed ratio of 1.000 represents no overdrive. FIG. 11 shows speed ratios computed using a finite element modeling computer simulation of a composite elastomeric roller rolling with constant engagement against a non-deformable planar surface. Speed ratios larger than 1.000 represent overdrive, and speed rates less than 1.000 represent underdrive. The linear decrease in speed ratio with increasing positive drag is noted. At a positive drag of approximately 3.5 lb/inch, the roller investigated theoretically in FIG. 11 would show zero overdrive and a speed ratio of 1.000. This FIG. also illustrates that by applying specific positive or negative drag forces, speed ratios over a wide range of values can be produced in the same elastomeric nip. Thus it is clear that application of controlled drag force is an effective method to control overdrive in elastomeric nips, and that in favorable cases the application of an external drag force can reduce overdrive (or underdrive) effectively to zero or a negligible value.

Figure 12:
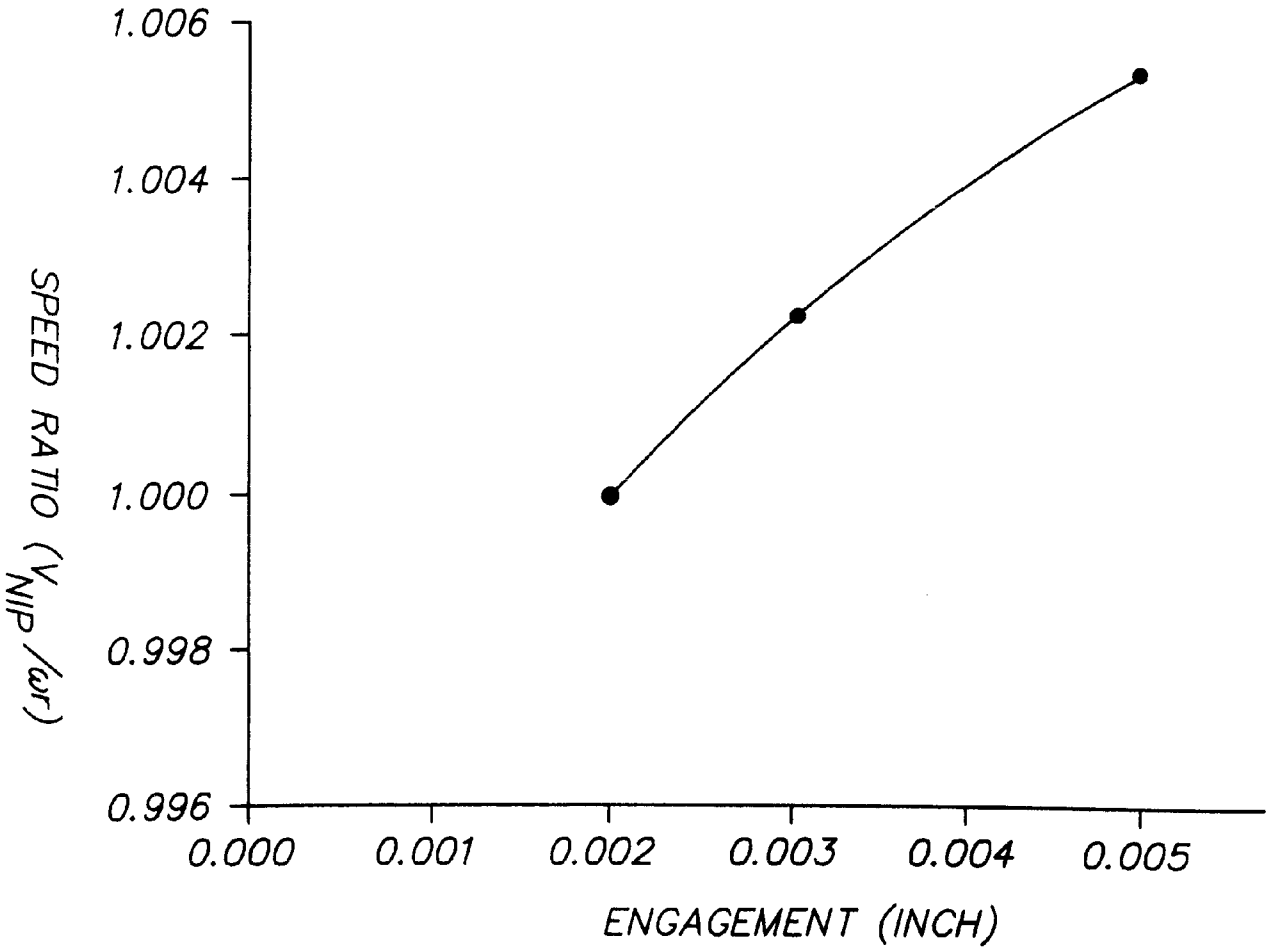
FIG. 12 is a graph illustrating speed ratio (as related to overdrive) vs. engagement for a compliant intermediate transfer roller against a rigid plate.

FIG. 12 shows a computer simulated rolling behavior of an ITR roller suitable for use in an electrophotographic engine as a function of engagement for a constant drag force equivalent to 80 in-oz of torque on the roller shaft. This typical value of drag has been chosen to show that speed ratios of 1.000 can be obtained for geometries of practical interest. This simulation was performed using a geometry equivalent to that shown in FIG. 5*c, d* but considering the case of driving of a rigid plate on a frictionless support.

The present invention has a number of advantages in a transfer system employing any conformable roller and in particular for conventional elastomeric ITM rollers so that it can be readily implemented. The apparatus of the invention is not strongly dependent on the properties of the rollers, their detailed dimensions or friction coefficients, provided there is no gross slippage. In the mechanical feedback mode using redundant gearing, it will work reliably for rollers that have different overdrive responses. Moreover, redundant gearing linkages are advantageously insensitive to variations of engagement.

The described redundant linkage embodiment is self-compensating, so that changes in elastic properties or dimensions of a conformable roller that might be caused by changes in environment, aging, temperature, or wear have advantageously much less effect on registration than if redundant gearing is not employed.

Figure 9:
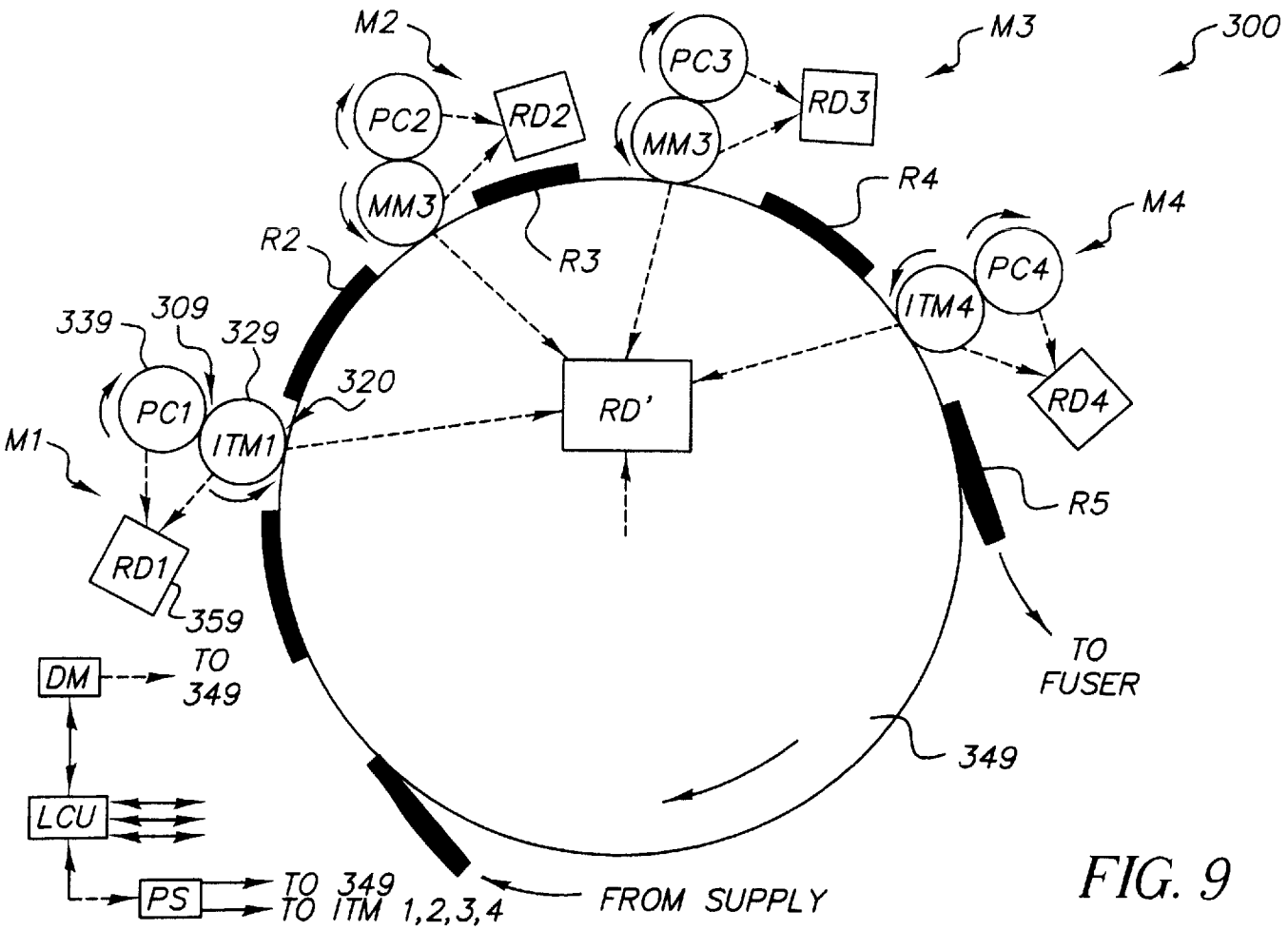
FIG. 9 is a schematic elevational view of a transfer apparatus incorporating another embodiment of the invention.

The invention is also applicable to an electrographic process and to other image transfer systems which employ rollers for transferring images in register to other members. The invention is also highly suited for use in other electrostatographic reproduction apparatus such as, for example, those illustrated in FIGS. 9 and 10. In the transfer embodiment indicated by the numeral 300 in FIG. 9, a plurality of color electrophotographic modules M1, M2, M3 and M4 are provided but situated about a large rotating receiver transport roller 349. Roller 349 is of sufficient size to carry or support one or more, and preferably as shown, at least four receiver members in the form of sheets R1, R2, R3, R4 and R5 on the periphery thereof so that a respective color image is transferred to each receiver member as the receiver members each serially move from one color module to the other with rotation of roller 349. The receiver members are moved serially from a paper supply (not shown) on to the drum or roller 349 in response to suitable timing signals from a logic and control unit (LCU) as is well known. After being fed onto roller 349, the receiver member R1 may be retained on the roller by electrostatic attraction or gripper member(s). The receiver member, say R1, then rotates past module M1 wherein a toner image formed on intermediate transfer member or roller ITM1 is transferred to R1 at a secondary transfer nip 320 between ITM1 (329) and roller 349. Each ITM in this embodiment is formed with a conformable layer as described for the previously described embodiments herein, e.g., roller 11 of embodiment 10, so the problem of overdrive (or underdrive) is corrected for, as will be described. The toner image, for example black color, is first formed on primary image forming member PIFM 339 (e.g., photoconductor PC1) in a manner as described for prior embodiments and transferred to ITM1 at a primary transfer nip 309 between PC1 and ITM1, preferably using electrostatic transfer. PC1 and the other photoconductive drums may include a conformable layer. Drive is provided from motor DM to roller 349. The other members are frictionally driven by the member receiving the motor drive through friction drive at each of the nips. Thus, if roller 349 receives the motor drive, each ITM is driven without slip by frictional engagement under pressure at the secondary transfer nip. In addition to the frictional drive between roller 349 and each ITM, there is a frictional drive without slip between each ITM and the respective PIFM such as PC1 at the no-slip engagement at the primary nip. Each primary and secondary nip has the members under pressure so that the ITMs each deform at each nip. Additionally, there is a negative or positive speed modifying force provided to each ITM.

Assuming that each ITM is formed with a compliant elastomeric layer having a Poisson ratio in the range of approximately 0.45 to 0.50, thereby presenting a problem of overdrive which varies module-to-module, the problem may be effectively resolved by mechanically coupling each respective PIFM with its corresponding ITM, such as PC1 and ITM1 with preferably a redundant gearing linkage RD1 of the type described above. Similar redundant gearing linkages are provided by RD2, RD3 and RD4 for modules M2, M3 and M4, respectively, to provide a positive drag force in the nip 309. Other means as disclosed herein for imposing a positive drag force or torque on each ITM may also be provided. Where the ITMs are compressible members, a negative drag force or torque is provided between each PIFM and its corresponding ITM as described herein, such as by the use of a redundant gearing linkage or other mechanism described above. An electrical bias is provided by power supply PS to the ITMs and to roller 349 to provide suitable electrical biasing for urging transfer of a respective color toner image from a respective PIFM such as photoconductive drums (PC1–4) to a respective ITM and from the ITM to a receiver sheet to form the plural color toner image on the receiver member as the receiver member moves serially past each color module to receive respective color toner images in register. After forming the plural color toner image on the receiver member, the receiver member, e.g., R5 is moved to a fusing station (not shown) wherein the plural color toner images formed thereon are fixed to the receiver member. The color images described herein have the colors suitably registered on the receiver member to form full process color images similar to color photographs.

The other color modules M2, M3 and M4 are similar to that described and may form toner images in, for example, cyan, magenta and yellow, respectively.

A speed modifying force is also preferably provided in the nip between roller 349 and each ITM. Such a force is preferably provided by using a redundant gearing linkage, one of which is schematically indicated by RD', wherein a gear concentric with and driven for rotation with roller 349 engages with respective gears concentric with and fixed for rotation with each of the ITMs, i.e., ITM 1–4. The gear concentric with roller 349 would have an outer diameter slightly larger than the diameter of roller 349, and a pitch diameter preferably no greater than the diameter of roller 349. Also, the gears concentric with rollers 329 and 339 respectively have pitch diameters that are preferably no greater than the respective diameters of rollers 329 and 339, and similarly for the other modules.

The various gear ratios may be set to any predetermined values, e.g., to provide negligible overdrive or underdrive for each pair of rollers in a nonslip nip relation to one another and connected by a redundant gearing linkage.

Alternatively, as described above, in order to minimize the effects of differential overdrive, each gear ratio is set close to that which would be produced by the natural speed ratio of each pair of contacting rollers, i.e., set so as to almost match the overdrive or underdrive that can be measured at the same engagement in the absence of redundant gearing. It is preferable not to exactly match the natural speed ratios so as to avoid gear chatter. The mechanically predetermined gear ratios determine actual speed ratios, e.g., the ratio of the peripheral speed of roller 339 far from nip 309 divided by the peripheral speed of roller 349. When the natural speed ratio in each of nips 309 and 320 is almost matched, this will generally result in some degree of overdrive or underdrive of roller 339 with respect to roller 349. This can be precisely compensated for by a digital image writer (not shown) which can be programmed so as to appropriately stretch, or compress, a latent image formed on photoconductive roller 339 so that a corresponding toner image has a correct length after it is transferred to a receiver, e.g., receiver R1 when the receiver is moved into nip 320.

Figure 10:
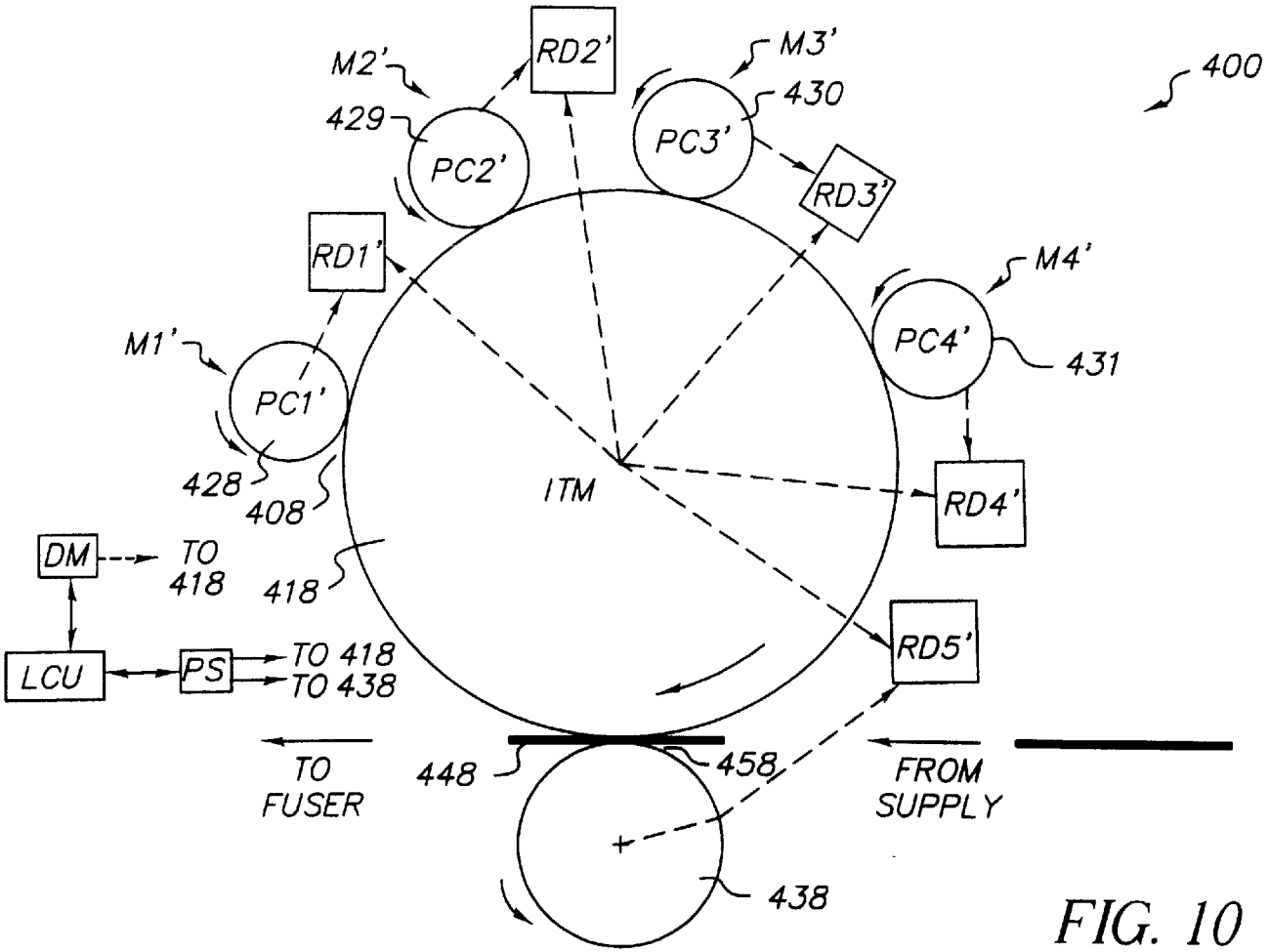
FIG. 10 is a schematic elevational view of a transfer apparatus incorporating yet another embodiment of the invention.

In another transfer embodiment indicated by the numeral 400 in FIG. 10, four-color modules M1', M2', M3', and M4' are shown situated about a common ITM roller 418. Each color module is a primary image forming member (PIFM) having members associated therewith for forming a primary image on each corresponding PIFM of a respective color, as described for other embodiments herein. Each color module preferably includes a photoconductive drum 428 (PC1'), 429 (PC2'), 430 (PC3'), 431 (PC4') and forms a respective color toner image in a similar manner as for the PIFMs described above. Preferably, the order of color toner image transfer to the ITM 418 is PC1'-yellow, PC2'-magenta, PC3'-cyan, and PC4'-black. The respective toner images formed on the respective photoconductive drums are each transferred electrostatically to ITM 418 at a respective primary nip formed with the ITM under pressure and with suitable electrical biasing provided by power supply PS to ITM 418. Each color image is transferred in register to the outer surface of the ITM to form a plural color image on the ITM. Drive from a drive motor DM is preferably provided to ITM 418 which has a conformable layer, preferably a compliant elastomeric layer. The photoconductive drums PC1'–4' may include a conformable layer. The ITM is frictionally engaged (nonslip) with the photoconductive drums PC1'–4' under pressure so that the respective nip areas of the ITM tend to distort. Overdrive (or underdrive) corrections using drag forces may be provided as described herein for the previous embodiments, preferably using respective redundant gearing linkages as represented by RD1'–RD5'. Thus, for an elastomeric ITM which is for all practical purposes incompressible, a redundant gearing linkage may be provided or other (positive) drag force or torque applied to the respective PC to eliminate overdrive. Similarly, for a compressible ITM a negative drag force or torque may be provided such as described herein to correct for underdrive. A receiver member 448 is fed from a suitable paper supply in timed relationship with the four-toner color image formed serially in registered superposed relationship on the ITM and transferred to the receiver member at the nip with backup roller 438. The power supply PS provides suitable electrical biasing to backup roller 438 to induce transfer of the plural or multicolor image to the receiver member. The receiver member is then fed to a fuser member for fixing of the four-color image thereto. A transport belt (not shown) may be used to transport the receiver member through the nip wherein in the nip, the receiver member is between the ITM and the transport belt.

As in the embodiments previously described, there is a nonslip condition between the ITM and the receiver member as well as between the receiver member and the backup roller 438. In the case of a conformable ITM, a redundant gear linkage RD5', as described herein, may be provided between the backup roller 438 and the ITM to provide a drag force, e.g., a positive drag force for correction of overdrive between a relatively rigid backup roller 438 and an elastomeric ITM which form a secondary nip under pressure for transfer of a composite color image formed on the ITM to the receiver member or sheet 448. In each primary transfer nip and in the secondary transfer nip there is nonslip frictional engagement between each PC and the ITM and between the ITM and the receiver sheet. The ITM is under pressure in each nip and deforms. When a gear is fixed for rotation with ITM 418 and engages a respective gear fixed for rotation with each photoconductive drum, the ITM's gear also preferably engages a gear fixed for rotation with backup roller 438 to provide the respective redundant linkages. The various gear ratios may be set to any predetermined values, e.g., to provide negligible overdrive or underdrive for each pair of rollers connected by a redundant gearing linkage. As described above, to minimize the effects of differential overdrive, each gear ratio is set close to that which would be produced by the natural speed ratio of each pair of contacting rollers, i.e., set so as to almost match the overdrive or underdrive that can be measured at the same engagement in the absence of redundant gearing. It is important not to exactly match the natural speed ratios so as to avoid gear chatter. The mechanically predetermined gear ratios determine actual speed ratios, e.g., the ratio of the peripheral speed of roller 428 far from nip 408 divided by the speed of receiver 448 passing through nip 458. When the natural speed ratios are almost matched in the various nips, some degree of overdrive or underdrive of receiver 448 with respect to roller 428, and similarly for rollers 429, 430, and 431, will generally result. This can be precisely compensated for in module M1' by a digital image writer (not shown) which can be programmed so as to appropriately stretch, or compress, a latent image formed on photoconductive roller 428 so that a corresponding toner image has a correct length after it is transferred to a receiver, e.g., receiver 448, and similar adjustments of latent image lengths are made in modules M2', M3', and M4'. When redundant gearing linkages RD1'–5' are employed, it is preferred that the pitch diameter of each gear is no greater than the outer diameter of the corresponding associated roller. When redundant gearing linkages RD1'–5' are not employed, a speed modifying force or torque is applied to each of rollers 428, 429, 430, 431 and 438, as described herein above.

As may be seen from the description above, redundant gearing linkages of the invention are well suited to apparatus featuring several image separation printing stations that are ganged together to produce a complete electrophotographic print engine where the surface speeds of all nips are synchronized. Driving a rigid half of a nip at a desired speed will produce drag forces or accelerating forces on an elastomeric other half of the nip which will cause the local speed of the elastomer as it engages the nip to asymptotically approach the speed of the rigid half. Image damaging overdrives are drastically reduced.

The improved apparatus and method described herein works on all the nips in a system so that for a given intermediate member (ITM) roller, a PC, an ITM and a receiver nip with back up roller can be geared together. It will allow the PC/ITM nip to have a different engagement than the ITM/receiver nip yet still provide local drag forces in each nip to compensate for the overdrive intrinsic to that nip and its engagement.

The improved apparatus and method at least partially compensates for run out, making the manufacturing 'tolerances needed for rollers less stringent. If a roller contains run out that would otherwise change engagement and thus cyclically change the local overdriving tendency of a conformable nip, there will generally be a phase lag in the driving force for overdrive or underdrive. Finite element modeling suggests that a steady state conformal response to a large change of distortion of a roller is achieved in about 15 degrees of rotation, making it possible that real time correction for the major effects of run out may be provided. Dimensional changes such as swelling due to temperature changes or moisture absorption or shrinking due to wear are fully compensated for as steady state changes in drag forces in an apparatus employing redundant gear linkages.

The improved apparatus and method including redundant gear linkages compensates for roller wear in terms of dimensional changes and property changes that under other circumstances would change the engagement characteristics and thus the overdrive and contact pressures. Automatic correction for random variations in coating and thickness homogeneity of the elastomeric layer on the roller and variations in stack height of the toner are provided.

The drag forces work against the drive train biasing the redundant gearing linkage system to improve its overall motion quality by elimination of chatter. The concept does not depend in detail on the coefficient of friction, only the suppression of slip.

The following method may be used to determine whether or not slip occurs.

Assume that one has an electrostatographic engine including two rollers in nip relationship, at least one of which includes a conformable or a compliant (e.g. elastomeric) blanket. Further, assume that these rollers are configured in such a state that one can serve as a driving roller and the other a driven roller. Note: the rollers do not need to be in direct contact. For example, there can be a web between the two rollers.

In order to determine if the rollers are in a nonslip condition during the normal operation of the device, it is first necessary to measure the torque driving the driven roller during normal operation. This can be done using standard methodology, as is generally known. For example, one can measure the torque using a torque gauge, or other force measuring device. Alternatively, one can measure the torque needed to be applied in order to stall the driven roller or engine.

Figure 14:
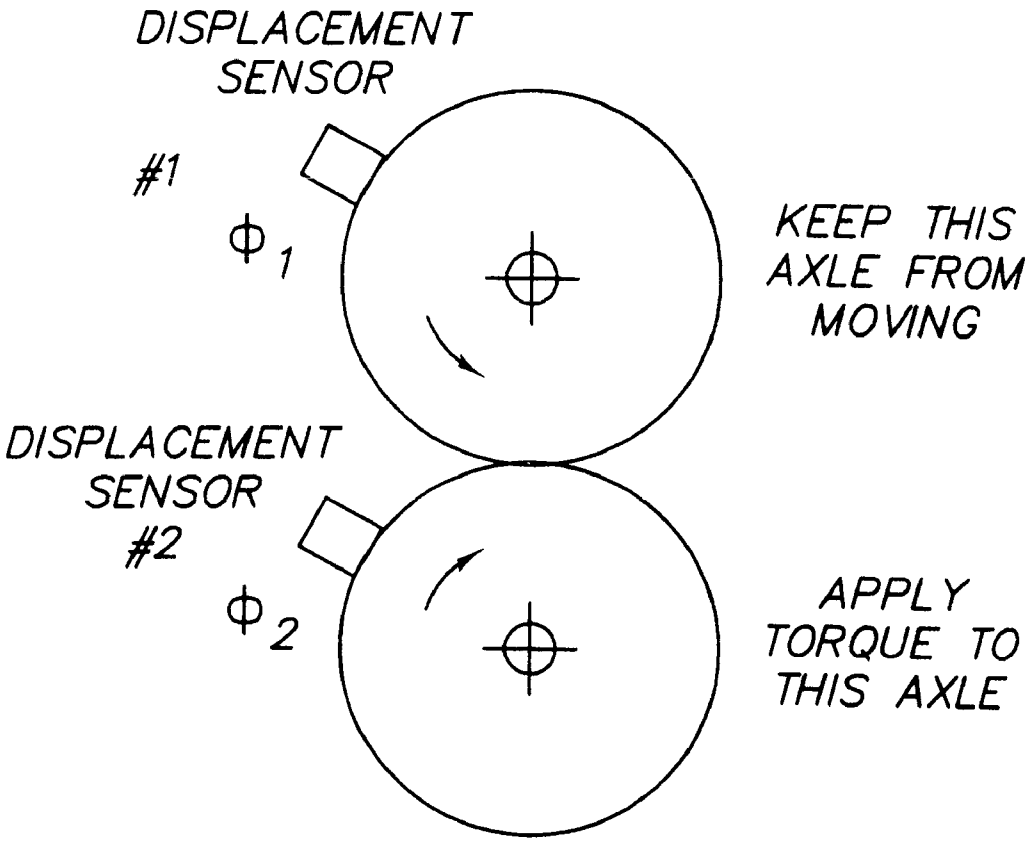
FIG. 14 is a schematic illustrating an elevational view of two rollers forming a nip and undergoing a test to determine presence of nonslip engagement in the nip.

Once the operating torque is determined, any mechanical coupling between the driven and driving rollers, such as gears, belts, etc. should be disconnected, so that the driven roller is driven directly by the driving roller. The driving roller should then be locked into a fixed position by clamping it, pinning the shaft, or any other appropriate means. The driven roller is "marked" in such a manner relative to a reference, such as a corresponding mark on the driving roller, so as to allow any displacement of the driven roller to be detected. This can be done in a variety of ways. Perhaps most simply is to place a mark on the side of each roller. Alternatively, various position sensors can be used, see FIG. 14. The specific sensing technique is not critical. A torque is then applied to the driven roller. While this torque is not critical, it is preferred that this torque be between the aforementioned driving torque and 110% of that driving torque. Slippage that occurs during normal operation may not be occurring under lower torque conditions. Alternatively, there is a risk of generating slippage at higher torques that do not occur during actual normal operation. (Note: if no slippage occurs at higher torque loadings, one can assume that no slippage occurs during normal operation).

Figure 15:
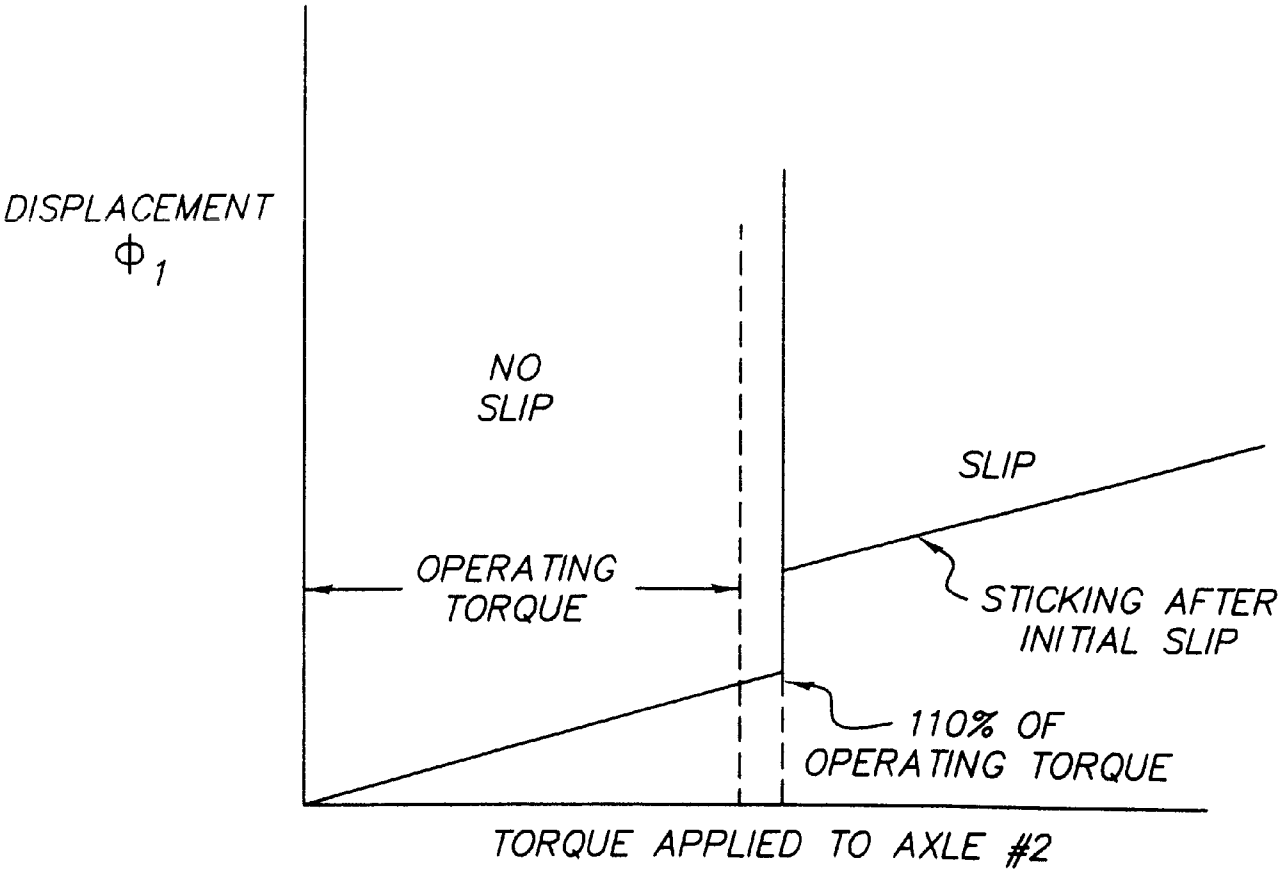
FIG. 15 is a graph illustrating a relationship between applied torque and displacement during a test where nonslipping engagement or stick-slip engagement is present.

Because of the elastic nature of the conformable blanket on at least one of the rollers, the application of the applied torque will generate some rotational displacement of the surface of the roller having the compliant blanket, say the driven roller. Assuming that the blanket acts in a linearly elastic fashion (which is not critical for this test), the rotational displacement of the surface of the roller having the compliant blanket will be proportional to the applied torque. The displacement will cease when the restoring torque, caused by the extension of the elastic layer, balances the applied torque. If the compliant material does not behave in a linearly elastic manner, the displacement versus torque plot may show some curvature. In addition, there may be some hysteresis noted between the displacement and torque during the loading and unloading cycles. Again, this is not critical. What is critical is that a finite rotational displacement occurs for a finite applied torque, see FIG. 15.

If slippage occurs, a single displacement will be not be observed for a given applied load. Rather, the displacement will increase with time with the torque fixed. Similarly, in the event that stick-slip occurs, the displacement will increase continuously for a brief period of time, pause, and then increase. This cycle will often be repeated multiple times.

The redundant gear linkage mechanism can be applied to a number of color separation stations at the same time using a common drive shaft so that all stations run in registry. This greatly simplifies the overall design and control of electrophotographic machinery.

Figure 13A:
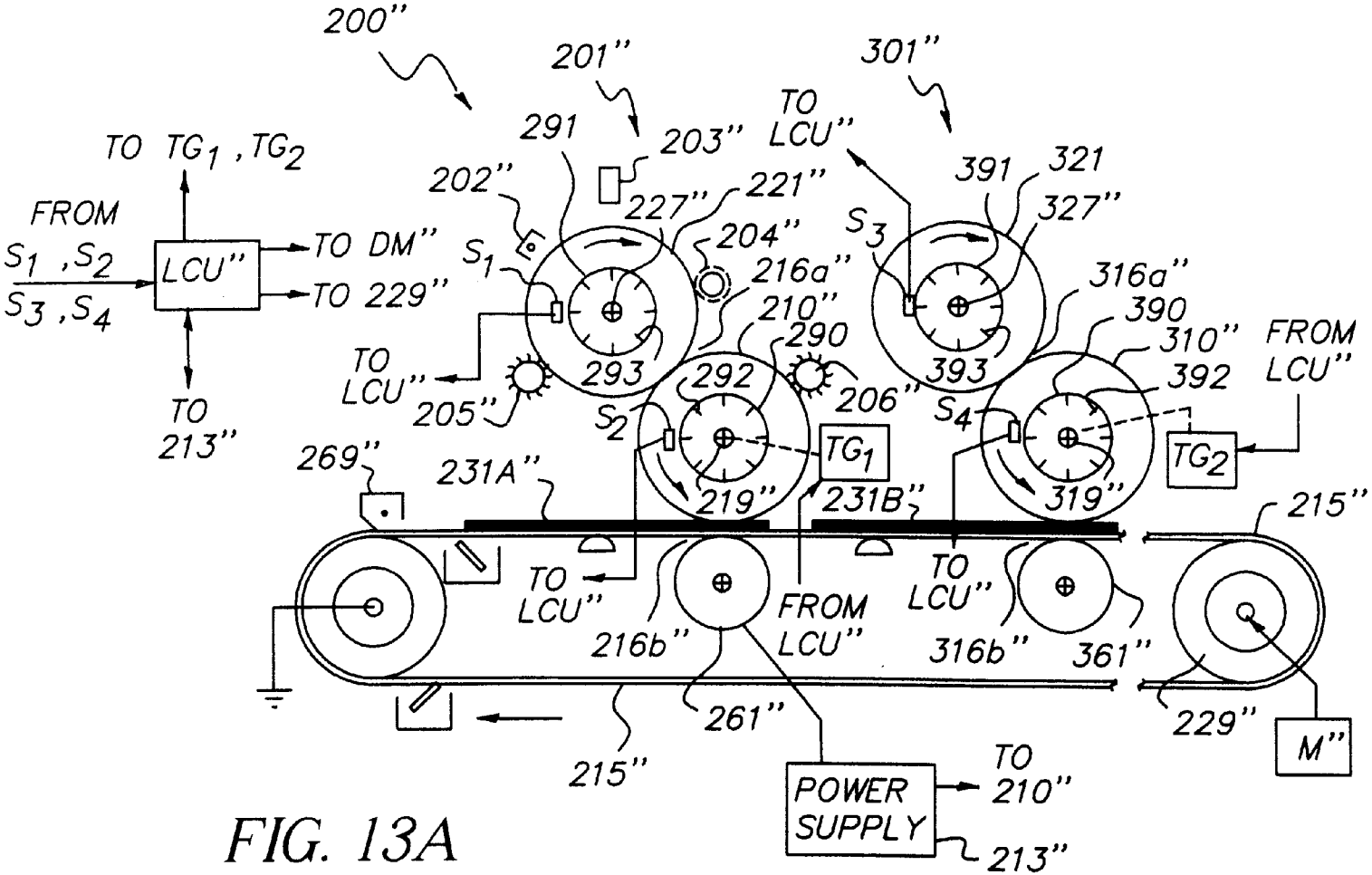
FIG. 13*a* is a schematic elevational view of a transfer apparatus incorporating still yet another embodiment of the invention.

With reference to FIG. 13*a,* an apparatus 200" is illustrated that is similar to that of FIG. 8*a* wherein similar structures are illustrated by similar numbers with the addition of a double prime ("). In this illustration, only two of the four color stations are illustrated but the structures of the two color stations not shown are identical to those shown. The embodiment of FIG. 13*a* differs from that of FIG. 8*a* in that a redundant gearing linkage is not provided between each compliant ITR and a respective photoconductive drum nor is such a redundant gearing linkage provided between a transfer backup roller and a respective ITR. The creation of toner images and their transfer to a receiver member are similar to that described for the embodiment of FIG. 8*a*. The use of the optional connection shaft 214 of FIG. 8*b* is not employed in the embodiment of FIG. 13*a*. Overdrive between the surface of an ITR and the surface of the photoconductive drum it is in nip relationship with is determined by sensing an encoder device 290, 390 associated, respectively, with each ITR and an encoder device 291, 391 associated with each photoconductive drum. Encoder markings or indicia of an encoder device, e.g., markings 292, 392 may be provided on the core of each ITR and markings 293, 393 on the core of each photoconductive drum, or alternatively an encoder wheel with such indicia may be secured to each shaft to which the respective ITRs and photoconductive drums are each fixed. The encoder devices each include, as is well known a sensor, e.g., sensors S1, S2, S3 and S4, which senses each of the fine markings and provides a signal representing detection of a mark. The fine markings or rulings may be at intervals representing spacings of, for example, 1/1200 of an inch at the peripheral surface of the ITM, or other suitable intervals may be used. It will be evident that the movement of the fine markings or rulings past the sensor may be interpreted by the LCU" as an angular velocity, whereupon if the outer radius of the ITR is known with precision, the surface speed of the ITR may be calculated as the product of this radius multiplied by the measured angular velocity. A similar encoder device is provided with each photoconductive drum. The signal outputs of the sensors S1, S2, S3 and S4 of the encoder devices are all input to the LCU" which is programmed to determine a differential between speed of rotation of the ITR relative to that of the respective photoconductive drum the ITR is in nip relationship with. After calibration, differences in speed between the ITR and the respective photoconductive drum as sensed by a differential reading of the pulse signals from the respective encoder devices of each module are interpreted by the LCU". A speed modifying force, preferably a torque, is then applied to shaft 219", and the LCU" calculates or determines from a look-up table in the LCU" a corrective torque to be applied to a respective torque generator TG1 or TG2 connected to each respective ITR shaft 219", 319" and modifies torque to the shaft to which each ITR is also respectfully attached to reduce overdrive.

Alternatively, the required positive or negative corrective torques may be produced by frictional forces applied to the respective shafts, or by any other suitable means of applying a speed modifying force as described above. As the response is relatively simultaneous to the sensing of instantaneous overdrive, the system corrects for runout and other factors involved with differential overdrive. Thus, for example where the ITR of one module has a non-uniform diameter the torque imparted by a torque generator connected to the ITR's shaft may increase torque to the shaft where an overdrive condition is detected. As an alternative to applying speed modifying forces to shafts 219" and 319", the speed modifying forces may instead be applied, e.g., using torque generators, to shafts 227" and 327".

Figure 13B:
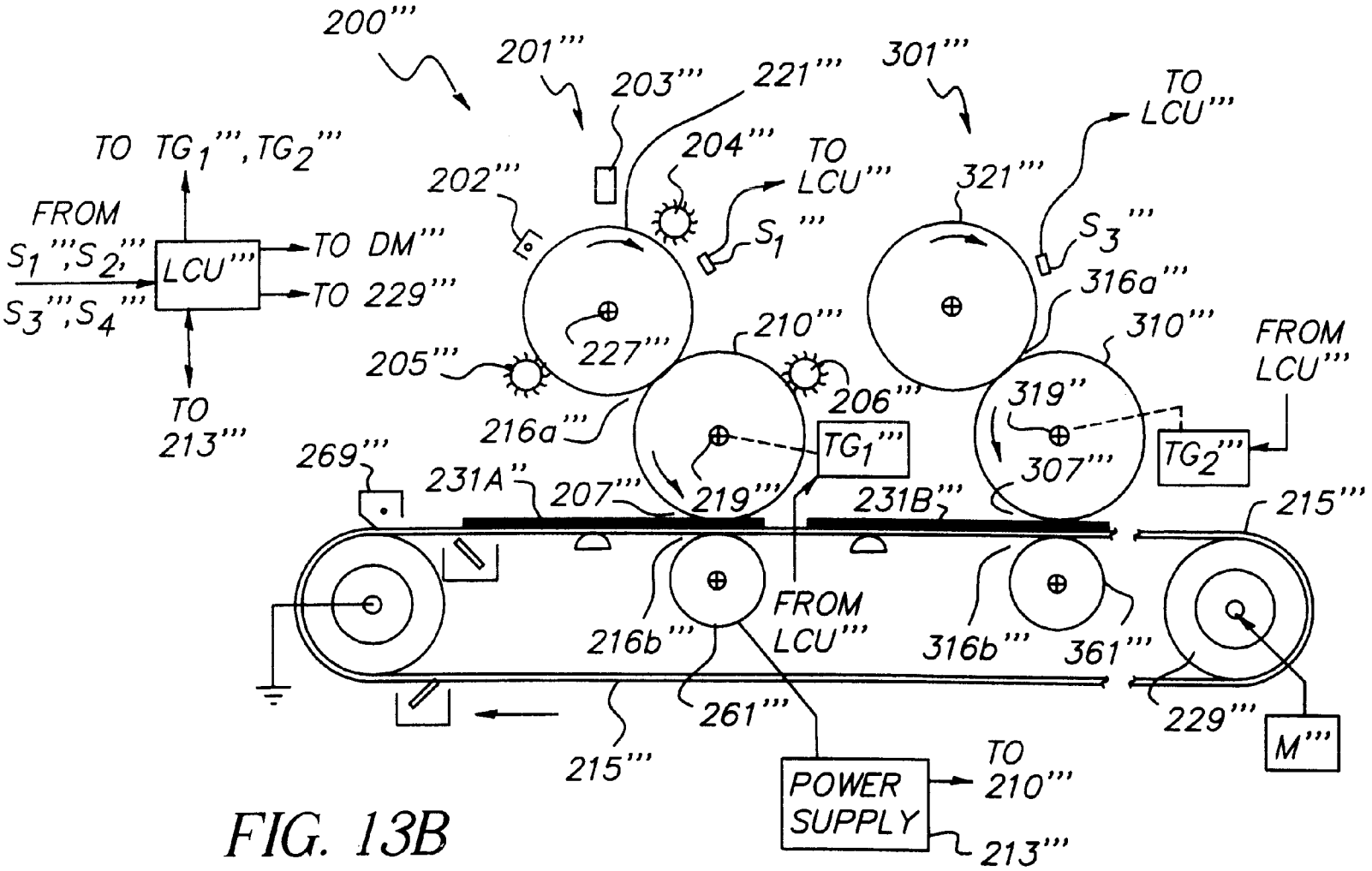
FIG. 13*b* is a schematic elevational view of a transfer apparatus incorporating an alternative to the embodiment of the invention shown in FIG. 13*a;*

FIG. 13*b* shows an alternative embodiment to that of FIG. 13*a* indicated as 200'", wherein the triple-primed ('") entities are in all respects similar to those of FIG. 13*a*. In this embodiment, encoder wheels are not used. In module 201'", fiducial marks, e.g., preferably in the form of identically spaced parallel fine lines or bars, are placed on the surface of photoconductive roller 221'" and sensed by sensor S1'". These lines or bars are preferably perpendicular to the direction of rotation of the roller, and have a predetermined center-to center distance which is preferably known precisely. The fiducial marks may be included as permanent markings of, or in, the outer layer of roller 221'" and may be placed for example near one edge of the roller outside of the imaging area. Sensor S1'" detects a number of fiducial lines or bars passing the sensor per unit time. Assuming the center-to-center distance is accurately known, the surface speed of roller 221'" can be calculated by LCU'" from signals sent to it by S1'". The LCU'" then compares this surface speed with that of IEW 215'", which is assumed to be known precisely. If there is a difference between these two speeds, a speed modifying force is applied to roller 221'" by, for example, a torque generator TG1'" to shaft 219'" in a manner as previously described, so as to reduce the speed difference substantially to zero or to some other predetermined difference. As an alternative to the use of TG1, any suitable speed modifying device as previously described above may be used to apply a torque or a frictional force to shaft 219'" or to the surface of roller 221'". As an alternative to applying a speed modifying force to ITM roller 210'", the speed modifying force is applied to PIFM roller 221'", either to its surface or to shaft 229'". Overdrive or underdrive of roller 321'" with respect to IEW 215'" is similarly corrected for or eliminated via signals sent to LCU'" by sensor S3'", and similarly for any other modules (not shown).

Alternatively, a digital writer may be used to form a latent electrostatic image on roller 221'", this latent image being for example in the form of a set of parallel equi-spaced bars or lines written perpendicular to the direction of rotation of roller 221'". The latent image is developed to form a toned image by toning station 204'". The toned bars or lines on the surface of roller 52 are formed at a known frequency, i.e., the number of bars or lines written per unit time is, say, equal to f and is established by the writer and stored in the LCU'". After the toned image has been transferred first to ITM 210'" and then subsequently to receiver 231A'", where the receiver may be a test sheet used for correcting for overdrive or underdrive, a sensor (not shown) is used to measure a frequency, say f', of passage of the toned bars or lines on the receiver past the sensor, and this frequency is sent to the LCU. Generally, as a result of overdrives or underdrives in nips 216*a*'" and 207'", f and f' will not be the same. A speed modifying force is applied to roller 210'" such that the frequencies f and f' are matched, whereupon it will be evident that the peripheral speed of roller 221'" far from nip 216*a*'" will then be the same as the speed of receiver 231A'" being transported by belt 215'". Alternatively, the difference between frequencies f and f' may be adjusted to any preset amount. As another alternative, the speed modifying force may be applied to roller 221'". The same procedure for correcting or eliminating overdrive induced registration errors is applied to module 301'" and any other modules (not shown). In a machine that includes a plurality of individual color stations, as described above, each station may be used to make a similar set of short bars or lines, with each set displaced in a direction parallel to axis 227'" so that no set overlaps another, and a similar frequency matching procedure is used in each station. When all stations have adjusted the corresponding peripheral speeds of the respective photoconductor rollers by suitable speed modifying forces applied separately in each station, it will be evident that a full color image made immediately subsequent to the test sheet passing through the machine will be in good registration. A test sheet may be utilized at any convenient time, e.g., between runs. Thereby, changes in dimensions of rollers or other members due to wear, aging, temperature changes and so forth may be compensated for in a simple way without the need for complicated adjustments to the individual writers.

In the various embodiments described above it is preferred that the conformable ITMs have a blanket layer having the characteristics described with reference to compliant elastomeric ITR 11 of FIG. 4*a* as to Young's modulus, thickness, electrical resistivity and are preferably covered with a relatively thin, hard surface or covering layer with the properties described for such layer as in ITR 11. Furthermore, as a preferred embodiment, the blanket layer or (where a hard outer covering layer covers the blanket layer) the composite blanket layer including the hard outer covering layer preferably has an operational Poisson ratio of approximately 0.45 to 0.50 measurable as described above.

In embodiments described above in which redundant gearing linkages are included, spur gears are preferred and the engagements may be fine tuned by radial motions of the axles within the allowable range for spur gear engagements. This fine tuning can be used to compensate for small variations of roller diameters due to manufacturing tolerance variations or roller wear. As is well known, spur gears having a diameter in a range of say 4 inches to 8 inches, i.e., characteristic of rollers used in the invention, may typically be operated with an engagement variation from ideal operation produced by a radial motion of the axles, this variation being about 0.03 inches to 0.04 inches, dependent on the size of the gears. This range may be compared with typical engagements in conformable transfer nips, usually less than about 0.01 inch, indicating that interaxle adjustments can be made for practical variations of engagement such as required by individual nips used with redundant gearing according to the invention.

In embodiments above in which fiducial marks are used in order to monitor surface speeds or angular speeds of members including rollers or other elements, the fiducial marks on a primary image forming roller, an intermediate transfer roller, a transfer backup roller or a transport web may be provided to be removable and replaceable during the life of each of these members, e.g., by using an ink jet machine or other marking apparatus to apply new marks after old marks are removed.

Although intermediate transfer embodiments described above relate to intermediate transfer rollers and in particular to conformable intermediate transfer rollers, it will be appreciated that an intermediate transfer member web in the form of an endless loop having a conformable surface may be used in conjunction with a speed modifying force applied to the loop or another member coming into pressure contact with the web, such that the intermediate transfer web passes through a transfer pressure nip formed by a primary imaging member roller and a backup roller, in which nip a toner image previously formed on the primary imaging member is transferred to the conformable surface, the web subsequently moving through another transfer nip wherein the toner image is transferred to a receiver.

In the following embodiments, a speed modifying device is used to control or eliminate overdrive in a fusing station of an electrostatographic machine. As described above in the background of this invention, overdrive in a fusing nip can cause excessive wear of fusing station rollers and produce serious image quality degradation including large area image defects as well as smaller scale image smearing defects. The fusing station of the subject invention includes two rollers, at least one of which is a fuser roller, and at least one of which is conformable and preferably includes a relatively incompressible compliant elastomeric layer, or alternatively, the conformable roller includes a relatively compressible resilient foam. In other alternative fusing embodiments (not illustrated) the fusing station may also include a moving fusing web partially wrapped on a heated roller (on which no toner image is formed) passing between the rollers, with the web contained in a pressure nip formed between the two rollers. Alternatively, a transport web may be used to transport receiver sheets adhered to the web, e.g., electrostatically, through the pressure nip.

Figure 16A:
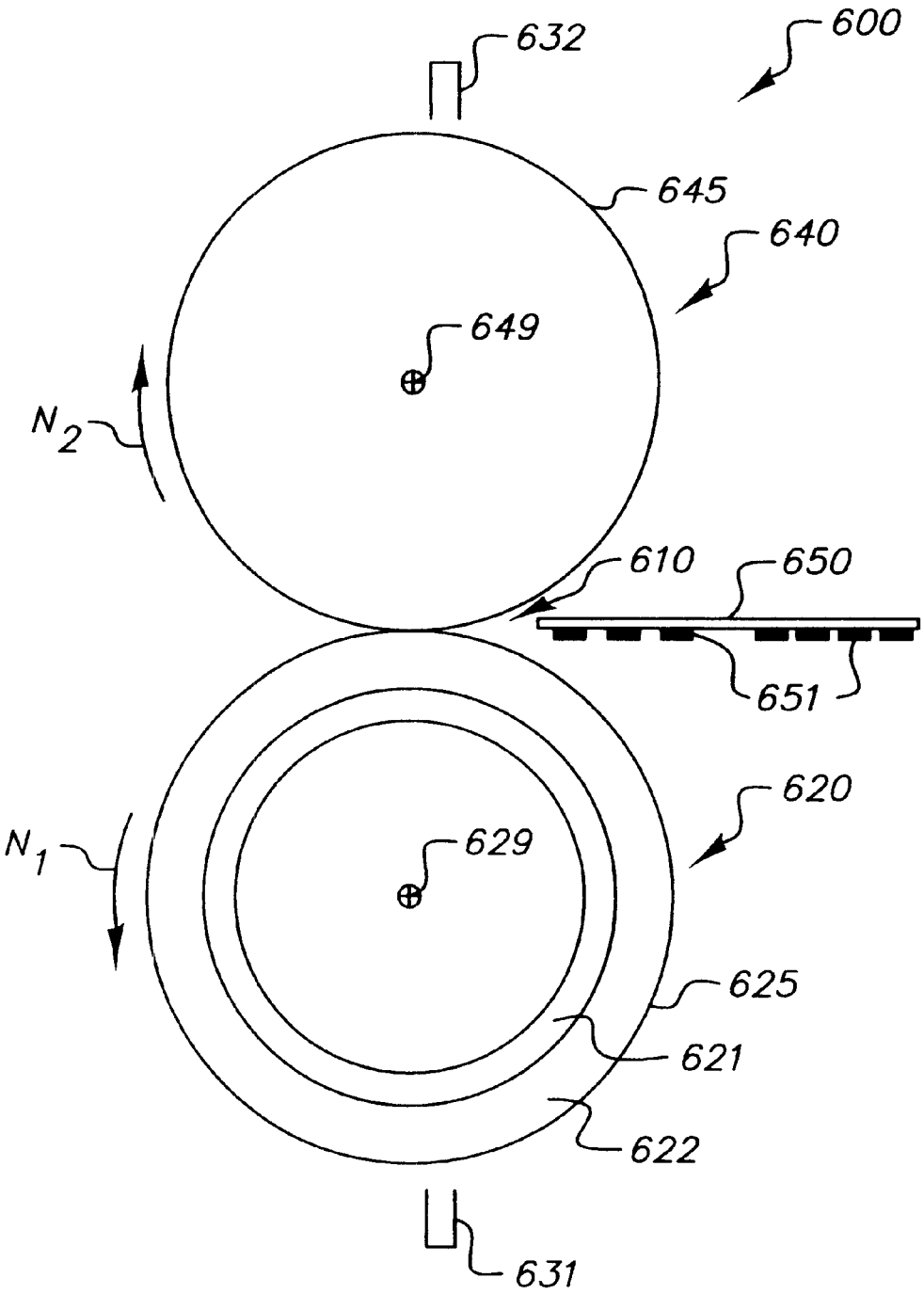
FIG. 16*a* is a schematic side elevational view of a fusing apparatus incorporating an embodiment of the invention.
Figure 16B:
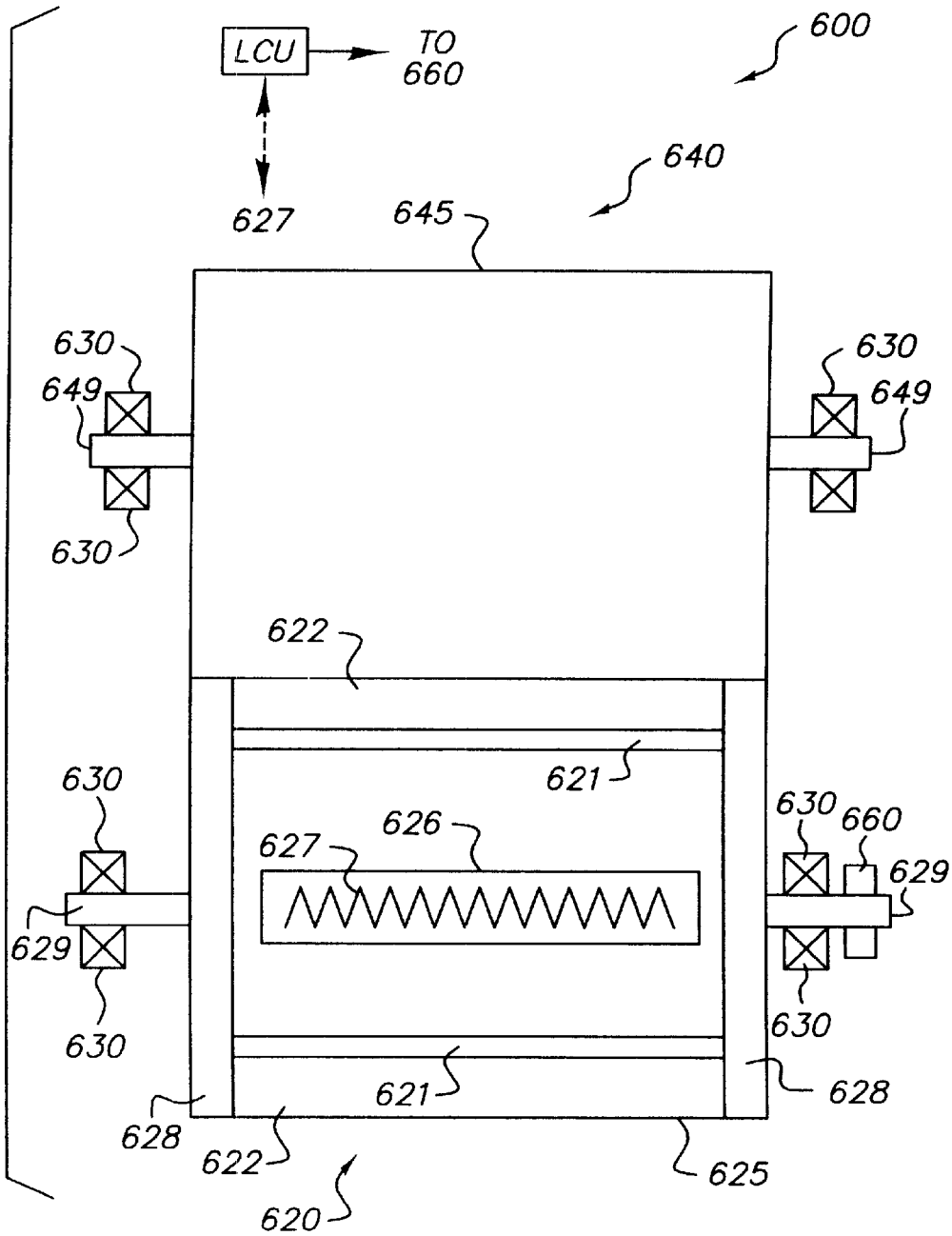
FIG. 16*b* is a schematic front elevational view of a portion of the apparatus of FIG. 16*a;*

FIGS. 16*a* and 16*b* show a simplex fusing station indicated as 600 which includes a conformable fuser roller 620 and a counter-rotating hard pressure roller 640. Fuser roller 620, moving in a direction indicated by arrow $N_1$, includes a rigid tubular cylindrical core member 621 preferably made from a metal, e.g., aluminum, and a plurality of layers 622 disposed about the core. The plurality of layers 622 includes a relatively thick compliant base cushion layer surrounding the core and a compliant release layer surrounding the base cushion layer. The individual layers of plurality 622 are not shown, and may include other layers such as for example subbing layers or a stiffening layer. Pressure roller 640 moving in a direction of arrow $N_2$ forms a fusing nip 610 with compliant fuser roller 620. Shafts 629, 649 are respectively supported for rotation by suitable bearings 630 as is well known. A receiver sheet 650, carrying on its underside an unfused toner image 651 facing the fuser roller 620, is shown approaching nip 610. The toner image may include one or more differently colored toner particles including black, cyan, magenta and yellow toners. The receiver sheet is fed into the nip by employing well known mechanical transports (not shown) such as a set of rollers or a moving web for example. The fusing station preferably has one driving roller, either the fuser roller or the pressure roller, the other roller being driven and rotated frictionally by contact. Alternatively, the receiver may be a continuous web, e.g., made of paper, which is frictionally driven through nip 610 by contact with rollers 620 and 640, or which is mechanically pulled through nip 610 and frictionally rotates rollers 620 and 640. The diameters of rollers 620 and 640 may be the same or may be different from one another.

The pressure roller 640 includes a core member and an optional surface layer coated on the core (individual layers not shown). The core may be made of any suitable rigid material, e.g., aluminum, preferably in the form of a cylindrical tube. The optional surface layer is preferred to be less than about 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ (from Minnesota Mining and Manufacturing). Alternatively, the optional surface layer may include a relatively hard poly(tetrafluoroethylene) or other suitable polymeric coating. A bare core having no conformable or compliant outer layer may include, for example, anodized aluminum or copper.

A heat source is used to heat the fuser roller 620. In a preferred embodiment shown in FIG. 16*b*, the heat source is internal to the fuser roller and may include, for example, an electrically resistive element located inside hollow core 621 provided for example with endcaps 628, the resistive element being ohmically heated by passing electrical current through it. An ohmically heated resistive filament may be used, e.g., filament 627 in axially centered tubular incandescent heating lamp 626, or other suitable interior source of heat within the core member may be used. Alternatively, the heat source may be included in one of the plurality of layers 622, e.g., in the form of a resistively heated wire or a resistively heated thin metallic layer, e.g., included in a printed circuit. Preferably, the heat source is controlled by a feedback circuit. For example, a thermocouple (not shown) may be used to monitor and thereby control the surface temperature of fuser roller 620 by employing a programmable voltage power supply (not shown) controlled, e.g., by a logic and control circuit (LCU) to regulate the temperature of filament 627. An auxiliary source of heat which is external to roller 620 (not shown) may be used.

A base cushion layer included in the plurality of layers 622 of an internally heated conformable roller 620 preferably includes a compliant elastomer. The base cushion layer (BCL) may include any suitable thermally stable elastomeric material, such as a fluoroelastomer, e.g., a Viton™ (from DuPont) or a Fluorel™ (from Minnesota Mining and Manufacturing) further including a suitable particulate filler to provide a useful thermal conductivity. Alternatively, the elastomeric BCL may include a rubber, such as an EPDM rubber made from ethylene propylene diene monomers further including a particulate filler, preferably of iron oxide. The elastomeric BCL may also include an addition cured silicone rubber with a chromium (III) oxide filler. However, it is preferred that the elastomeric BCL includes a condensation-cured poly(dimethylsiloxane) elastomer further including a filler which can be aluminum oxide, iron oxide, calcium oxide, magnesium oxide, nickel oxide, tin oxide, zinc oxide, or mixtures thereof. This filler preferably includes particles having a mean diameter in a range of approximately between 0.1 micrometer and 100 micrometers and occupying 5 to 50 volume percent of the base cushion layer, and more preferably, a mean diameter between 0.5 micrometer and 40 micrometers and occupying 10 to 35 volume percent of the base cushion layer. In a preferred embodiment, the filler includes zinc oxide particles. The elastomeric base cushion layer preferably has a thickness between 0.25 mm and 7.5 mm, and more preferably, between 2.5 mm and 5 mm. The elastomeric BCL preferably has a thermal conductivity in a range of approximately between 0.08 BTU/hr/ft/° F. to 0.7 BTU/hr/ft/° F., and more preferably, in a range between 0.2 BTU/hr/ft/° F. and 0.5 BTU/hr/ft/° F. The elastomeric BCL also has a Poisson ratio preferably in a range between approximately 0.4 and 0.5, and more preferably, between 0.45 and 0.5. In addition, the elastomeric base cushion layer preferably has a Young's modulus in a range of approximately 0.05 MPa–10 MPa, and more preferably, 0.1 MPa–1 MPa.

In an alternative embodiment, the heat source is external to the fuser roller 620. Preferably, an external heat source includes one or more heating rollers (not shown) contacting the outer surface 625 of the fuser roller and for example frictionally driven by roller 620. Alternatively, an external heat source includes a source of radiant energy (not shown), e.g., an infra red radiation source, which heats the surface 625 in non-contacting fashion from without. In this embodiment, lamp 626 or other internal source of heat is preferably not used. However, an internal heat source may be provided as an auxiliary source of heat.

A base cushion layer included in the plurality of layers 622 of an externally heated conformable roller 620 preferably includes a compliant elastomer material and filler, both of which are similar to those described above for the compliant elastomer included in the base cushion layer of an internally heated fuser roller. The filler preferably includes particles having a mean diameter in a range of approximately between 0.1 micrometer and 100 micrometers and occupying 3 to 30 volume percent of the base cushion layer, and more preferably, a mean diameter between 0.5 micrometer and 40 micrometers and occupying 5 to 20 volume percent of the base cushion layer. The elastomeric base cushion layer (BCL) of an externally heated conformable roller 620 preferably has a thickness between 0.25 mm and 25 mm, and more preferably, between 1.25 mm and 12.5 mm. The elastomeric BCL preferably has a thermal conductivity less than 0.4 BTU/hr/ft/° F., and more preferably, in a range of approximately between 0.1 BTU/hr/ft/° F.–0.3 BTU/hr/ft/° F. The elastomeric BCL also has a Poisson ratio preferably in a range between approximately 0.2 and 0.5, and more preferably, between 0.45 and 0.5. In addition, the elastomeric base cushion layer preferably has a Young's modulus in a range of approximately 0.05 MPa–10 MPa, and more preferably, 0.1 MPa–1 MPa.

Alternatively, the base cushion layer (BCL) of an externally heated fuser roller 620 is compressible and includes a resilient foam or sponge material which may include an open-cell or closed-cell foam, including felted foams. The BCL may also include elastomeric particles or ground up pieces which have been fused or sintered into a porous mass. Alternatively, the BCL may include individual compressible elements, such as for example a plethora of gas-filled spheres or walled bubbles embedded in an elastic matrix. Preferably, the compressible BCL included in an externally heated fuser roller 620 is a conformable material, having a Poisson ratio which is less than about 0.35, more preferably between about 0.25 and 0.35, and most preferably between about 0.25 and 0.29. It is preferred that a compressible BCL including a foam is relatively stiff, i.e., having a Young's modulus preferably in a range of about 0.05 MPa to 50 MPa, and more preferably about 0.1 MPa to 10 MPa. The solid phase of the foam or sponge included in the compressible BCL preferably has a Young's modulus in a range of about 0.5 MPa to 500 MPa, and more preferably, about 1 MPa to 100 MPa. The solid phase may be a fluoroelastomer, e.g., a Viton™ (from DuPont) or a Fluorel™ (from Minnesota Mining and Manufacturing). Alternatively, the foam or sponge may include a rubber, such as an EPDM rubber made from ethylene propylene diene monomers, which may further include a metal oxide particulate filler, e.g., iron oxide. As another alternative, the compressible BCL may include a poly(dimethylsiloxane) elastomer further including a metal oxide particulate filler, e.g., aluminum oxide, iron oxide, calcium oxide, magnesium oxide, nickel oxide, tin oxide, zinc oxide, or mixtures thereof. The compressible BCL may also include a polyimide foam which may further include a filler. A filler embedded in the solid phase preferably includes particles having a mean diameter between about 0.1 micrometer and 100 micrometers and about 3 to 30 volume percent of the solid phase of the base cushion layer, and more preferably, a mean diameter between about 0.5 micrometer and 40 micrometers and about 5 to 20 volume percent of the solid phase of the base cushion layer. The base cushion layer preferably has a thickness between about 0.5 mm and 25 mm, and more preferably between about 1.25 mm and 12.5 mm. The compressible BCL preferably has a thermal conductivity in a radial direction less than about 0.4 BTU/hr/ft/° F. in the most compressed region in the nip 610, and more preferably, in a range of about 0.1 BTU/hr/ft/° F.–0.3 BTU/hr/ft/° F.

In order to control overdrive of 640 by roller 620, a speed modifying device (SMD) 660 is used to apply a speed modifying force to shaft 629 or to a wheel attached coaxially to shaft 629 (not shown). SMD 660 may include, for example, a brake to apply a positive drag force or a positive torque. Alternatively, SMD 660 may include a friction brush, a torque generator or any other suitable speed modifying device. Alternatively, instead of the speed modifying device applying a drag or torque to axle 629, the speed modifying device may include a frictional means, e.g., a brush or other suitable mechanism, to apply a positive drag force to surface 625 of roller 620. Inasmuch as the applied speed modifying force is transmitted to nip 610 it will be evident that a speed modifying device may be used alternatively to apply a speed modifying force as is suitable to shaft 649 or to surface 645 of pressure roller 640, and for a combination of hard roller 640 and compliant elastomeric roller 620, a negative (accelerating) drag or torque can be applied to shaft 649 or a negative drag applied to surface 645. It may be desirable in some applications to apply speed modifying forces to both the fuser roller and the pressure roller. The value of drag or torque applied by SMD 660 is controlled by the LCU, such as by methods entirely similar to the methods described above used for the transfer embodiments of the subject invention, e.g., methods which in effect measure the peripheral speed of fiducial marks or indicia placed on, or in, one or both of the surfaces 625 and 625, or, methods which monitor the speed of fiducial marks located on one or both of shafts 629 and 649 or fiducial marks provided on a wheel secured coaxially to either or both of shafts 629 and 649, in a manner similar to that described above for transfer embodiment 200" of FIG. 13*a*.

When fuser roller 620 is externally heated by frictional contact with one or more heating rollers, as described above, the speed modifying force may alternatively be applied in a similar fashion to one or more of the one or more heating rollers.

The embodiment 600 of FIG. 16*a* illustrates a fusing station having a fuser roller member including a conformable layer and a pressure roller member which is hard. Alternative fusing station embodiments (not illustrated) may also be used which include a speed modifying device for applying a speed modifying force to one or both members. These alternative fusing station embodiments include: a conformable pressure roller with a hard fuser roller; and, a conformable fuser roller with a conformable pressure roller. A conformable roller of an alternative fusing station embodiment may be a roller having a relatively incompressible layer such as for example a compliant elastomeric layer, or, a roller having a relatively compressible layer such as for example a resilient foam or sponge layer. For these alternative fusing station embodiments it will be evident that, depending upon circumstances, a positive or negative drag force or torque is to be suitably applied by the speed modifying device(s) to one or both of the fusing and pressure rollers in order to reduce or eliminate overdrive.

Referring once again to FIG. 16*a, b* illustrating a simplex fusing station, an alternative embodiment includes a heat source for roller 640, either internal or external to the roller, such that the fusing station is a duplex fusing station, with an unfused toner image including one or more toners of different colors located on the top side of receiver 650, in addition to toner image 651 on the underside. In this alternative embodiment, roller 640 may be a hard roller or a conformable roller having respective mechanical characteristics of the materials and layer dimensions that are entirely similar to those previously described above.

A preferred method of using an LCU may be employed to control a speed modifying device (SMD) for any of the above-described fusing stations. This method includes fiducial marks formed or placed on, or in, the surfaces of both the fusing roller and the pressure roller. These fiducial marks, e.g., preferably in the form of identically spaced parallel fine lines or bars, are preferably perpendicular to the directions of rotation of the rollers and preferably have the same center-to-center distance on each roller. Preferably, the corresponding center-to-center distances are measured and confirmed to be the same prior to use, and are measurable at a convenient interval during the life of each of the rollers. The fiducial marks may be sensed by sensors as described above so that the surface speeds of the rollers can be in effect measured and an appropriate speed modifying force applied by a suitable speed modifying device. The fiducial marks may be included as permanent markings and may be placed for example near one edge of each of the rollers, preferably outside of the fusing area.

With specific reference to FIG. 16*a,* a sensor 631 can detect a number of fiducial lines or bars (not shown) located at the surface 625 of roller 620 and passing sensor 631 per unit time, i.e., at a frequency equal to f1 which is sent as a signal to, and stored in, the LCU. Similarly, a sensor 632 can detect a number of fiducial lines or bars (not shown) located at the surface 645 of roller 640 and passing sensor 632 per unit time, i.e., at a frequency equal to f2 which is sent as a signal to, and stored in, the LCU. Generally, as a result of overdrive or underdrive in nip 610, f1 and f2 will not be the same. A speed modifying force is applied, by a speed modifying device in a manner as described above, to one or both of rollers 620 and 640 such that frequencies f1 and f2 are preferably matched, whereupon it will be evident that the peripheral speed of roller 620 far from the nip 610 will then be the same as the peripheral speed of roller 640 far from the nip, and overdrive eliminated. The frequencies f1 and f2 are matched when a difference between them is null, i.e., f1 minus f2 is computed by the LCU to be equal to zero.

Alternatively, the center-to-center distances between fiducial lines or bars may not be the same on the two rollers, e.g., because of tolerancing errors during manufacture, or wear, or temperature differences, and so forth. The two sets of center-to-center distances are accurately measurable and stored in the LCU, e.g., prior to use, during use, or during a machine shutdown, whereupon the difference of frequencies, f1 minus f2, may be chosen appropriately by the LCU so that the application of the speed modifying force or forces eliminates overdrive. Alternatively, a predetermined amount of overdrive may in some circumstance be desirable, and hence an aim value of f1 minus f2 may be preset in the LCU to any suitable predetermined value, and the speed modifying force or forces applied so that this predetermined value is produced by the corresponding speed modifying device(s). A ratio of the frequencies f1 and f2 or other manipulation of the information sent to the LCU by the sensors may also be used to control the amount of desired overdrive. For example, when the two sets of center-to-center distances are accurately the same, overdrive is eliminated by the speed modifying device when the ratio f1/f2=1. In an alternative method, fiducial marks in the form of finely spaced lines having a known separation between them may be provided on shafts 629 and 649, or on wheels secured coaxially to shafts 629 and 649. A sensor (not shown) for measuring (in effect) a speed of rotation of shaft 629 detects a frequency of passage past the sensor of the respective fiducial marks and sends a signal to the LCU, and similarly another sensor is used to measure a speed of rotation of shaft 649 and sends a corresponding signal to the LCU. The LCU compares these frequencies (or speeds of rotation) and computes a speed modifying force or forces to be applied to one or both of the rollers 620 and 640 as described above in order to produce a predetermined amount of overdrive, including zero.

The fiducial marks on a pressure roller or on a fuser roller may be provided to be removable and replaceable during the life of the roller, e.g., by using an ink jet machine or other marking engine to apply new marks after old marks are removed.

Figure 17A:
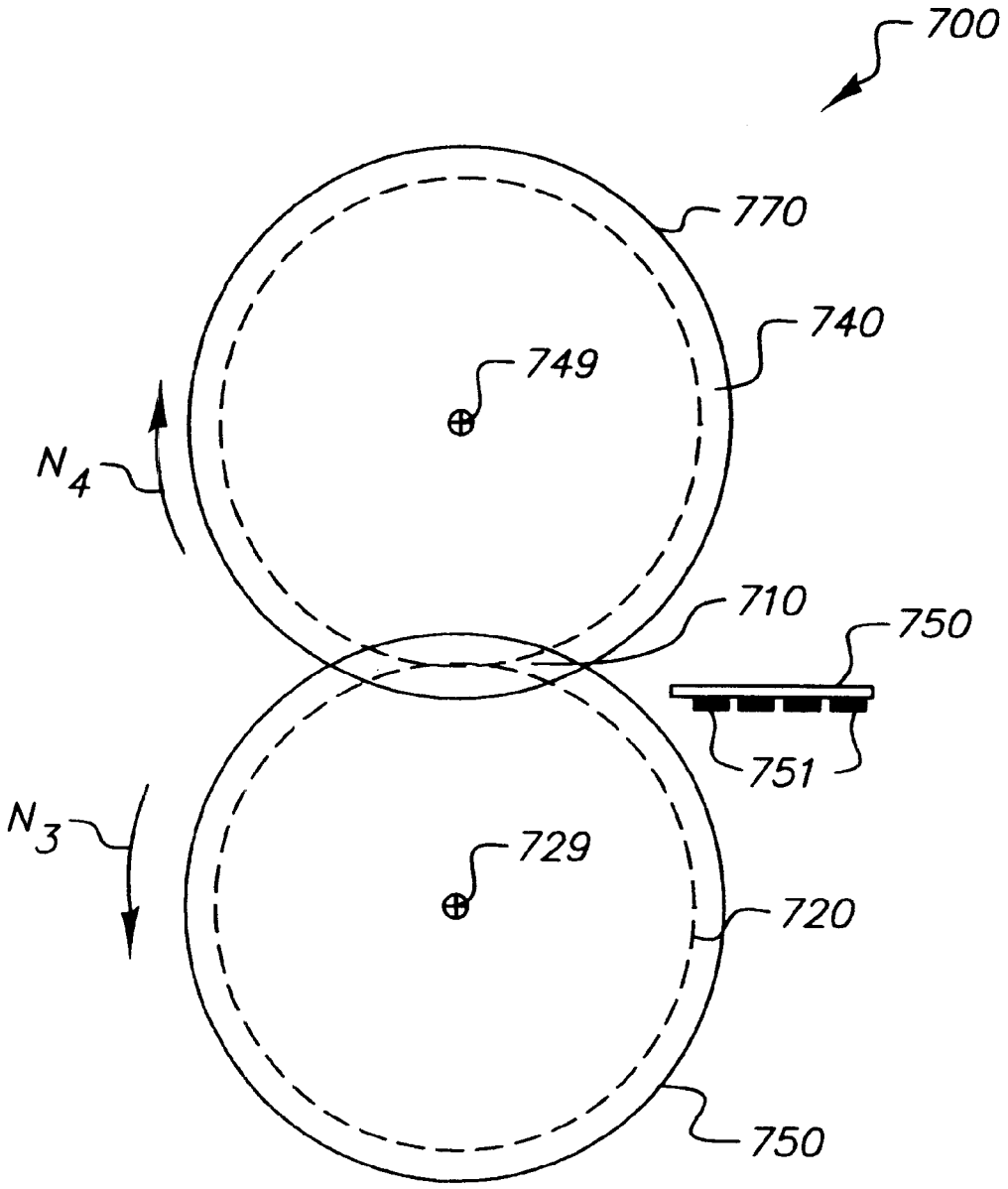
FIG. 17*a* is a schematic elevational view of a fusing apparatus incorporating another embodiment of the invention.
Figure 17B:
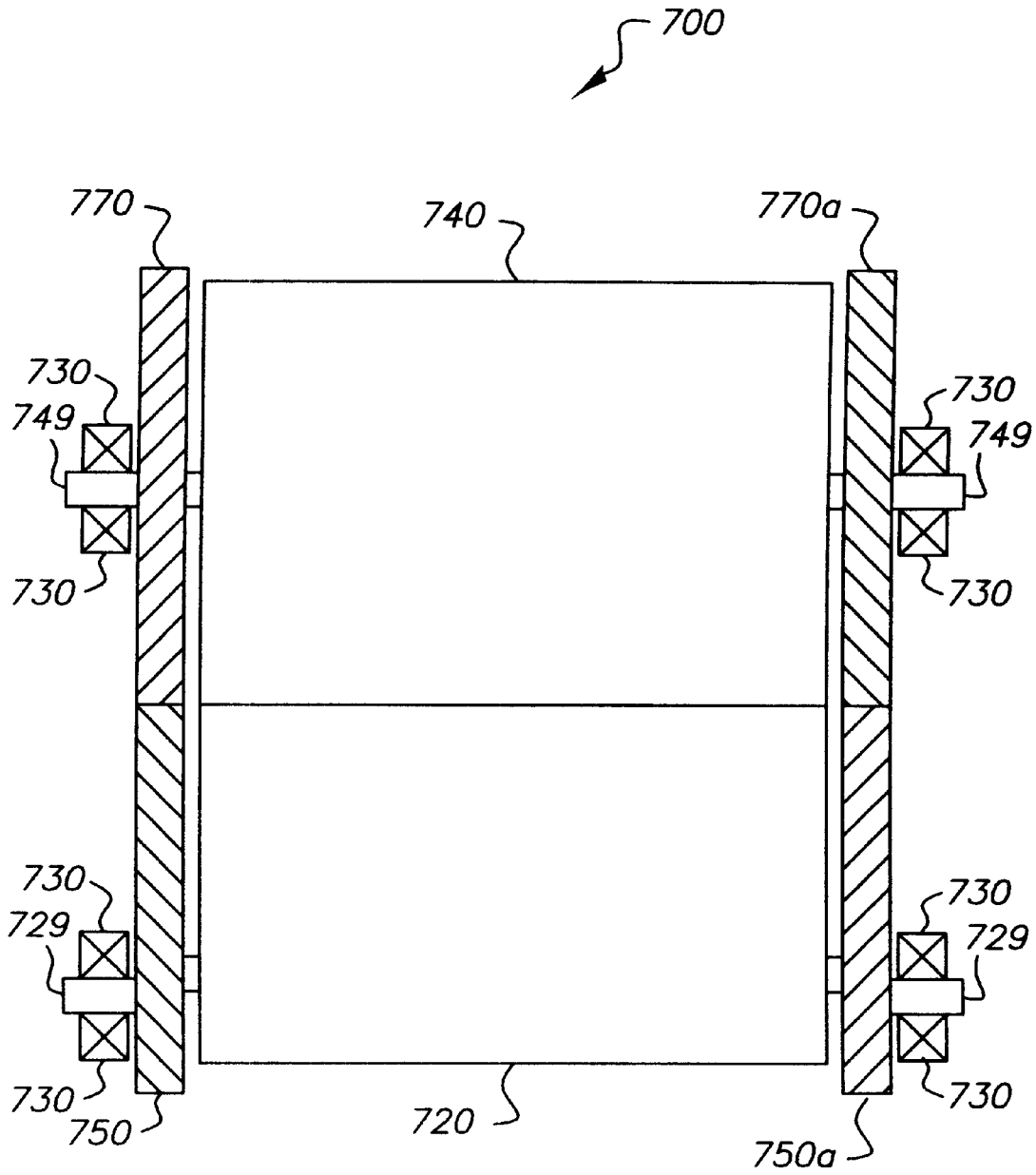
FIG. 17*b* is a schematic front elevational view of a portion of the apparatus of FIG. 17*a.*

Referring to FIGS. 17*a* and 17*b,* another embodiment of a simplex fusing station of the invention is designated as 700 and includes a pressure roller 720 rotating in a direction $N_4$ and forming a pressure nip 710 with a fuser roller 740 counter-rotating in a direction $N_3$. One of rollers 720 and 740 frictionally drives the other. A receiver sheet 750, carrying on its underside an unfused toner image 751 facing the fuser roller 720, is shown approaching nip 710. The toner image may include one or more differently colored toner particles including black, cyan, magenta and yellow toners. The receiver sheet is fed into the nip by employing well known mechanical transports (not shown) such as a set of rollers or a moving web for example. The material characteristics and layer geometries of rollers 720 and 740 are the same in all respects as those of the corresponding rollers 620 and 640 of embodiment 600. Alternative embodiments to embodiment 700 are also contemplated in which the material characteristics and layer geometries of fuser rollers and pressure rollers are the same in all respects as the material characteristics and layer geometries of the fuser rollers and pressure rollers provided in any of the above-described alternative embodiments to embodiment 600. Thus, either or both of rollers 720 and 740 may be conformable as described above, and may include a relatively incompressible elastomer or a relatively compressible foam or sponge. Fuser roller 720 may be heated by an internal or an external heat source as described above. Also, roller 740 may be a fuser roller heated by an internal or an external heat source in a duplex fusing station as described above. Rollers 720 and 740 are provided with respective corresponding coaxial shafts 729 and 749 which are supported for rotation by suitable bearings 730 as is well known. Redundant gearing linkages including preferably spur gears 750, 770 and optional gears 750*a,* 770*a* are provided as a speed modifying device to control overdrive in a self-compensating fashion according to the same manner as explained above for transfer station embodiments of the subject invention which include redundant gear linkages, i.e., including a nonslip frictional drive in nip 710. As described in detail above for these transfer station embodiments, the redundant gearing linkages 750, 770 and 750*a,* 770*a* of embodiment 700 produce speed modifying drag forces that control overdrive to any predetermined amount, including zero, as determined by a gear ratio provided in these linkages. Preferably, the gear ratio is chosen to substantially eliminate overdrive. For embodiment 700 and for any of the above-mentioned alternative embodiments of embodiment 700, a redundant gearing effectively replaces any of the other speed modifying devices included in embodiment 600 or included in the above-described alternative embodiments of embodiment 600.

A roller used in the any of above-described fusing station embodiments and alternative fusing station embodiments may be provided with a substantially cylindrically symmetric longitudinal profile such that an outer diameter of the roller varies along the length of the roller in order to compensate for humidity induced swelling of paper receivers, the roller preferably having a smallest diameter approximately midway along the length of the roller and largest near each end of the roller.

The invention has been described in detail with particular reference to certain preferred embodiments thereof, but it will be understood that variations and modifications can be effected within the spirit and scope of the invention.

What is claimed is:

1. For use in an electrostatographic machine, an apparatus for frictionally moving member by another member, comprising:

a movable first member having a first operational surface;

a second member having a second operational surface for forming a pressure nip with said first operational surface of said first member, said second operational surface of said second member being movable with said first operational surface of said first member in said pressure nip, at least one of said first member and the second member including a conformable elastomeric layer which has a Poisson ratio in the range of 0.45 and 0.50, wherein at least one of said first operational surface and said second operational surface deforms in said pressure nip;

a drive mechanism for moving one of said first member and said second member, said one of said first member and said second member thereby frictionally moving the other member in a nonslip condition of engagement; and a speed modifying device operatively associated with at least one of said first member and said second member in order to apply a force to change, to a predetermined difference, any difference in speeds between a speed of a first portion of said first operational surface and a speed of a second portion of said second operational surface, the first and second portions being situated away from said nip and located where any distortions caused by said pressure nip are negligible, said predetermined difference including zero.

2. The apparatus of claim 1 wherein said first member comprises a roller of substantially cylindrical configuration when not engaged with said second member.

3. The apparatus of claim 1 wherein said first member comprises a first roller and said second member comprises a second roller.

4. The apparatus of claim 3 wherein an axial first shaft supports said first roller without slippage between said first shaft and said first roller and an axial second shaft supports said second roller without slippage between said second shaft and said second roller.

5. The apparatus of claim 4 wherein said speed modifying device comprises a redundant gearing linkage connecting for rotation said first shaft and said second shaft, said redundant gearing linkage including a first spur gear on said first shaft and a second spur gear on said second shaft defining a gear ratio, wherein the gear ratio has a predetermined value, this predetermined value including a value that provides substantially zero overdrive and a value that provides a ratio of peripheral speeds of said first roller and said second roller that is close to but not equal to a natural speed ratio for a given engagement between said first roller and said second roller, said peripheral speeds being determined where any distortions of said first roller and said second roller are negligible.

6. The apparatus of claim 5 wherein said first roller is an intermediate transfer roller and said second roller is a primary imaging roller.

7. The apparatus of claim 5 wherein said first roller is an intermediate transfer roller and said second roller is a transfer backup roller.

8. The apparatus of claim 5 wherein said first roller is a conformable primary imaging member and said second roller is a transfer backup roller.

9. The apparatus of claim 5 wherein said first roller is a roller included in a fusing station and said second roller is a roller included in said fusing station.

10. The apparatus of claim 4 wherein said speed modifying device applies a controlled drag force or a torque to at least one of said first shaft and said second shaft, such drag force or torque having a predetermined value to provide a value of overdrive or underdrive, such value including zero.

11. The apparatus of claim 10 wherein said first roller is an intermediate transfer roller and said second roller is a primary imaging roller.

12. The apparatus of claim 10 wherein said first roller is an intermediate transfer roller and said second roller is a transfer backup roller.

13. The apparatus of claim 10 wherein said first roller is a conformable primary imaging member and said second roller is a transfer backup roller.

14. The apparatus of claim 10 wherein said first roller is a roller included in a fusing station and said second roller is a roller included in said fusing station.

15. The apparatus of claim 1 wherein one of said first member and said second member comprises an intermediate transfer web, said intermediate transfer web included in said pressure nip.

16. The apparatus of claim 1 wherein one of said first member and said second member comprises a primary imaging web, the primary imaging web included in said pressure nip.

17. The apparatus of claim 1 wherein said first member comprises a toner image bearing member roller and said second member comprises a transport web for transporting a receiver member through said pressure-generated nip, said transport web included in said pressure nip.

18. The apparatus of claim 1 wherein said second member comprises a receiver member, said receiver included in said pressure nip.

19. The apparatus of claim 1 wherein said first member comprises a roller and said speed modifying device applies a drag force to at least one of said first operational surface and said second operational surface.

20. The apparatus of claim 19 wherein said second member comprises a transport web for transporting a receiver member through said pressure nip.

21. The apparatus of claim 19 wherein said first member is an intermediate transfer roller and said second member is a primary imaging roller.

22. The apparatus of claim 19 wherein said first member is an intermediate transfer roller and said second member is a transfer backup roller.

23. The apparatus of claim 19 wherein said first member is a conformable primary image forming member roller and said second member is a transfer backup roller.

24. The apparatus of claim 19, wherein said first member is a roller included in a fusing station and said second member is a roller included in said fusing station.

25. The apparatus of claim 19 wherein said speed modifying device comprises at least one of a group including clutches, friction pads, brushes, brakes, motors, electrical windings, actuators, torque generators, magnetics, electric eddy current generator, piezoelectrics, hydraulics, and pneumatics.

26. For use in an electrostatographic machine, a transfer apparatus comprising:

a primary image forming member (PIFM) roller, said PIFM supported on an axial first supporting shaft;

a conformable intermediate transfer roller (ITR) in pressure engagement in a first nip with said PIFM, said ITR supported on an axial second supporting shaft;

a transfer backup roller supported on an axial third supporting shaft in pressure engagement with said ITR to form a second nip therewith;

a moving transport web for transporting a receiver member through said second nip, said moving transport web and receiver included in said second nip, said receiver adhered to said web, the ITR rotated by frictional contact with the transport web and receiver, the web contacting the backup roller thereby frictionally rotating the backup roller, said ITR contacting and frictionally rotating said PIFM; and wherein a first redundant gearing linkage connects for rotation said first supporting shaft and said second supporting shaft and a second redundant gearing linkage connects for rotation said second supporting shaft and said third supporting shaft, said first redundant gearing linkage including a first spur gear on said first supporting shaft and a second spur gear on said second supporting shaft defining a first gear ratio, said second redundant gearing linkage including said second spur gear and a third spur gear on said third supporting shaft, said second and third spur gears defining a second gear ratio, the first and second gear ratios having predetermined values, such that said predetermined values include values that provide a predetermined difference of speed between a peripheral speed of said PIFM and a speed of said moving transport web, said difference of speed having a value including zero and a value that is close to but not equal to a speed difference determined by natural speed ratios resulting from given respective engagements between said PIFM and said ITR and between said ITR and said transfer backup roller, said peripheral speed of said PIFM being determined where any distortions of said PIFM are negligible.

27. For use in an electrostatographic machine, a transfer apparatus comprising:

a primary image forming member (PIFM) roller, said PIFM supported on an axial first supporting shaft;

a conformable intermediate transfer roller (ITR) in pressure engagement in a first nip with said PIFM;

a transfer backup roller supported on an axial second supporting shaft in pressure engagement with said ITR to form a second nip therewith;

a moving transport web for transporting a receiver member through said second nip, said moving transport web and receiver included in said second nip, said receiver adhered to said web, the ITR rotated by frictional contact with the transport web and receiver, the web contacting the backup roller thereby frictionally rotating the backup roller, said ITR contacting and frictionally rotating said PIFM; and wherein a redundant gearing linkage connects for rotation said first supporting shaft and said second supporting shaft, said redundant gearing linkage including a first spur gear on said first supporting shaft and a second spur gear on said second supporting shaft defining a gear ratio, the gear ratio having a predetermined value, such predetermined value including a value that provides a predetermined difference of speed between a peripheral speed of said PIFM and a speed of said moving transport web, said difference of speed having a value including zero and a value that is close to but not equal to a speed difference determined by natural speed ratios resulting from given respective engagements between said PIFM and said ITR and between said ITR and said transfer backup roller, said peripheral speed of said PIFM being determined where any distortions of said PIFM are negligible.

28. In an electrostatographic reproduction apparatus, a method of transferring a toner image from a primary image forming member, comprising the steps of:

providing a pressure-generated nip between a primary image forming member (PIFM) roller having a first operational surface and a conformable intermediate transfer member (ITM) roller distorted in the pressure-generated nip, said ITM having a second operational surface;

forming a toner image on said PIFM for electrostatic transfer of the toner image to said ITM;

one of said ITM and said PIFM frictionally moving the other in a nonslip condition of engagement so as to move said toner image into said pressure-generated nip by rotating said PIFM;

establishing an electric field in said pressure-generated nip to urge transfer of said toner image from said PIFM to said ITM; and during the step of transferring said toner image from said PIFM to said ITM, applying a lateral speed modifying force to said pressure-generated nip so as to establish a predetermined difference in peripheral speeds between a speed of a first portion of said first operational surface and a speed of a second portion of said second operational surface, the first and second portions being situated away from said nip and located where any distortions caused by said pressure-generated nip are negligible, said predetermined difference in peripheral speeds including zero.

29. In an electrostatographic reproduction apparatus, a method of fusing a toner image to a receiver member, comprising the steps of:

establishing a pressure-generated nip between a rotating heated fuser roller having a first operational surface and a counter-rotating pressure roller having a second operational surface;

transporting a receiver member to said pressure-generated nip, said receiver having a surface holding an unfused toner image thereon;

rotating one of said fuser roller and said pressure roller so as to frictionally rotate the other in a nonslip condition of engagement, thereby moving said receiver member into said pressure-generated nip such that said surface holding an unfused toner image faces said fuser roller;

fusing said toner image to said receiver while frictionally moving said receiver member through said pressure-generated nip; and during the step of fusing said toner image, applying a lateral speed modifying force to said pressure-generated nip so as to establish a predetermined difference in peripheral speeds between a speed of a first portion of said first operational surface and a speed of a second portion of said second operational surface, the first and second portions being situated away from said pressure-generated nip and located where any distortions caused by the nip are negligible, said predetermined difference in peripheral speeds including zero.

30. In an electrostatographic reproduction apparatus, a method of transferring a toner image from a toner image bearing member to a receiver member transported by a moving transport web, comprising the steps of:

adhering a receiver member in a nonslip fashion to the moving transport web;

establishing a pressure-generated nip between a rotating transfer backup roller (TBR) and a counter-rotating conformable toner image bearing member (TIBM) roller having an operational surface, the TIBM being distorted in the nip and provided with an axial supporting shaft, said nip including said transport web and said receiver;

forming a toner image on said TIBM for electrostatic transfer of the toner image to said receiver;

rotating said TIBM in a nonslip condition of frictional engagement with at least one of said web and said receiver so as to move said toner image into said pressure-generated nip, said TBR being frictionally rotated in a nonslip condition of engagement with said moving transport web, a drive being provided to the transport web to drive the receiver member in the nip;

establishing an electric field in said pressure-generated nip to urge transfer of said toner image from said TIBM to said receiver; and while transferring said toner image from said TIBM to said receiver, applying a controlled speed modifying force to at least one of said shaft and said outer surface, so as to establish a predetermined difference in speeds between a speed of a peripheral portion of said operational surface and a speed of at least one of said web and said receiver adhered to the web, the peripheral portion of said operational surface being situated away from said nip and located where any distortions caused by the nip are negligible, said predetermined difference in speeds including zero.

31. In an electrostatographic reproduction apparatus, a method of fusing a toner image to a receiver member, comprising the steps of:

establishing a pressure-generated nip between a rotating heated fuser roller having a first operational surface and a counter-rotating pressure roller having a second operational surface, said fuser roller supported by a first supporting shaft and said pressure roller supported by a second supporting shaft;

transporting a receiver member to said pressure-generated nip, said receiver having a surface holding an unfused toner image thereon;

rotating one of said fuser roller and said pressure roller so as to frictionally rotate the other in a nonslip condition of engagement, thereby moving said receiver member into said pressure-generated nip such that said surface holding an unfused toner image faces said fuser roller;

fusing said toner image to said receiver by frictionally moving said receiver member through said pressure-generated nip; and during the step of fusing said toner image, applying a lateral speed modifying force to at least one of said first and second operational surfaces and said first and second supporting shafts, so as to establish a predetermined difference in peripheral speeds between a speed of a first portion of said first operational surface and a speed of a second portion of said second operational surface, the first and second portions being situated away from said pressure-generated nip and located where any distortions caused by the nip are negligible, said predetermined difference in peripheral speeds including zero.

32. In an electrostatographic reproduction apparatus, a method of transferring a toner image from a toner image bearing member to a receiver member transported by a moving transport web, comprising the steps of:

adhering a receiver member in a nonslip fashion to the moving transport web;

establishing a pressure-generated nip between a rotating transfer backup roller (TBR) supported by an axial first supporting shaft and a counter-rotating, conformable, toner image bearing member (TIBM) roller having an operational surface, said TIBM being distorted in the nip and provided with an axial second supporting shaft, said nip including said transport web and said receiver;

forming a toner image on said TIBM for electrostatic transfer of the toner image to said receiver;

rotating said TIBM in a nonslip condition of frictional engagement with at least one of said web and said receiver so as to move said toner image into said pressure-generated nip, said TBR being frictionally rotated in a nonslip condition of engagement with said moving transport web, a drive being provided to the transport web to drive the receiver member in the nip;

establishing an electric field in said pressure-generated nip to urge transfer of said toner image from said TIBM to said receiver; and while transferring said toner image from said TIBM to said receiver, applying a lateral speed modifying force to said nip by a redundant gearing linkage between said TIBM and said TBR, said redundant gearing linkage comprising spur gears having a predetermined gear ratio, said spur gears secured coaxially on said first and second supporting shafts, said predetermined gear ratio establishing a predetermined difference in speeds between a speed of a peripheral portion of said operational surface and a speed of at least one of said web and said receiver adhered to the web, the peripheral portion of said operational surface being situated away from said nip and located where any distortions caused by the nip are negligible, said predetermined difference in speeds including zero.

33. In an electrostatographic multicolor reproduction apparatus, an apparatus for transferring a plurality of toner images in register to a receiver member, comprising:

a plurality of image forming modules, each module respectively including a rotating generally cylindrical member having a conformable layer upon which toner images are formed, and another rotating member, said generally cylindrical member engaged in a transfer nip with said another rotating member in each module;

a transport device for transporting a receiver member serially into a respective transfer nip with each of said generally cylindrical members to transfer a respective toner image established on each generally cylindrical member to said receiver member, the generally cylindrical member of each module deforming in response to pressure in said respective transfer nip and being in a substantially nonslip condition of engagement with the receiver member in said respective nip; and a speed modifying device for applying a force to said generally cylindrical member of each module to control to a predetermined value an overdrive or an underdrive of the generally cylindrical member of each module, said predetermined value including zero.

34. The apparatus of claim 33 wherein said speed modifying device applies a drag force provided by a gearing connection between said generally cylindrical member of each module and said another rotating member in each module that forms a transfer nip with the generally cylindrical member.

35. The apparatus of claim 34 wherein said another rotating member is a backup roller that presses a receiver member in the respective nip.

36. The apparatus of claim 34 wherein said another rotating member is a primary image forming member.

37. The apparatus of claim 33 wherein said cylindrical member is supported by an axial shaft and said cylindrical member has an operational surface, said cylindrical member located in a transfer nip with a second member.

38. The method of claim 37 wherein said speed modifying force comprises a drag force provided by a speed modifying device, the drag force applied to at least one of said operational surface and said shaft.

39. The method of claim 37 wherein said speed modifying force comprises a torque provided by a speed modifying device, the torque applied to at least one of said operational surface and said shaft.

40. The apparatus of claim 33 wherein said another rotating member is supported by an axial shaft and said another rotating member has an operational surface.

41. The apparatus of claim 40 wherein said speed modifying force comprises a drag force provided by a speed modifying device, the drag force applied to at least one of said operational surface and said shaft.

42. The apparatus of claim 40 wherein said speed modifying force comprises a torque provided by a speed modifying device, the torque applied to at least one of said operational surface and said shaft.

43. For use in an electrostatographic machine, an apparatus including a system of rollers comprising one or more frictionally driven rollers, the rotations of said driven rollers being produced by a driving element in frictional driving relation to one of said driven rollers, wherein at least one of said driving element and said driven rollers includes a conformable outer surface, said apparatus including a speed modifying device for controllably applying a speed modifying force to at least one of said driven members in order to control to a predetermined value an overdrive or an underdrive of at least one of said driven members, said predetermined value including zero.

* * * * *